US009689542B2

(12) United States Patent
Anderson et al.

(10) Patent No.: US 9,689,542 B2
(45) **Date of Patent: *Jun. 27, 2017**

(54) EMERGENCY EXIT ROUTE ILLUMINATION SYSTEM AND METHODS

(71) Applicants: Jerry T Anderson, San Clemente, CA (US); Sonja K Zozula, San Clemente, CA (US)

(72) Inventors: Jerry T Anderson, San Clemente, CA (US); Sonja K Zozula, San Clemente, CA (US)

(73) Assignee: Sonja K. Zozula, San Clemente, CA (US)

( * ) Notice: Subject to any disclaimer, the term of this patent is extended or adjusted under 35 U.S.C. 154(b) by 6 days.

This patent is subject to a terminal disclaimer.

(21) Appl. No.: 14/851,979

(22) Filed: Sep. 11, 2015

(65) Prior Publication Data

US 2016/0003428 A1 Jan. 7, 2016

Related U.S. Application Data

(60) Continuation-in-part of application No. PCT/US2014/058416, filed on Sep. 30, 2014, and a (Continued)

(51) Int. Cl.
*F21S 8/00* (2006.01)
*F21S 9/02* (2006.01)
(Continued)

(52) U.S. Cl.
CPC ..... *F21S 8/033* (2013.01); *F21S 4/26* (2016.01); *F21S 8/032* (2013.01); *F21S 9/024* (2013.01);
(Continued)

(58) Field of Classification Search
CPC ..... F21V 33/00; G08B 7/06; G08B 7/062; G08B 17/10; F21S 8/032
(Continued)

(56) References Cited

U.S. PATENT DOCUMENTS 6,313,549 B1 * 11/2001 Moisan ..... G08B 7/062 307/66
2002/0057204 A1 * 5/2002 Bligh ..... G08B 7/062 340/691.1
(Continued)

*Primary Examiner* — Ali Alavi
(74) *Attorney, Agent, or Firm* — William H. Quirk; Jesse L. Frizzell; Rosenthal Pauerstein Sandoloski Agather LLP

(57) ABSTRACT

A system and method that helps evacuees exit a residential structure in the event of an emergency such as a fire, earthquake, security breach or the like, by providing emergency illumination around the periphery of an exit door and/or an alternative safe exit portal together with floor/ground level illumination along the path to the portal, and by providing an audible tone or voice recording to guide occupants to the exit portal. Various forms of linear illuminators parallel to and near the floor of an interior room or hallway provide the floor-level identification and illumination of the exit route to be used in the event of emergency, with some linear illuminators having directional aspects along hallways to lead evacuees toward an exit, and other illuminators outlining the perimeter of portals that are safe to exit through, the illuminators normally being hardly noticeable but having controllers and energizers to light up the planned exit route when emergency conditions are detected.

21 Claims, 19 Drawing Sheets

HOME SETTING

MULTI STORY COMMERCIAL SETTING

Related U.S. Application Data continuation-in-part of application No. 14/633,194, filed on Feb. 27, 2015, now Pat. No. 9,135,794, which is a division of application No. 13/763,160, filed on Feb. 8, 2013, now Pat. No. 8,998,438, which is a continuation of application No. 13/011,878, filed on Jan. 22, 2011, now Pat. No. 8,376,567, and a continuation of application No. 12/653,320, filed on Dec. 12, 2009, now Pat. No. 8,083,367, said application No. 14/633,194 is a continuation of application No. 12/653,320, filed on Dec. 12, 2009, now Pat. No. 8,086,367, said application No. 13/763,160 is a continuation of application No. 12/653,320, filed on Dec. 12, 2009, now Pat. No. 8,083,367.

(60) Provisional application No. 61/318,731, filed on Mar. 29, 2010, provisional application No. 61/336,501, filed on Jan. 22, 2010, provisional application No. 61/201,603, filed on Dec. 12, 2008, provisional application No. 61/884,485, filed on Sep. 30, 2013.

(51) Int. Cl.

| | |
|---|---|
| ***G08B 7/06*** | (2006.01) |
| ***G08B 17/10*** | (2006.01) |
| ***F21S 4/26*** | (2016.01) |
| *F21Y 101/02* | (2006.01) |

(52) U.S. Cl.

CPC ..... *G08B 7/062* (2013.01); *G08B 7/066* (2013.01); *G08B 17/10* (2013.01); *F21Y 2101/02* (2013.01)

(58) Field of Classification Search

USPC ..... 362/27, 147; 340/693.1, 540, 815

See application file for complete search history.

(56) References Cited

U.S. PATENT DOCUMENTS

| | | | | |
|---|---|---|---|---|
| 2003/0218545 | A1* | 11/2003 | Colberg | G08B 7/066 340/815.4 |
| 2007/0099095 | A1* | 5/2007 | Rudin | G02F 1/133516 430/7 |
| 2011/0133655 | A1* | 6/2011 | Recker | H02J 9/02 315/159 |
| 2011/0146120 | A1* | 6/2011 | Liu | G09F 13/18 40/541 |

* cited by examiner

HOME SETTING

MULTI STORY COMMERCIAL SETTING

EMERGENCY EXIT ROUTE ILLUMINATION SYSTEM AND METHODS

CROSS-REFERENCE TO RELATED APPLICATION

This application is a Continuation-in-Part of International Application No. PCT/US2014/058416, filed Sep. 30, 2014, entitled "Emergency Exit Route Illumination System and Methods," which claims the benefit of the filing date of U.S. Provisional Application Ser. No. 61/884,485, filed Sep. 30, 2013, entitled "Modular Emergency Exit Route Illumination System and Methods." This application is also a Continuation-in-Part of U.S. Non-Provisional application Ser. No. 14/633,194, filed Feb. 27, 2015, entitled "Modular Emergency Exit Route Illumination System and Methods," which is a Divisional application of U.S. Non-Provisional application Ser. No. 13/763,160, filed Feb. 8, 2013, entitled "Modular Emergency Exit Route Illumination System and Method," which is a Continuation of U.S. Non-Provisional patent application Ser. No. 13/011,878, filed Jan. 22, 2011, entitled "Modular Emergency Exit Route Illumination System and Methods," all of which claim the benefit of U.S. Provisional Applications Nos. 61/336,501 and 61/318,731, both entitled "Modular Emergency Exit Portal Lighting System and Method," filed Jan. 22, 2010 and Mar. 29, 2010, respectively, as well as to the prior co-pending U.S. patent application Ser. No. 12/653,320, filed Dec. 12, 2009, entitled "Emergency Exit Route Illumination System and Methods," and to its previously co-pending U.S. Provisional Application No. 61/201,603, bearing the same title, filed Dec. 12, 2008. By this reference, the entire disclosures, including the claims and drawings, of all of the foregoing applications are hereby incorporated by reference into the present disclosure as though now set forth in their entirety.

BACKGROUND OF THE INVENTION

1. Technical Field

This invention relates to the field of illumination of safe exit doorways, windows, stairs, paths of egress or other safe exit portholes or other portals of an enclosed or semi-enclosed structure, such as a private residence, to help evacuees/occupants more swiftly and safely evacuate such a structure in the event of a fire, heavy smoke event, earthquake, security breach, and/or the presence of unsafe levels of hazardous gasses or other noxious fumes or any other emergency or event which its user desires to be informed of through its activation. The invention also relates to the materials, articles and processes used for exit illumination systems, as well as to how and when to use the same. The invention also relates to the field of providing a new and unique form of egress-marking visible notification appliance technology designed to be integrated into code-compliant fire-related notification appliance circuits and other security systems, access control systems and other types of systems to deliver emergency exit and egress path illumination in varying forms to the occupants of the residences, buildings, facilities and structures, maritime vessels, recreational vehicles, airplanes, trains and other vehicles, and other locations where such technology may be useful.

2. Background Art

"According to the Federal Emergency Management Association (FEMA), more people die annually in the United States from fires than all other natural disasters combined . . . "

People regularly become quickly confused and disoriented in building structures under siege by fire, smoke and other perilous situations. In particular, when building structures are on fire or are otherwise experiencing a heavy smoke event from smoldering materials, smoke fills the building structure, floor by floor, space by space, from the ceiling down toward the floor. That is, smoke first fills areas overhead, closest to the ceiling, and as a space fills with smoke, the floor levels are the last areas to become visually occluded by smoke.

Per FireHouse.com, "on average, 8 people die every day in the United States in residential fires. It is estimated that 75 percent of ALL fire-related deaths are due to smoke inhalation brought about by disorientation."

In residential settings, there are typically no means by which an evacuee(s) can identify a safe exit doorway or other portal as most residential structures are not required to provide "EXIT" signage above or near the safe exit doorways.

In commercial settings, where "EXIT" signage is typically required, those signs are less than ideal once a fire has begun and the resulting smoke begins to quickly fill the structure. Because of the way that smoke fills a building structure (described above), "EXIT" signs, which by code are often required to be affixed "above" an exit portal, are the first and primary luminary devices to provide safety knowledge to evacuees and, regrettably, are one of the first things to disappear from sight during fire and heavy smoke. Obviously, an "EXIT" sign above a doorway which is invisible to evacuees is relatively useless as it can no longer successfully impart the knowledge that it was intended to pass along to such evacuee(s) in the crisis due to its occlusion by the increasingly-dense smoke in the areas proximate to its installation.

Currently, it is exceptionally rare to find a private residential setting wherein any lighted signage is used to identify a safe exit door. In commercial settings, where such signage is required by law, current "EXIT" sign location/placement is generally accepted primarily because the location of the sign is "out of the way" and is generally clear of passers-by, cleaning and maintenance staff's vacuum cleaners, carts, hand-trucks moving goods into and out of the building structure and other normal use of the building structure that could damage, break or otherwise disable the device. Notwithstanding the safe place for such signage to be installed and to be maintained, the location is one of the worst places for its intended purpose during smoke and fire events.

Numerous quotes, statistics and facts regarding structure fires in the US directly relate to the need for the preferred embodiments of the present invention. The following are some examples:

According to the Unites States Fire Administration, "approximately 2,865 people die in residential fires every year," which is the equivalent of the 9/11 life loss tally every year.

Per FireHouse.com, "on average, 8 people die every day in the United States in residential fires. It is estimated that 75 percent of ALL fire related deaths are due to smoke inhalation brought about by disorientation."

One of the most heart-wrenching statistics is that "more than 40 percent of residential fire related deaths among children, ages 9 and younger, occur when the child is frantically attempting to escape his/her own house."

"Every 20 seconds, a fire department responds to a fire somewhere in the United States."

"Once a minute, a fire occurs in a structure."

"Home is the place where you feel safest. But your home is also where you are most likely to die in a fire. Four out of five fire-related deaths among civilians occur in the home."

"Today, people who die in fires typically die in ones and twos, in their own homes and vehicles."

"In 2013, U.S. fire departments responded to an estimated 1,240,000 fires. These fires resulted in 3,240 civilian fire fatalities, 15,925 civilian fire injuries, and an estimated $11.5 billion in direct property loss," based on data reported to NFPA's "Fire Loss in the United States During 2013."

"Most fire deaths are not caused by burns, but by smoke inhalation."

"As a fire grows inside a building structure, it will often consume most of the available oxygen, slowing the burning process. This "incomplete combustion" results in toxic gases."

"In addition to producing smoke, fire can incapacitate or kill by reducing oxygen levels, either by consuming the oxygen, or by displacing it with other gases. Heat is also a respiratory hazard, as superheated gases burn the respiratory tract. When the air is hot enough, one breath can kill."

It is projected that one out of every 5 homes in the U.S. will have a fire, burglary, or carbon monoxide poisoning in the next 6 years. "Homes" includes dwellings, duplexes, manufactured homes (also called mobile homes), apartments, row-houses, townhouses and condominiums. Other residential structures, such as hotels and motels, dormitories, barracks, rooming and boarding homes, and the like, are not included in this statistic.

Analogous challenges are presented in virtually any type of disaster or emergency situation that requires immediate evacuation of a building structure, whether due to fire, flood or earthquake, or whether due to human threat such as a security breach, hazardous gas release, terrorist attack, bomb threat or the like.

Common modern visible notification appliances in fire alarm systems utilize a single-point of high-intensity light xenon lamp and lens to emit intense stroboscopic pulses of light into their indigenous areas as a form of "indirect" lighting to alert occupants and to assist occupants of a building in hopefully locating a path of egress and the exits to evacuate the space, area or building. These appliances are also utilized in sleeping areas to "wake" slumbering occupants where higher intensity flashes, 17 candelas luminosity, are used to wake sleeping occupants.

These conventional strobes pump their light into a broad area of the room or space to light up the area for occupants to see enough of the space or area to navigate to an exit. In fire alarm systems, conventional traditionally recognized xenon emergency strobe lights are required to be installed on the ceiling or up high on the wall at or above 80" inches and below 96" in height unless the ceiling height of the room will not permit same. Common emergency lighting and exit signage appliances are also typically a point-source light which is installed elevationally high on a wall or above a doorway. They are designed to provide ambient light and exit location information to people in a building crisis such as fire, power failure and other emergency events. Alternatively, the present invention, herein referred to as an Egress Marking Visible Notification Appliance™ (EMVNA™), is installed all of the way around the periphery of an exit door and/or along a path of egress, up high and at lower levels, in a much more effective configuration when smoke from fire begets the extinction of light; an all too common phenomenon in fire. Unlike common visible notification appliances in fire alarm systems, emergency lighting appliances and exit signage appliances, the EMVNA captures the value of light as an alerting, demarking, and directional medium and place it in exactly the right format and locations at exactly the right time, i.e. during a building evacuation event or emergency.

In comparison to the EMVNA, traditionally recognized conventional emergency strobes do not "directly" identify the exit point or path of egress like the EMVNA. In contrast, The EMVNA, even though it is also a stroboscopic luminary designed to provide alerting functions and it does deliver lower intensity ambient-type lighting like strobes, is NOT intended to perform the same functions as traditional conventional emergency strobe lighting devices. Its moderate intensity light output and light color is specifically designed not to create flash blindness in evacuating occupants and to provide them with a light color that is profoundly easy to see and process. The EMVNA is not intended to wake sleeping occupants and it is not intended to provide standard xenon strobe light intensities of light. Rather it is intended to alert, demark and direct occupants via an alternative location-of-light, intensity-appropriate and hue of color configuration designed to be "superior in its effectiveness and safety".

The activation of this new form of egress-marking visible notification illumination in fire alarm control panel driven systems is driven by a fire alarm control panel's activation and the resulting actuation of its notification appliance circuitry or through another integrated system's activation. It can also be integrated with emergency lighting appliances, devices and systems; exit lighting appliances, devices and systems; path-marking systems; as a component in an array security system components and devices in a security system; as well as access control systems. This new system is designed to deliver emergency alerting and directional illumination at elevationally high, low, or simultaneously both high and low, locations in space, to highlight safe exit doorways, windows, stairs or other safe exit portholes or other portals, or predetermined paths of egress and/or intermittent points of emergency alerting and directional illumination along such paths of egress of an enclosed or semi-enclosed structure as identified above.

Few material advancements in visual notification devices have occurred since their initial entry into the marketplace. This segment of the industry went from almost total obscurity to literally blowing up in the 1990s when the Americans with Disabilities Act of 1990, et seq., (ADA) codes were enacted. As enforcing authorities having jurisdiction (AHJ's) have developed an understanding of the current technology, notification appliances have emerged as an important, yet somewhat static and mundane, part of fire safety and building operations worldwide. And, as acceptance of their importance to fire safety has been incorporated into fire and building codes, reliance on them nearly everywhere is almost a given. Generally, it was just a limited few pioneers who were first to market the modern visible notification appliance products; mostly large, well-capitalized companies have inherited the benefits of being founders of what now has evolved into a multi-billion dollar industry with sales approaching four times U.S. domestic sales annually worldwide.

Today, the Egress-Marking Visible Notification Appliance (EMVNA) technology interrupts this trend by delivering a unique and much more effective appliance with versatility, functionality, and overall efficacy than that of conventional traditional visible notification appliances. Until the advent of the EMVNA, no other appliance has entered the market which successfully combines a system-integrated visible notification appliance with exit-marking capabilities. Traditional code required system-integrated visual notification appliances and other exit-path marking device's typical placements and configurations, while immensely important as an acceptable means of visual notification to date, are materially less efficient than the EMVNA technology in delivering the visual notification message to occupants as smoke pours into an occupied space in a fire and fills the space from the ceiling down. The commonplace emergency strobes, emergency lighting and exit signs, and their systems, though important to preserve for a myriad of reasons, fall short in a number of ways as the graph below indicates.

Some have tried to overcome such challenges and problems by designing creative exit lighting systems, but their attempts have fallen far short of the ideal. Among those are the inventors of the following patents: U.S. Pat. Nos. 4,794,373, 5,130,909, 5,343,375, 5,418,523, 5,612,665, 5,755,016, 5,815,068, 6,025,773, 6,237,266, 6,646,545, 7,114,826, 7,255,454 and 7,391,319.

SUMMARY OF THE INVENTION

It is a fundamental object of the present invention to overcome the obstacles and challenges of the prior art in a way that helps save lives and avoid injury by helping to orient occupants of a home, other residential structure or commercial setting in the event of an emergency, power failure, or other crisis, highlighting the predetermined exit portal and guiding occupants toward the exit portals through the use of illumination.

Objects of focus for this instant application include providing inconspicuous and inexpensive life-saving systems to help direct home, building, and facility occupants to safety in an emergency, as well as methods and related assemblies that can be readily commercialized, easily installed, easily tested, and easily used. Aspects of the invention address these objects in part by providing linear illuminators to highlight the border of the preferred exit window or doorway (each, a "portal" or "porthole") in an emergency without necessarily requiring complete integration into smoke alarms or other alert, emergency, or safety systems. Its ability to be deployed in a myriad of layout formats and alternative configurations provides exceptional flexibility in the field for architects, fire authorities having jurisdiction, building code authorities, facility and building engineers or other authorities dictating the fire, safety and security details of any given residence, building, facility, structure, maritime vessel, airplane, train, recreational or other vehicle in their emergency preparedness duties and obligations. Our objects also include reducing the costs to acquire and implement life-saving emergency exit lighting, especially in the home setting. Related objects include providing systems that can easily be acquired and implemented by or for the disabled, poor and elderly.

Aspects of some of the inventions to be claimed include an easily-installed home emergency exit illumination system that brightly illuminates the path to a portal, and/or the outline of the portal itself, through which an occupant can escape fire & smoke. Aspects of the invention serve the object of readily identifying the portal by providing alarm-activated linear illuminators positioned to brightly highlight the perimeter of the portal and portions of the path to the portal. Commercialized aspects of the invention are designed to provide building, facility and structure owners, operators, tenants, and managers thereof, specifically in public accommodation settings, with the opportunity to provide all occupants of a building, facility or structure with a reliable hard-wired or wirelessly integrated version(s) of this invention.

Still another object is to provide an aesthetically unnoticeable system that does not detract from the interior design of the home or workspace when the system is not responding to an emergency situation. This object is served in part through the use of linear illuminators that are virtually invisible and undetectable when not energized.

Embodiments of the invention include combinations of well-known individual electrical parts, sensors, printed circuit board(s), and plastic or metal housing components and various luminary/light sources integrated to create a system and method for providing emergency illumination and possibly directionality (i.e., information about which direction to go) to areas around, near or adjacent to an exit door, window, stairwell/staircase or otherwise as may be utilized in a residential or commercial enclosed or semi-enclosed structure to demark emergency exits. Such systems may be used in any part of an enclosed or semi-enclosed structure to provide emergency illumination of a safe exit, to provide additional floor/ground level illumination, and to identify the safe exit portal or shelter in place location which a person seeking emergency egress should exit to or through in the event of fire, smoke, earthquake, terrorist attack or other crisis or emergency condition, such as power failure, that precipitates the immediate relocation of occupants to safe areas and/or the complete evacuation of the structure.

Preferred embodiments may include a single-station form which performs as a stand-alone module, or a system-integrated form which, as the name suggests, may be integrated with existing detection systems (such as fire/smoke detection, security systems, noxious gas detection, and the like) and other exit and emergency lighting appliances or systems currently being utilized within the structure.

Preferred embodiments also exploit circuitry and systems in existing fire alarm control panels, access control panels and drivers, burglar and security system panels, other alarms and/or other automated or manually triggered systems to automatically energize an illumination system that highlights both exit portals (i.e., windows or doorways) as well as at least a portion of the path leading to the portal. Preferred embodiments might also exploit existing DC power backup supplies used by any of the aforementioned systems, appliances, and/or devices. Although the system can be integrated with a smoke detection module, it preferably is packaged with an illumination controller linked to lengths of linear illuminators, where the controller operates in response to the audible alarm signal from smoke detectors, carbon monoxide detector alarms, a firefighter P.A.S.S. device or other useful audible alarms or, if integrated, it would respond to its integrated system's activation protocols designed to trigger its operation where other emergency condition detectors in the home, commercial setting, industrial setting or elsewhere where these alerting and notification systems may be required or used. The controller is preferably adapted for mounting above the top edge of or near the portal egress path or pathpoint or into a UL rated electrical junction box so the supplied illuminator lengths, in varied, often trim-to-fit lengths can extend symmetrically left and right from that location, to partially or completely illuminate the portal and the path to the portal independently or as an extension of another emergency lighting or exit demarcation (sign) device or appliance. With an assortment of approaches that may or may not be added in a system, variations may also convey directionality to the occupant in order to alert the occupants of the structure, demark the path or area toward which the occupant should travel and help lead or direct the occupant to and through the predetermined exit portal.

The Egress Marking Visible Notification Appliance (EMVNA) is a technologically advanced integrated fire-alarm, security, access control and other building system and method which provides a unique visible notification appliance system and method for emergency situations, such as fire, power failure and other occupant relocation or evacuation events in residences, buildings, facilities and structures, maritime vessels, recreational vehicles, airplanes, trains and other vehicles. The EMVNA is a transgenerationally designed notification appliance which has been designed to be passively compatible with all other visible notification appliances operating in a given space on a notification appliance circuit (NAC) through its copyrighted proprietary firmware driving the device and is designed to be integrated into other emergency lighting and exit demarcation appliances (signage) as an extension of their intended purpose to increase their efficacy for occupants, given their current inability to provide the marginal benefits that the present invention affords them unless included. The EMVNA is designed to anticipate that all or parts of the EMVNA may be sheathed, coated, and/or otherwise shielded or contained in protective materials, containers or waterproofing process covers or boxes (such as a Hoffman box, Panduit channeling, or Plexiglas covers) to allow for its use in hazardous or wet interior or exterior locations.

The EMVNA is a supervised device being supervised similarly to other common dumb-device visible notification appliances in a NAC and is specifically designed to be a low power consuming passive visible notification appliance in the NAC, compatible with, but totally independent of, other visible notification appliances operating in the common NAC. The EMVNA is specifically designed not to interfere, hinder or otherwise limit or affect any other device's ability to operate on the common indigenous NAC.

The EMVNA provides visible stimuli and information to users, emergency response personnel, and occupants. At an exit doorway, and/or along a predetermined path of egress, the EMVNA provides floor to top-of-jamb illumination or low-level illumination, respectively, in a code-compliant fashion or manner. When configured as part of a fire alarm system, the EMVNA operates in the notification zone in a flash-synchronized manner when the system is configured to flash. When integrated into an emergency lighting, exit demarking or path-marking system or connected to appliances integrated therein, the EMVNA becomes an extension of the system or appliance. In all configurations, its luminaries may consist of linear, point-source or combinations of these types of luminaries configured to emit a flashed or static emergency light message of appropriate intensity to occupants, users and emergency response personnel in order to: (i) initiate emergency action; (ii) demark the exits and/or predetermined paths of egress; and (iii) direct users, emergency response personnel, and occupants to such exits or shelter-in-place safe quarters or rooms or along such predetermined paths of egress in buildings or outdoors for evacuation or relocation purposes.

The inventions are to be generally defined in the appended claims, as they may be supplemented or amended from time to time. However, those of skill in the art will recognize many other aspects of our inventions from the following descriptions, considered in light of the prior art. It must be understood that many other aspects of our inventions and many other alternatives, variations, substitutions and modifications will also fall within the scope of the inventions, both those inventions that are now claimed and those inventions that are described but not yet claimed.

with an integral lengthwise flange 320 to enable mounting of illuminator 20' behind baseboard 160, for many of the embodiments without a pre-formed groove 165 in baseboard 160.

Figure 15:
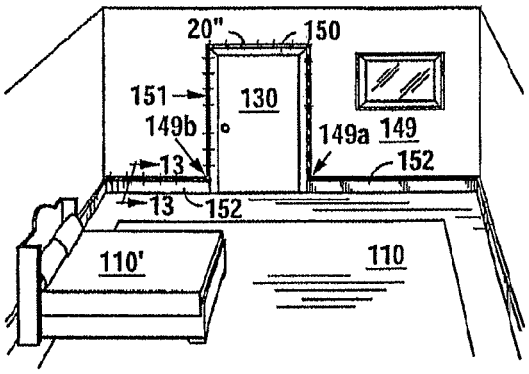

FIG. 15 is a perspective view from within room 110 of building structure 100, showing amongst other things a preferred placement of illuminator 20 highlighting the outline of door 130.

Figure 11:
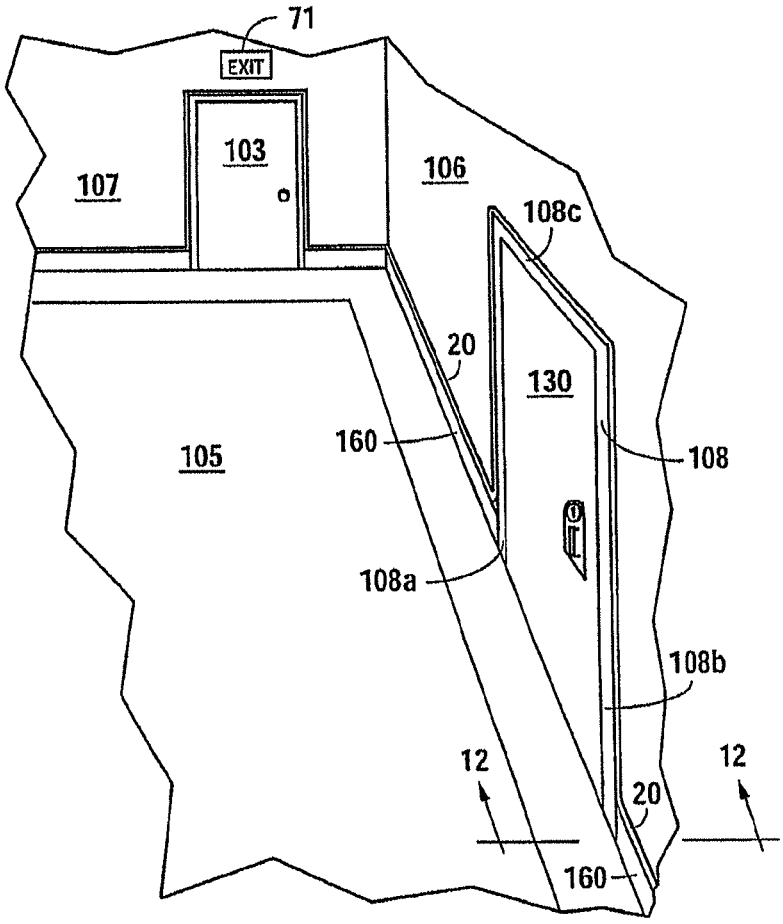
FIG. 11 is a perspective view of the internal portion of hallway 105 of building structure 100 or 100' of prior figures, showing an embodiment for the placement of a linear illuminator 20 that is characteristic of numerous embodiments of the present invention.
Figure 16:
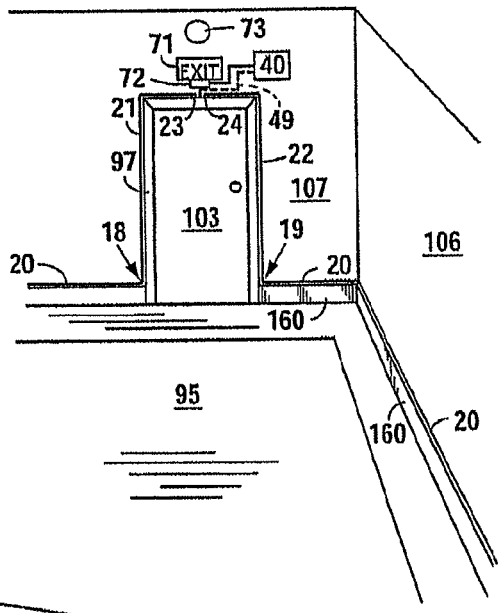

FIG. 16 is a perspective view of the internal portion of hallway 105 much like that of FIG. 11, except with a closer perspective of exit door 103, illustrating more detail on the placement of opposite courses 21 and 22 of linear illuminator 20 relative to that exit door 103.

Figure 1A:
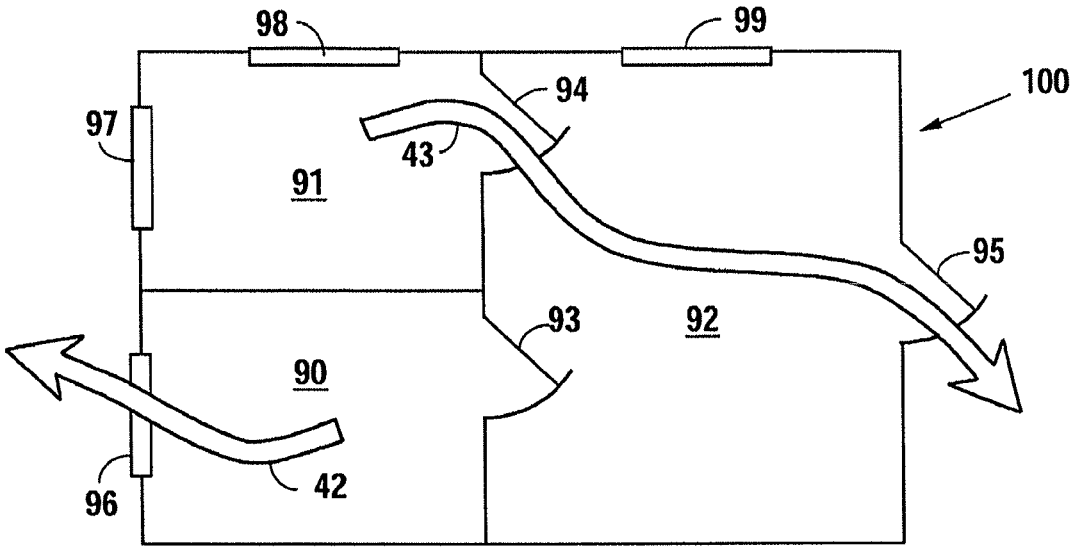
FIGS. 1A and 1B show simplified general floor plans of a home structure 100 and an upper floor of a multi-story commercial structure 100', respectively, to be used as reference for describing preferred variations of exit route illumination subsystems 40 and 40' installed in the respective structures 100 and 100'.
Figure 1B:
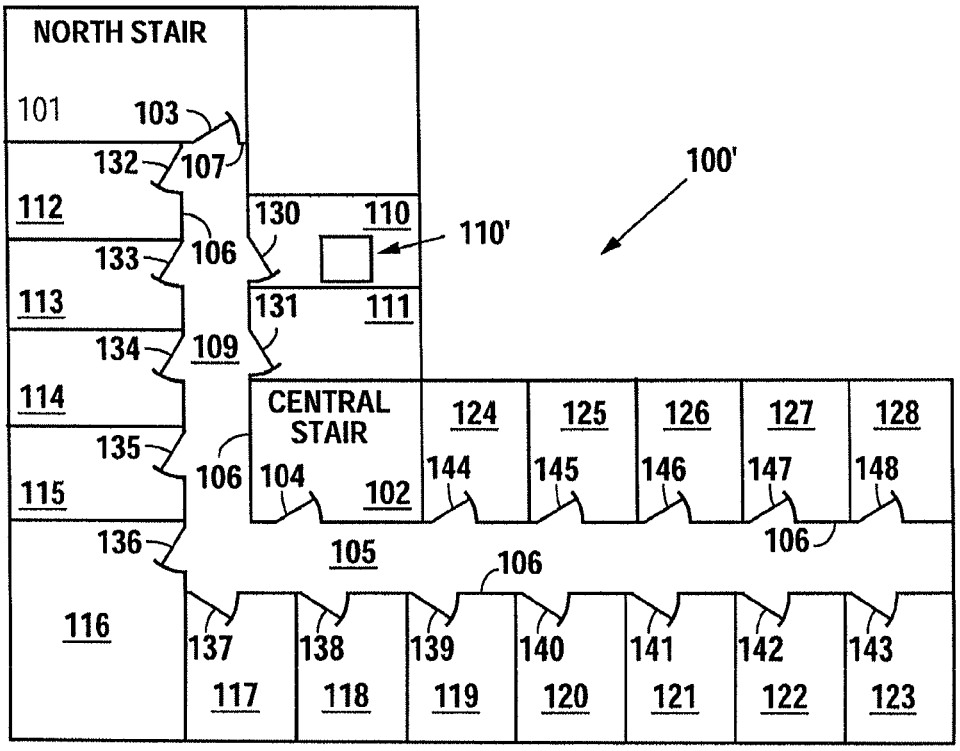
Figure 17:
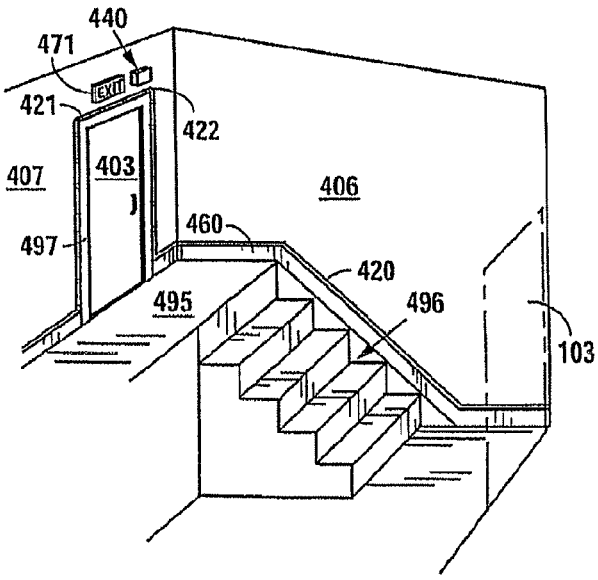

FIG. 17 is a perspective view from within a stairwell such as North Stair 103 of FIG. 1B, to illustrate another and/or an expanded embodiment of an exit route illumination subsystem 40 according to teachings of the present invention.

Figure 18:
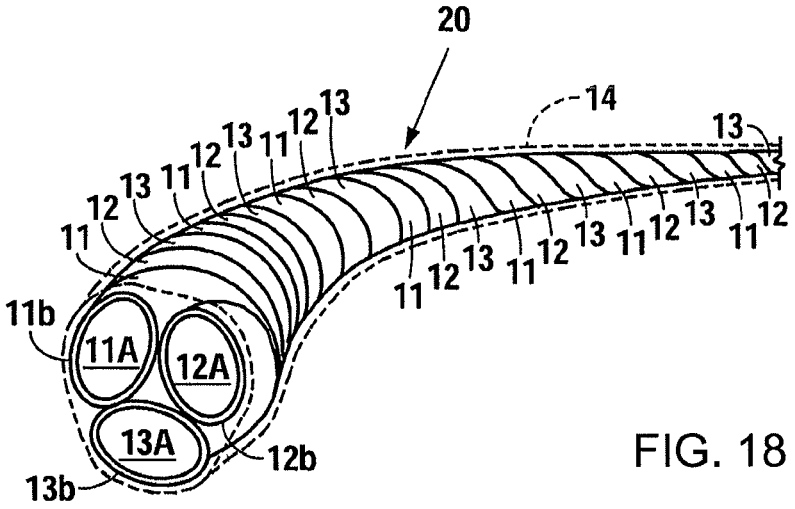

FIG. 18 is a perspective view that includes an orthogonal cross-section of a preferred EL-Wire embodiment of illuminator 20 of various embodiments.

Figure 14:
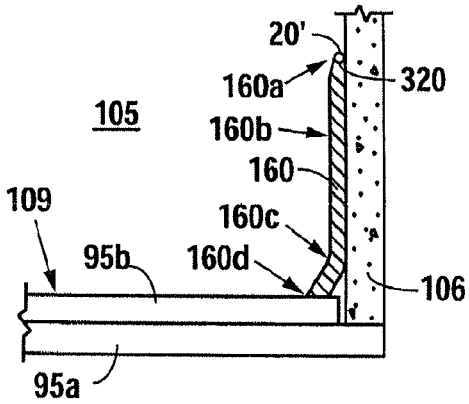
FIG. 14 is very similar to FIG. 12, except that FIG. 14 illustrates an embodiment of illuminator 20 (numbered 20')
Figure 19:
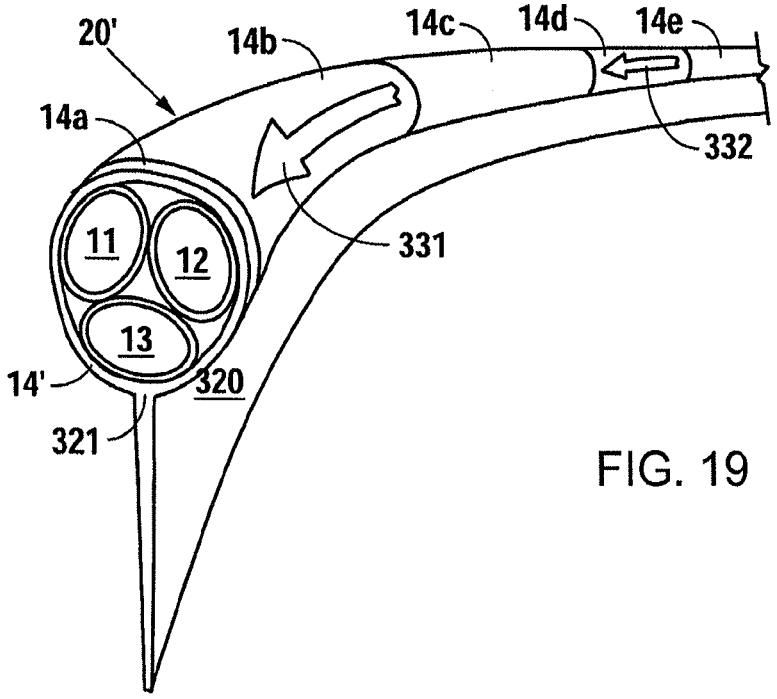

FIG. 19 is a perspective view very much like the view of FIG. 18, except that FIG. 19 shows an alternative embodiment having a jacket or casing 14' that preferably includes segments 14*b* and 14*d* that display visible arrow shaped features 331 and 332 along the length of illuminator 20, as well as a lengthwise mounting flange 320 as described with reference to FIG. 14.

Figure 20:
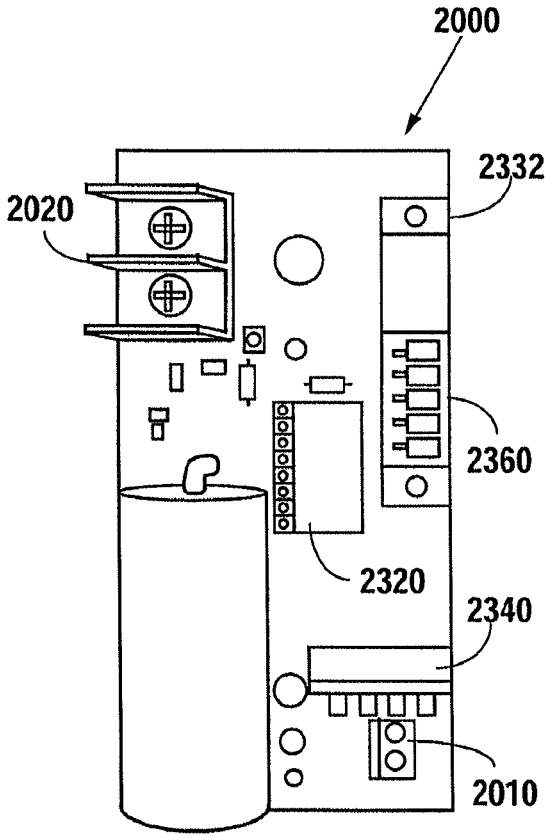

FIG. 20 is a perspective view of a representative Egress-Marking Visible Notification Appliance (EMVNA) driver 2000 having five-position dual in-line package (DIP) switch for synchronization with existing notification appliance circuitry, microprocessor 2320 to execute proprietary software, terminal block 2020 to connect driver 2000 to existing N.A.C., and various other components.

Figure 21A:
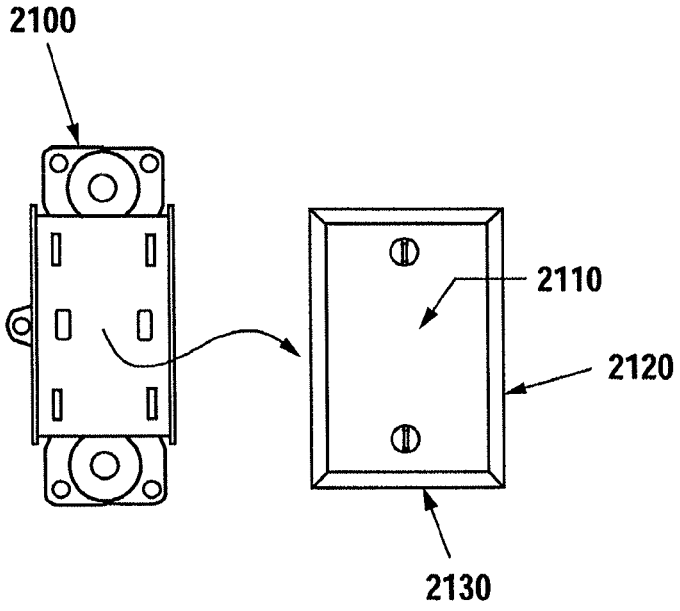
Figure 21B:
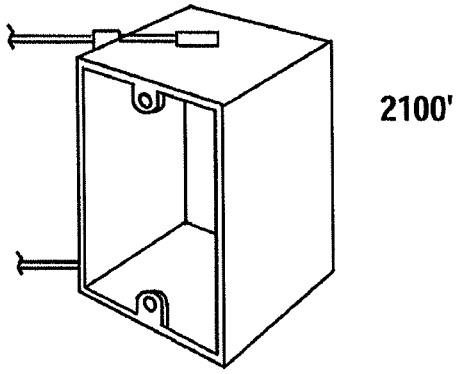

FIGS. 21A and 21B are perspective views of single-gang electrical outlet boxes used to house driver 2000. FIG. 21A also shows single-gang cover plate 2110 which is mounted to a wall surface and acts as a cover for single-gang electrical outlet box 2100.

Figure 22A:
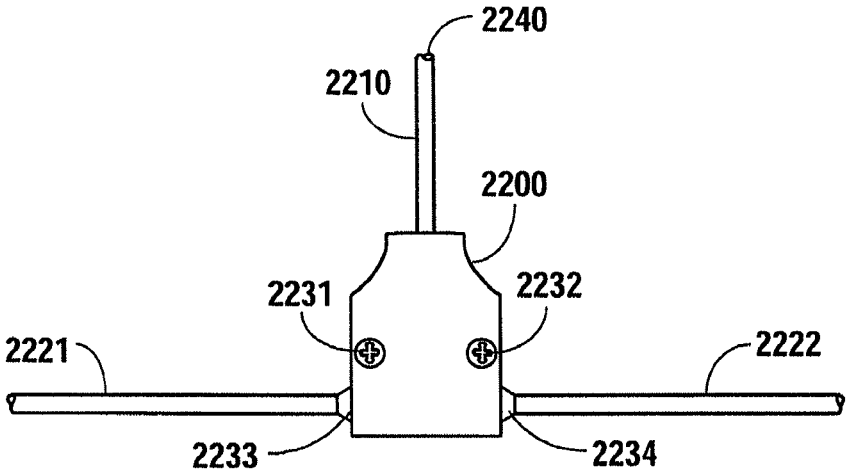
Figure 22B:
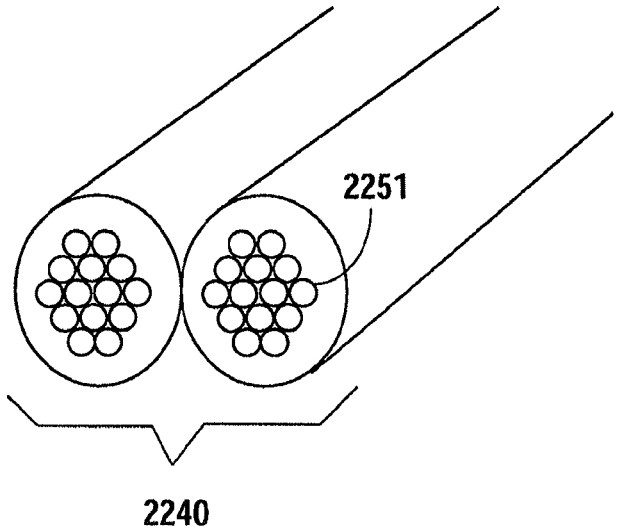
Figure 22C:
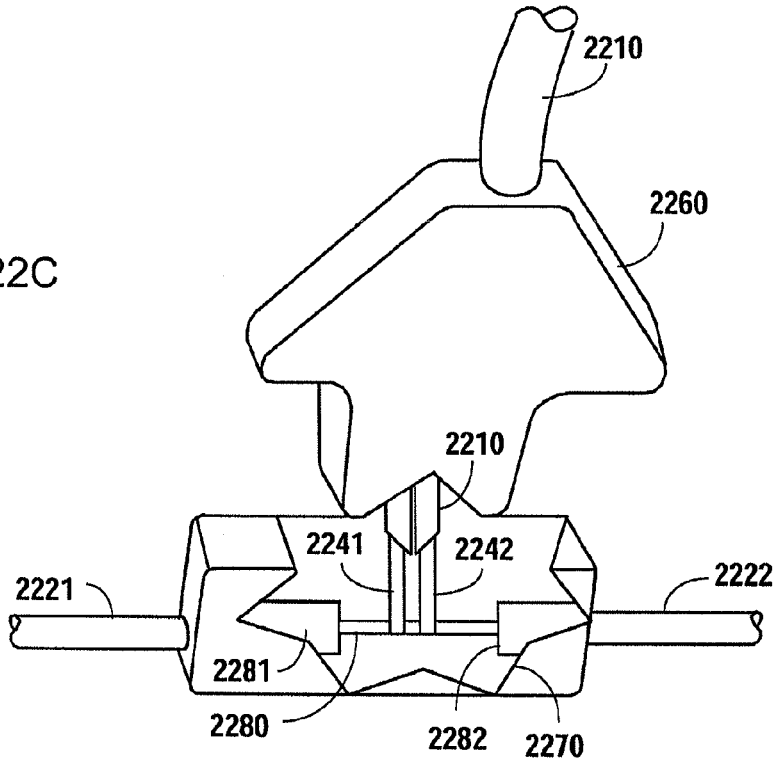
Figure 22D:
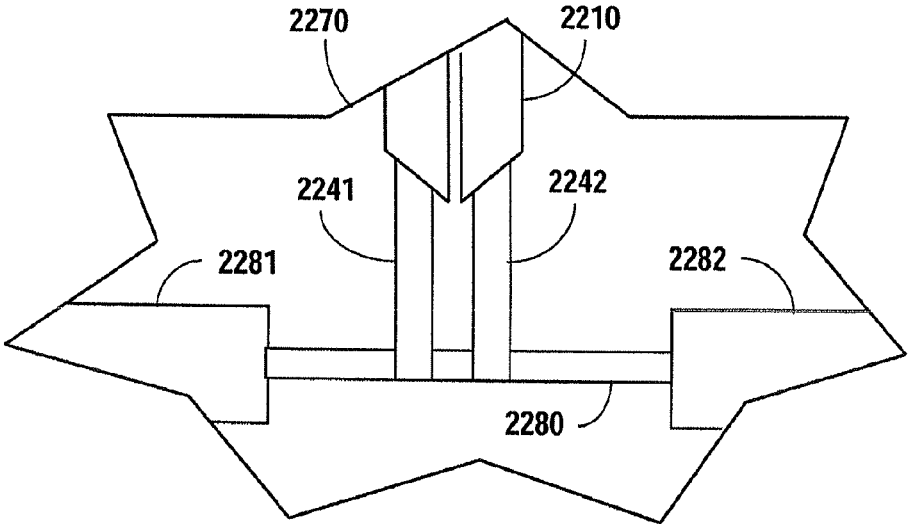

FIG. 22A, is a perspective view showing T-Connector 2200 which receives power from driver 2000 via two-wire lead-wire 2240 in order to illuminate LightStrands 2221 and 2222. FIG. 22B is a perspective view that includes an orthogonal cross-section of two-wire lead-wire 2210 showing arrangement of individual inner wires 2251 which transmit power to T-Connector 2200. FIG. 22C is a perspective view on inner molding 2260 of T-Connector 2200 including a cut-away view of junction region 2270 where stripped electroluminescent wire (el-wire) is connected to two-wire lead-wire 2210. FIG. 22D is a larger representation of the cut-away view shown in FIG. 22C.

Figure 23:
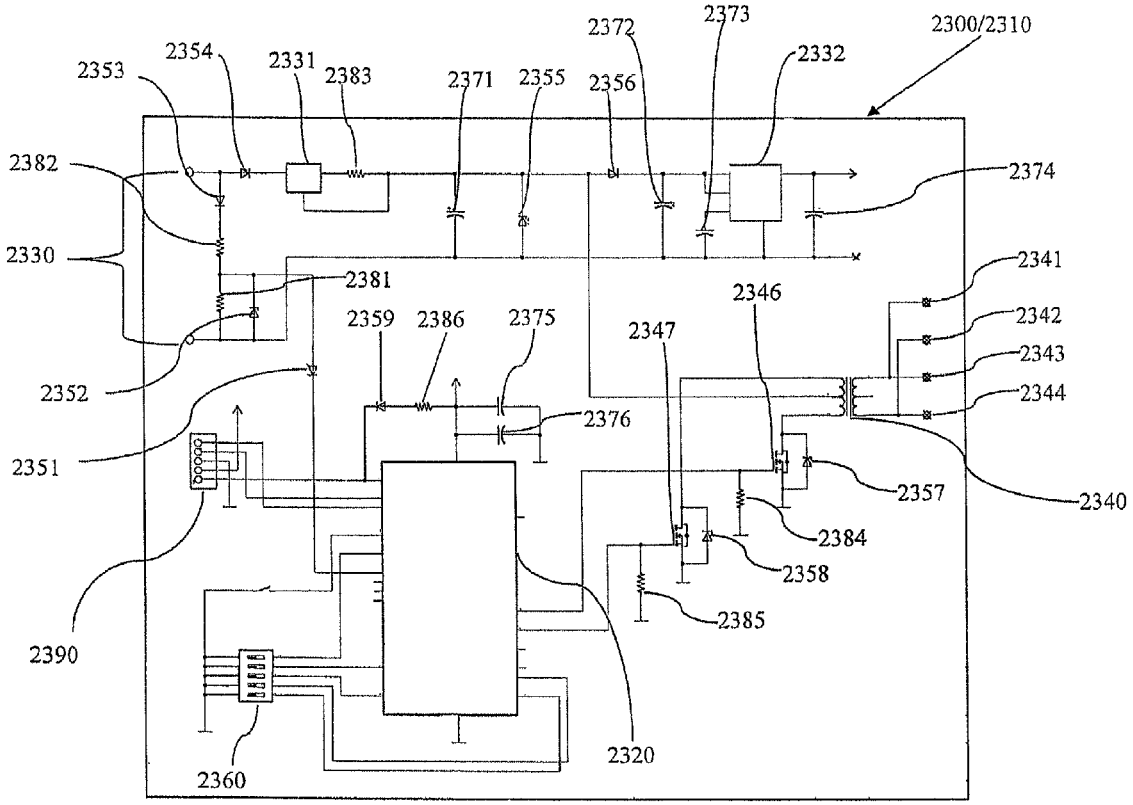

FIG. 23 is a detail view of printed circuit board 2310.

Figure 24:
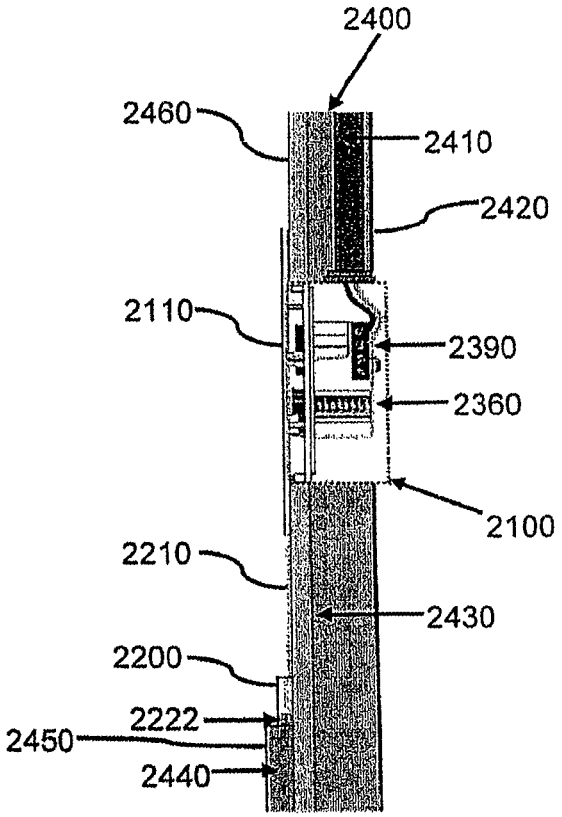

FIG. 24 is a cross-sectional view of installation of EMVNA showing single-gang electrical outlet box 2100 recessed within wall interior 2430, single-gang cover plate 2110 mounted on wall surface 2460, and T-Connector 2200 mounted on wall surface 2460 with LightStrand 2222 exiting the base of T-Connector 2200.

Figure 25:
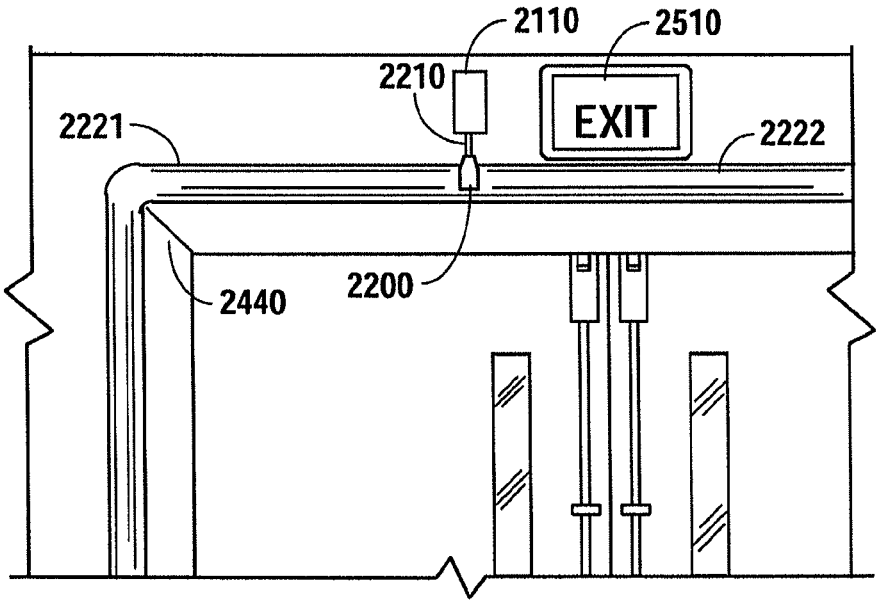

FIG. 25 is a perspective view of preferred embodiment installed in a typical building exit showing single-gang cover plate mounted in close proximity to existing exit sign 2510, T-Connector 2200 mounted below that with LightStrands 2221 and 2222 exiting T-Connector 2200 on the left and right sides, respectively and running along door trim 2440 horizontally then vertically to outline the exit door.

Figure 26:
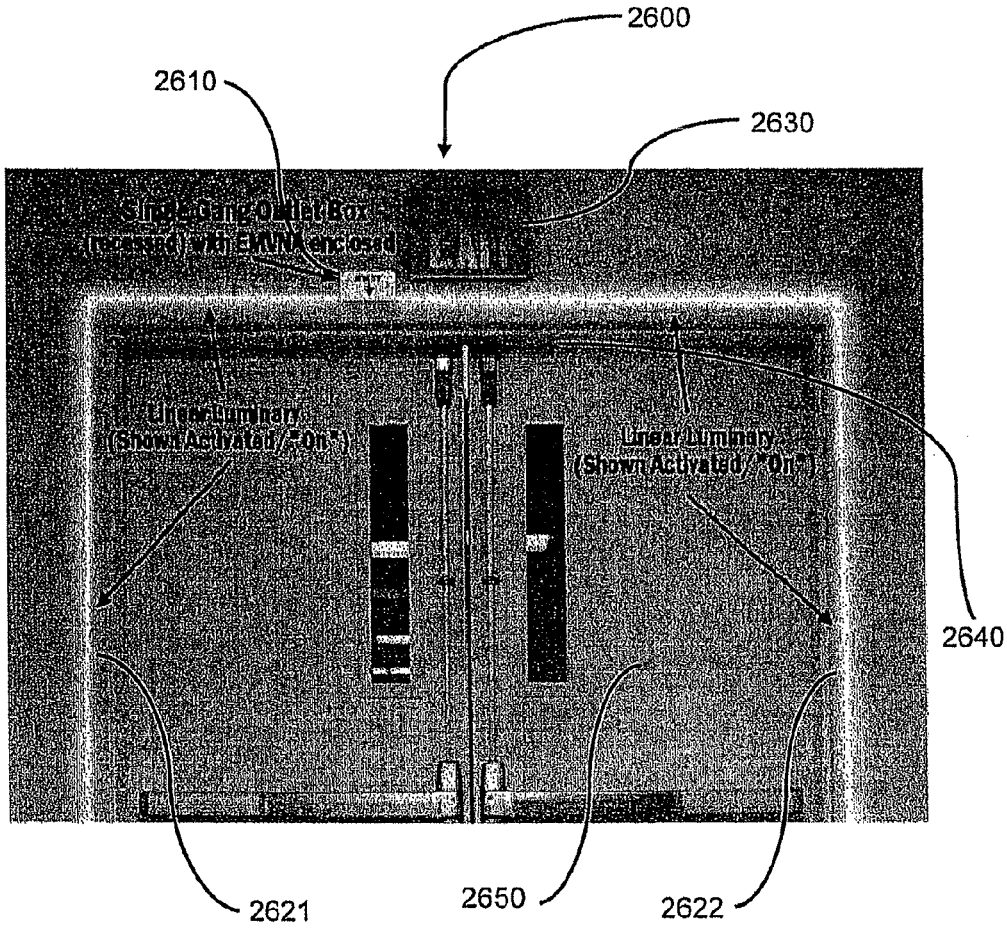

FIG. 26 is a perspective view similar to that in FIG. 25 showing an alternative embodiment of integrated EMVNA system 2600 installed at a typical building exit with a lettered cover plate 2610 denoting the "exit" here with a down arrow.

Figure 27A:
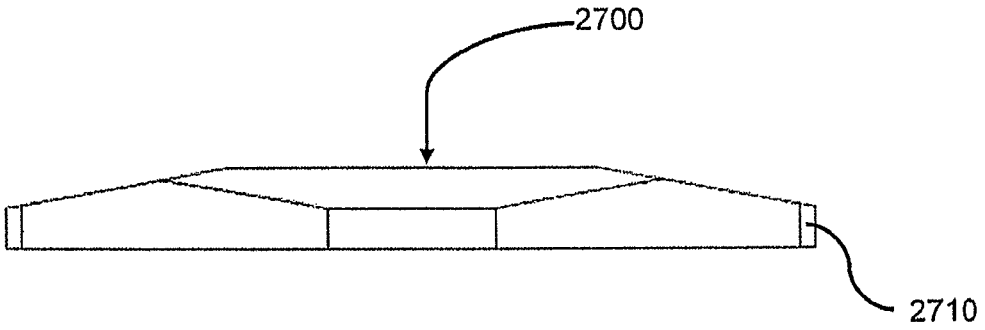
Figure 27B:
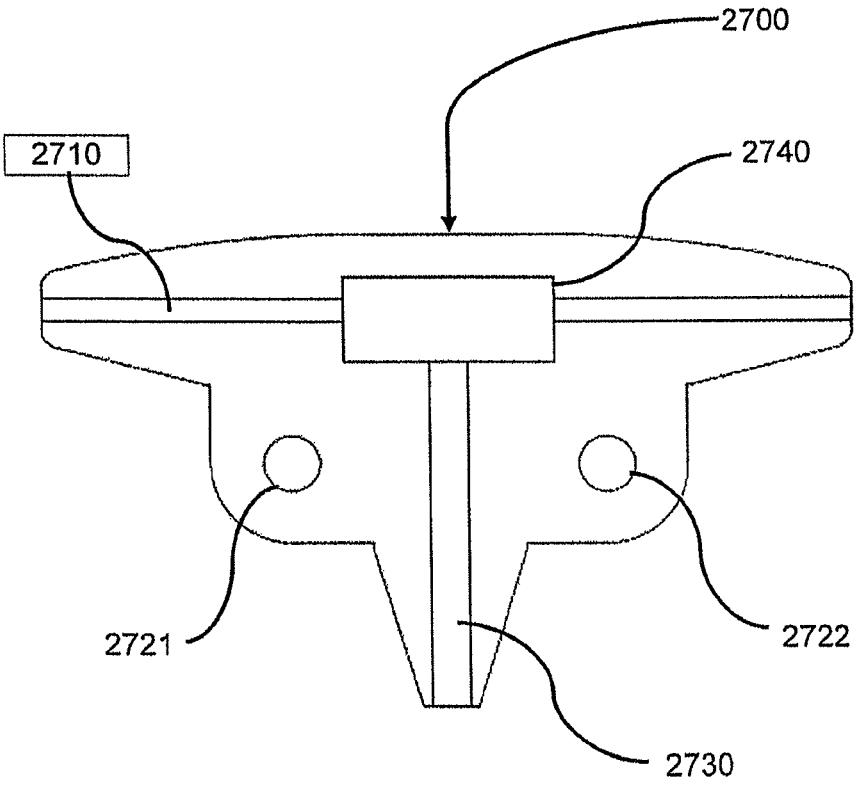
Figure 27C:
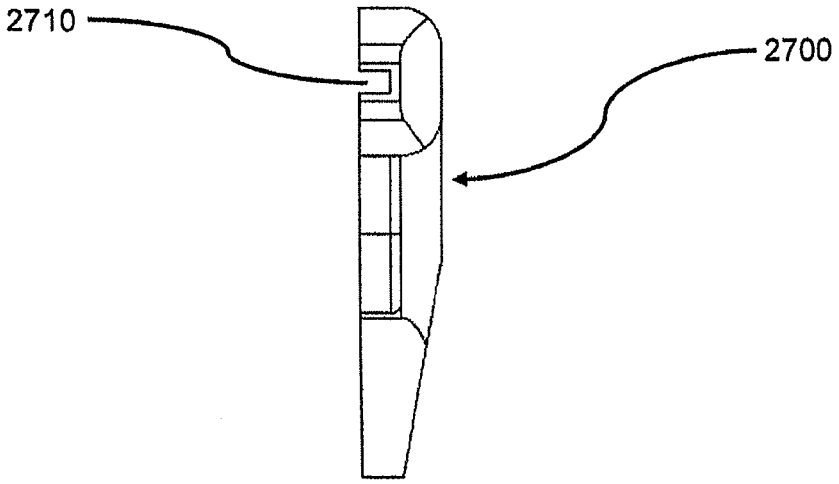

FIGS. 27A, 27B, and 27C are perspective views showing an alternative embodiment of el-wire t-box 2700 showing lead-wire groove 2730 to house two-wire lead-wire 2210, el-wire groove 2710 for housing the el-wire and recessed region 2740 of el-wire t-box 2700 providing a space for joining stripped portion of el-wire 2280 and two-wire lead-wire 2210.

DETAILED DESCRIPTION OF PREFERRED EMBODIMENTS

One of ordinary skill in the art can glean a good understanding of the broader inventions from consideration of several presently preferred embodiments that are depicted with the aid of FIGS. 1A-27C of the drawings, where like numerals are often used for like elements in the various embodiments. Occasional paragraph or section headings have been used for ease of reference, but such headings generally should not be read as affecting the meaning of the descriptions included in those paragraphs/sections.

Home Setting. The embodiments emphasized first in this description are thought to be most applicable in the context of home settings (such as in the example of FIG. 1A) or other residential structures but may be utilized in commercial settings as well. For reference, FIG. 1A shows a simplified floor plan of a home, which is residential structure 100. The residential structure 100 depicted in FIG. 1A has two smaller rooms 90-91 and one large central room 92 with an exterior exit door 95. The smaller rooms 90-91 each have doors (or at least doorways in alternative embodiments) 93-94 that lead to the central room 92. Although not shown in FIG. 1A, it should be understood that there can also be hallways, stairways and the like as well in the home setting. As is typical for rooms adjacent exterior walls, each of the rooms 90-92 also has at least one window 96-99. The preferred emergency exit route from any of the rooms is predetermined through one or more portals, i.e., one or more of windows 96-99 and doorways 93-95, depending on the best judgment of the home owner or residents. As examples, the preferred exit route 42 from room 90 can be chosen as directly through window 96, and the preferred exit route 43 from room 91 can be through doorway 94, into the central room 92, and then out the exterior door 95.

Alternative Settings. It should also be understood, though, that alternative embodiments may be installed in virtually any occupiable structure that has portals such as doors or windows through which an occupant (including workers or emergency personnel) might have need to escape in the event of a fire or other emergency. In the alternative embodiment illustrated in FIG. 1B, structure 100' has similarities [sometimes identified with the same or similar reference numerals] with the residential structure 100 of FIG. 1A. Structure 100' is a multi-story hotel building structure, but many aspects of the present invention can also be appreciated in virtually any occupied building structure within which occupants and/or emergency personnel may need assistance finding the exit during an emergency. As with many features of the present invention, a reader of these descriptions should understand that reference to a "structure 100" may refer either to the residential structure 100, the building structure 100', the facility or to any of the other alternative structures where the context permits a generic application to multiple embodiments. Hence, in alternative embodiments, structure 100 may be commercial, residential or industrial.

Referring to the preferred embodiment installed in building 100' as a hotel, the floor of structure 100' depicted in FIG. 1B has two exit stairwells, a North Stair 101 and a Central Stair 102, a central corridor or hallway 105, and nineteen guest rooms 110-128. Because they lead to the exit stairs 101 and 102, respectively, doors 103 and 104 have been predetermined to be the safest ways to leave hallway 105 and are therefore referred to as hallway exit doors 103 and 104.

The building structure 100' will be discussed at various places throughout this description, particularly in association with FIGS. 9-17, further herein.

Figure 2:
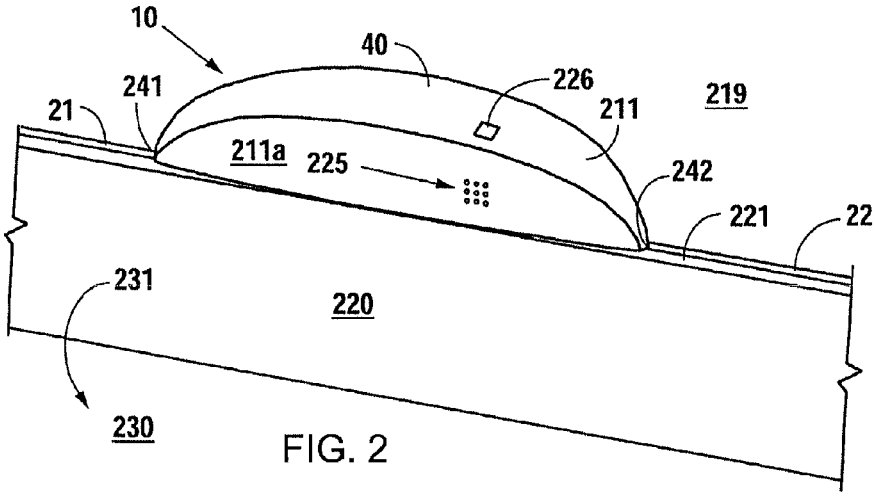
FIG. 2 is a perspective view of a representative illumination system 10 of certain preferred embodiments, with control subsystem 40 operatively employed on the top edge 221 of trim member 220 on wall 219, to provide linear illumination along opposite courses 21 and 22 extending to the left and right of control subsystem 40, respectively.
Figure 3:
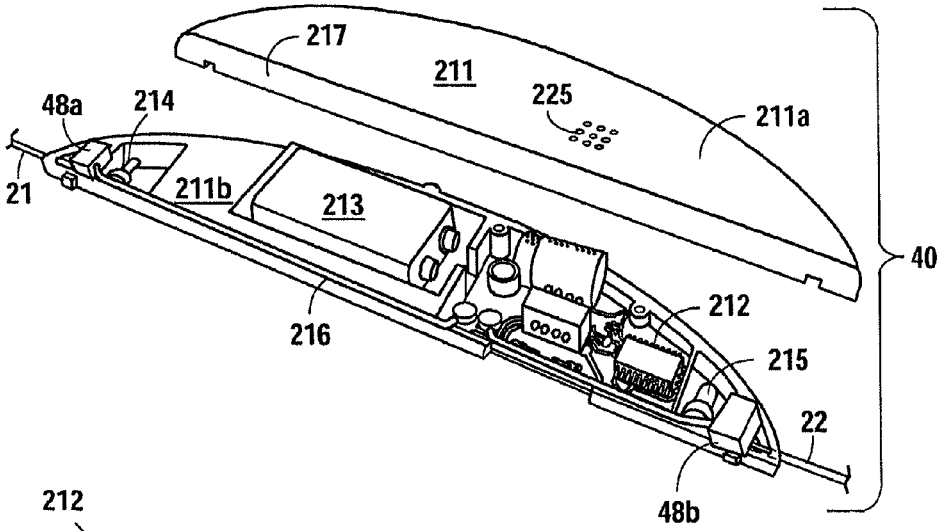
FIG. 3 is a partially-disassembled view of the control subsystem 40 of FIG. 2 with left and right energizers 48*a*, 48*b* illustrated schematically with corresponding illumination courses 21, 22 extending as lines therefrom.
Figure 4:
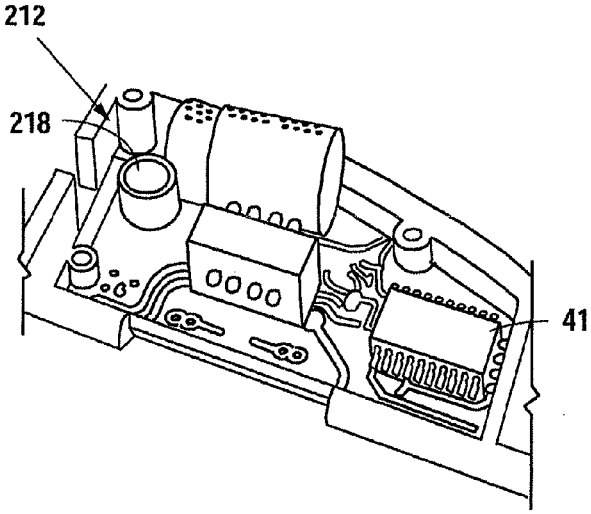
FIG. 4 is a detail perspective view of the printed circuit board 212 shown in FIG. 3.

Stand-Alone (Single-Station) Module. FIGS. 2-4 show various views of a representative illumination system 10 of certain preferred embodiments. When adapted and deployed as a stand-alone module, illumination system 10 is referred to as a "Single-Station Egress-Marking Visible Notification Appliance" or "S-EMVNA". In a preferred configuration, the S-EMVNA version of system 10 is a self-contained modular device which is sound activated, is 9 v DC battery-powered and may be activated when nearby detectors 73 (and often, other audible fire (and other) alarms) are activated. The S-EMVNA is preferably in the form of a UL 217 listed (Single and Multiple Station Smoke Alarms) device serving as an accessory to such UL 217 listed (or similar like listings in foreign jurisdictions) devices such as smoke alarms. This configuration is also designed to be triggered or activated by a firefighter's audible P.A.S.S. device, should a firefighter's P.A.S.S. device be triggered or broadcasting its emergency tonal and frequency alarm sounds within the listening radius of the S-EMVNA, and is also designed to be activated by other alarm broadcastin detection devices, such as most carbon monoxide detection/alarm devices used in American jurisdictions today. A control subsystem 40 of such an illumination system 10 is preferably embodied as a stand-alone module that is self-contained with its own power supply 213 in housing 211, which in turn is preferably mounted on or just above the top edge 221 of trim member 220 on wall 219. As will be discussed further herein with reference to FIGS. 5, 6 and others, the resulting illumination system 10 functions to provide linear illumination along opposite courses 21 and 22 extending generally to the left and right of control subsystem 40, respectively.

FIG. 2 is a perspective view of a representative illumination system 10 of certain preferred embodiments, with modular control subsystem 40 operatively employed adjacent and preferably above the door 230 (or other portal cover of) an exit portal 231. In contrast to several of our other embodiments, modular control subsystem 40 is preferably adapted to be a self-contained control subsystem that does not depend on physical and/or data connection to an external triggering system or power supply. Rather, with further reference to FIGS. 3 and 4, modular control subsystem 40 has a small, low-profile housing 211 that contains its own battery as a power supply and its own stand-alone controller 41 that does not require a data link to any separate system, but which may interface with other systems or subsystems or communication platforms through sound, RF, direct connection or other communicative actuating means.

The preferred housing shape and relative size of the housing 211 for module 40 are evident in FIGS. 2-4. Although other sizes and shapes may be suitable, housing 211 preferably has a small elongate profile above portal 231. Such a small elongate profile is characterized by having an exposed face 211*a* that is less than eight inches long (preferably less than five inches) and less than two inches tall (preferably less than one-and-a-quarter inches) in the orientation of FIG. 2 (i.e., lengthwise along the length of the adjacent trim 220 of doorway 231). The housing 211 is also low profile in the sense that it protrudes less than an inch-and-a-quarter from a wall 219 on which it is mounted.

Figure 5:
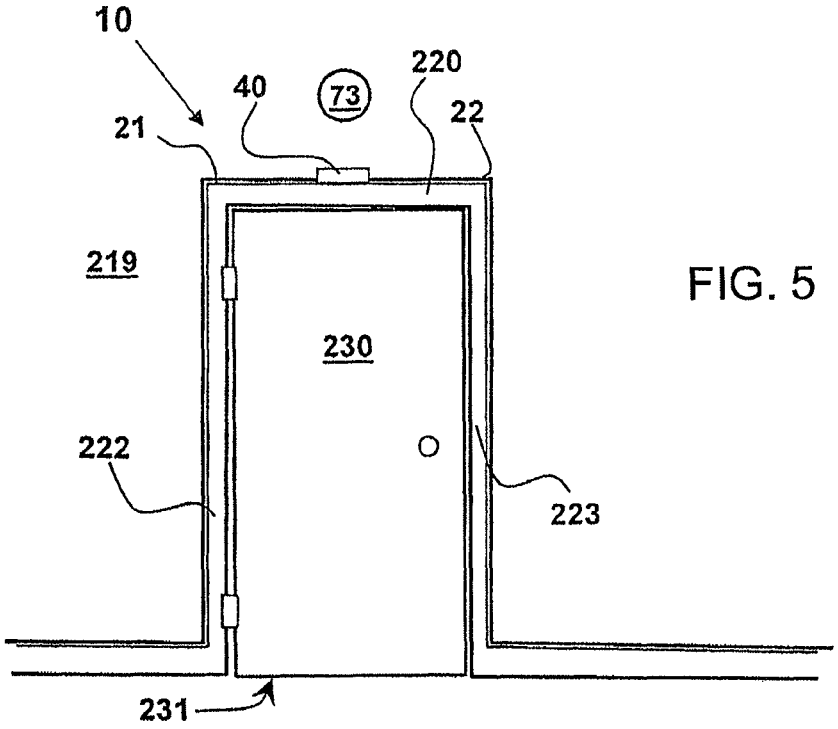
FIGS. 5 and 6 are elevation views of preferred variations of the embodiments of FIGS. 2 through 4, as operatively employed around the trim members 220, 222 and 223 of a doorway 231, with a nearby smoke alarm 73 on wall 219.

With further reference to FIG. 5, modular control system 40 (or "module" 40) is preferably adapted to detect and respond to the alarm of an independent smoke detector 73 (or other type of independent danger detector) in structure 100. To detect the independent alarm from smoke detector 73, an audio sensor 218 (numbered in FIG. 4) is included on the control board 212 within module 40, and controller chip 41 is coded to activate energizers 48*a* and 48*b* when detector 218 receives audio frequencies or other communicative transmissions indicative of a standard smoke alarm. The controller 41 of module 40 is wired or programmed to energize the illuminator courses 21 and 22 to illuminate in response to detecting that alarm, without requiring any form of electrical or radio frequency (RF) signal or any other data link with the independent detector 73.

Controller 41, coordinated by the device's pre-programmed firmware, intermittently samples the ambient background audio values in its indigenous area or space. Controller 41 "listens" for the tonal patterns and frequency values of the audible signal generated by a detector 73 (high and low frequencies) or other pre-configured values that may be used. Controller 41 can be configured to sense and detect other stimuli and/or conditions as well.

Other alternative embodiments may be triggered by any or all of an audible or electronic emergency fire protection alarm system, smoke detector, carbon monoxide detector or other emergency alarm or detection systems that emit an alarm preferably an audible alarm, or as an extension of another appliance, device (such as an emergency lighting appliance or exit sign appliance or system), system or subsystem to augment and/or broaden its efficacy in the provision of safety and which may be actuated by such appliance or device or through other stimuli or interconnected integrated system which may operate concomitantly or independently with or through such appliance, device or system. As another alternative, the embodiment of FIG. 2 may be modified to include the desired danger detectors 73 within its housing. Such desired danger detectors may include heat, smoke, fire, or noxious fumes sensors, as are described elsewhere herein to some degree. Still other embodiments may be configured to include, but not be limited to, hard-wire capability; synchronizability with other devices and systems; power failure detection and signaling; heat detection and signaling; sensing and detecting of carbon monoxide; carbon dioxide, radon, noxious fumes and other toxic gaseous release detection and signaling; earthquake and tremor detection and signaling; ship heeling/listing/capsizing detection and signaling, explosion detection and signaling; motion detector activation and alarm signaling; and glass break activation and alarm signaling (through a security system or free-standing). In the configuration which serves as a carbon monoxide detector, the S-EMVNA performs in a similar manner as with other configurations by performing as a visible alert system which may simultaneously have RF or other wireless integration capability for purposes of testing the device. Embodiments of the EMVNA system 10 that are configured as a power failure detection and signaling device are preferably UL 924 listed (Emergency Lighting and Power Equipment), and when such EMVNA system 10 is installed in a building or structure, it will illuminate when power service to the building or structure is interrupted. During a power failure, this configuration of the EMVNA system 10 will illuminate without flashing and will remain illuminated for a designated period of time as an emergency light source and/or illuminate an exit sign at a point of egress. Such embodiment could be powered by its own wall-pack battery backup in the event of a power failure, or, as an alternative configuration, could be integrated into a facility-wide generator or battery backup system. This configuration of the EMVNA system 10 would preferably be 6V DC to 33V DC in voltage scope so that it can integrate with most, if not all, 6-12V systems currently in use.

Another alternative embodiment is an integrated module referred to herein as the "Integrated Egress-Marking Visible Notification Appliance" or "I-EMVNA" variation of illumination system 10, the various elements of which are shown in FIGS. 20-27. The I-EMVNA variation of illumination system 10 is designed to be integrated into building-wide fire alarm systems and their local signals are remotely initiated, either automatically from detectors in the system or manually from pull-stations spread throughout a facility when so initiated by the system's fire panel. These hard-wired EMVNAs are designed to be hard-wire connected to a building's fire alarm system's notification appliance circuitry and are similarly configured to the system like other visual notification appliances like emergency strobes and horn-strobes. The I-EMVNA variation of illumination system 10 is preferably in the form of a UL 1971 listed (Signaling Devices for the Hearing Impaired) which allows the module to integrate into an existing fire panel and to be calibrated such that the I-EMVNA variation of illumination system 10 will flash synchronously with the traditional existing UL 1971 listed notification appliances currently being utilized in the building or structure.

This format of the I-EMVNA variation of illumination system 10 operates on the integrated NAC's 24 volt DC low-voltage power source(s), is current-limited and draws approximately 65 mA (milliamps) from the NAC power source for its operation. The I-EMVNA can also operate on a 12 volt DC input and can also be hard-wire configured with and installed in an emergency lighting, exit demarcation (signage), access control or security alarm system or security/fire combo systems, where the fire and security systems are integrated together through one combined system. In these alternative systems, it can be directly integrated independently or as an extension of another integrated appliance, as detailed above. Additionally, it can utilize building-wide backup generator supplied power to operate, may include its own DC batter backup power supply and/or can utilize a DC power supply of another appliance or device for its operation.

Most EMVNAs are designed to be installed/recessed into or over single-gang electrical outlet box 2100 or double-gang outlet box whose lettered cover plate 2610 can either denote the "FIRE" to indicate that it is a part of the fire system in the structure and may denote "exit here" with a down arrow designed to be placed on the coverplate used to secure the device driver inside the electrical box (back-box or junction box) which can be used to denote which direction one should take to reach the nearest exit with a left arrow, right arrow or up arrow as the specific location might command. The EMVNA system 10 is preferably in the form of a UL 1971 and/or a UL 924 listed (Emergency Lighting and Power Equipment), or similar listings in foreign jurisdictions, exit sign which preferably is located at a level which makes the sign visible when smoke may be obscuring the view of evacuees at a higher level within the room, enclosure or structure.

Some I-EMVNAs are also fabricated in their own housing which can be mounted at any location. Five-position and other multi-position dual in-line package (DIP) switch 2360 in the I-EMVNA variation of illumination system 10 can be field-calibrated to different light intensity settings and can be configured or calibrated to flash in synchronization with the other visible notification appliances in the same room and/or field of view. Typical EMVNAs are calibrated by the manufacturer to flash at a 1 Hz flash pattern or a pattern identical to the other visible notification appliances that it is synchronized within the connected zone or field of vision.

The I-EMVNA variation of illumination system 10 is compatible with other control systems and their synchronized visible notification appliances in the connected zone and they flash at the code-required 1 Hz rate while delivering a color and luminosity specifically designed for its elevationally low-level location capability and utility. In the absence of other visible notification appliances in the NAC, the I-EMVNA is compatible with other I-EMVNA devices with a variety of code-compliant 1 Hz flash, 2 Hz flash or other code-compliant flash patterns and has switch-selectable settings to independently operate. The purpose of the I-EMVNA's 1 Hz flash compatibility and its designed ability to synchronize with other notification appliances in the common NAC is to avoid creating a conflict in the indigenous environment for individuals with epilepsy and/or those who may have positive photic response to visual stimuli with seizures (i.e. be prone to seizure as a result of being exposed to flashing light(s)).

The I-EMVNA variation of illumination system 10 is automatically triggered with the notification appliance circuitry, like other notification appliances, to immediately light the periphery of an exit door and/or highlight the path of egress with its two linear luminaries being LightStrands 2221 and 2222, which in contrast to existing technologies, provides both a direct visual alarm by demarcating an exit and an indirect visual alarm by illuminating toward and in the area in proximity to the exit. LightStrands 2221 and 2222 are made available in a variety of linear luminary lengths, the most common being two LightStrand lengths which are each 12' long for a total of 24 lineal feet of LightStrand luminary. Common linear luminary lengths are 12' (24 lineal feet of light per device), 15' (30 lineal feet of light per device) and 18' (36 lineal feet of light per device). These differing lengths for the I-EMVNA are designed to accommodate large or inordinately large doorways, double-door openings, doors with transoms overhead and/or doors with built-in side-light features. Although these are standard lengths, if necessary, additional lengths may be joined end-to-end in order to accommodate longer courses of luminaries, and the devices may be butted, one to the other, in order to run the synchronized linear luminary format along any distance or length.

The I-EMVNA variation of illumination system 10 may be integrated with a variety of different systems to alert, demark and/or direct occupants of a building in a fire or other emergency event or crisis in a building, such as, but not limited to, exit signs or signage systems to provide multi-elevational exit demarcation which, unlike in-wall or surface mounted conventional exit signs, is visible from any angle of approach. The I-EMVNA may also be integrated with emergency lighting system to demark exit points and/or egress paths in the event of a power failure or other emergency event which triggers the integrated emergency lighting system, or as a path-marking device to direct occupants toward an exit point, safe harbor, or shelter-in-place location and/or along a predetermined path of egress leading to safety. The I-EMVNA may be integrated into a 12V or 24V hard-wired commercial (and limited residential) notification appliance circuit (NAC) which is driven by a Fire Alarm Control Panel (FACP) which has its own array of detectors and sensors which detect the presence of smoke, heat and/or fire, which can be manually activated (such as through a pull-station in a hallway) or automatically activated (such as through its smoke, heat and/or fire detection devices integrated into other sensing and detection circuits which are integrated into the FACP) and where, in this type of system, the I-EMVNA will flash synchronously with the other visible integrated notification appliances which are driven by the system.

The I-EMVNA variation of illumination system 10 may also be integrated into a 12V-24V hard-wired residential or commercial/industrial security system and/or a combination security, emergency lighting system, exit lighting system, access control system, and fire system which also has its own separate array of detection and sensing devices integrated into the panel on separate circuits. Within the security system and some emergency lighting and exit sign systems, the I-EMVNA will have a setting to either flash or not to flash. The system's control panel with which the I-EMVNA is integrated will energize it and will control its operation.

Another system into which the I-EMVNA variation of illumination system 10 may be integrated is a 12V-24V, typically hard-wired commercial access control system where the device can be energized and activated by the access control system per the control panel that drives the system. In this application, the I-EMVNA will be able to flash or not flash either at the point of ingress or egress or remotely as a signal to personnel charged with knowing the security (i.e. the breach or containment of the premises) and can be used as indicators inside the building or structure to alert those already inside of a breach of a controlled access point into the protected space. An alternative contemplated embodiment of the I-EMVNA would also be to be used as a signal on the exterior of the building, facility or structure to alert law enforcement or security personnel that a burglar, fire or other security system has been activated (silently or accompanied by audible and other communicative means) as a result of fire, breach or other unwarranted or other unpermitted access thereto or other event where passing-by authorities can determine through its signal that the building, facility, structure or premises has undergone an event triggering the system and that it is in need of immediate attention per indigenous protocols for such an event. The I-EMVNA is also anticipated to be utilized in locations containing a "safe-room", such as an American Embassy or Consulate facility where identification of the location of persons seeking shelter from indigenous conditions might be located when extraction or other rescue intervention teams or personnel enter the facility to perform their search and rescue duties pursuant to specified protocols for same.

It is contemplated that EMVNAs can be integrated with and/or interconnected through the so-called "Internet of Things." Such integration and/or interconnectivity can result in greater functionality of the EMVNA modules. It is further contemplated that any of the EMVNA modules or systems described herein may be integrated or interconnected in this manner, including a stand-alone or integrated EMVNA module.

Module Components. FIGS. 3 & 4 show partially-disassembled views of the same control subsystem 40 depicted in FIG. 2. Subsystem (or "module") 40 includes housing 211, printed circuit board 212, left and right energizers 48*a* and 48*b* (for illuminator courses 21 and 22, respectively), and the various supports and mounts of housing 211, and the various connections between these aforesaid components. Housing 211 is preferably a two-part (parts 211*a* and 211*b*) injection-molded housing that snaps or hinges together in a conventional manner. When halves 211*a* and 211*b* are assembled together, its exposed face 211*a* only has audio openings 225, test button 226 (comparable to smoke detector battery test button) and illuminator openings 241 and 242 in the back lower corners at the opposite lateral ends of its length. The audio openings 225 serve to enable sound to freely pass into or out of housing 211, and illuminator openings 241 and 242 allow the opposite courses 21 and 22 of linear illuminators 20 to extend in the appropriate directions from housing 211.

The characteristics of the printed circuit board 212, the energizers 48*a* and 48*b*, and the other lesser components will be understood by those of skill in the art from the remainder of these descriptions.

Such characteristics make subsystem 40 ideal for packaging in an affordable, easy-to-install kit, together with the necessary components and supplies to complete installation of pre-set lengths of linear illuminators 20. As an example, a preferred variation of such a kit that provides linear illuminators 20 in the form of EL-Wire illuminators, wherein the kit preferably includes the modular control subsystem 40, two lengths of EL-Wire illuminators in the chosen style (i.e., one of the variations described elsewhere herein, or the equivalent), and supplies for securing the orientation of the EL-Wire lengths in the appropriate orientations around exit portals and along baseboards or the like.

FIGS. 20 & 23 show a preferred alternative embodiment of the system referred to herein as an Egress-Marking Visible Notification Appliance (EMVNA). FIG. 20 shows the front view of EMVNA driver 2000 with five-position dual in-line package (DIP) Switch 2360 which is utilized for synch settings to synchronize EMVNA's 1 Hz flash with other devices and fire panel outputs in the existing building structure. Five-position DIP switch 2360 can be field-calibrated to two different brightness levels for different applications and can be field-calibrated to two different 1 Hz flash patterns; (i) one setting for "single-flash" and one setting for "double-flash" suitable for a variety of applications. Control of the various wired components is achieved by microcontroller 2320 which executes and operates proprietary copyrighted firmware and software. Audio transformer 2340 receives audio signals. Also shown in FIG. 20 is voltage regulator 2332. Connection of EMVNA driver 2000 to T-Connector 2200 is made via terminal block 2010. Connection of EMVNA driver 2000 to notification appliance circuits in the existing structure is made via terminal block 2020.

FIG. 23 shows a detailed view of an alternative embodiment EMVNA showing electrical schematic of control circuitry 2300 representing printed circuit board 2310. Control of the various wired components is achieved by microcontroller 2320 which executes and operates proprietary copyrighted firmware and software. Power to circuit board 2310 is supplied by power supply 2330, such power coming from the fire panel or security panel monitoring the alarm system. Output voltage is maintained by two linear voltage regulators 2331 and 2332. Audio transformer 2340 receives audio signals from microphone leads 2341, 2342, 2343, and 2344 and is driven by N-channel metal oxide semiconductor field-effect transistors (MOSFET) 2346 and 2347. Diode

2351 is added between microcontroller 2320 and power supply 2330 to prevent reversal of electric current and other diodes 2352, 2353, 2354, 2355, 2356, 2357, 2358, and 2359 are also present in printed circuit board 2310. A five-position dual in-line package (DIP) switch 2360 is utilized for synch settings to synchronize strobe flash with other devices and fire panel outputs in the existing building structure. Five-position DIP switch 2360 can be field-calibrated to two different brightness levels for different applications and can be field-calibrated to two different 1 Hz flash patterns; (i) one setting for "single-flash" and one setting for "double-flash" suitable for a variety of applications. Printed circuit board 2310 also utilizes capacitors 2371, 2372, 2373, 2374, 2375, and 2376, as well as resistors 2381, 2382, 2383, 2384, 2385, and 2386, whose use and function would be obvious to one skilled in the art. Electrical wire connections are made via two-position barrier strip connector 2390.

Figure 6:
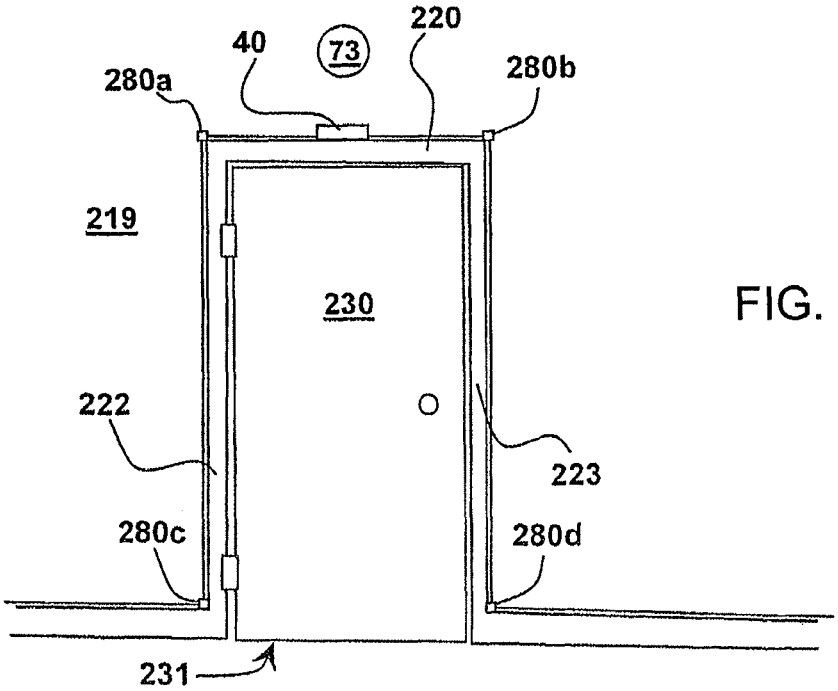

Installation. The resulting assembly of module 40 is preferably installed in structure 100 on the top edge 221 of trim member 220 on wall 219. Although modular control subsystem 40 could be positioned along one of the side trim members 222 or 223, it preferably mounted in the center, directly above the top of the portal 231, such as illustrated in FIGS. 2, 5 and 6. With control subsystem 40 operatively positioned adjacent the doorway 231 or other desired portal (such as a window that can be used as a fire exit from a bedroom), the system 10 is otherwise adapted to provide linear illumination along opposite illumination courses 21 and 22 extending to the left and right of control subsystem 40, respectively. The housing 211 may then be glued or caulked in place, and/or mounting nails or screws can be used through mounting holes 214 and 215 in the back half 211*b* of housing 211.

Once mounted in place adjacent portal 231, the features of housing 211, namely the orientation of openings 241 and 242 coupled with the bottom elongate surface 217 of housing 211, serve to self-align linear illuminators 20 with the length of the adjacent trim number 220. System 10 thus provides a nine-volt-battery-operated, self-contained luminary device that is installable to automatically highlight the portal in an emergency.

Installation of a preferred alternative embodiment is shown in FIGS. 21A, 21B, 24 and 25. FIG. 21A shows single-gang electrical outlet box 2100 into which EMVNA driver 2000 is mounted. Two-screw single-gang driver cover plate 2110 is mounted to cover the front of single-gang electrical outlet box 2100. Two-wire lead-wire 2210 can pass through cover plate notch 2120 or notch 2130, whichever is more suitable, in order to connect EMVNA driver 2000 to T-Connector 2200.

FIG. 21B represents an alternative embodiment of single-gang electrical outlet box 2100 denoted single-gang electrical outlet box 2100'. Single-gang electrical outlet box 2100' is red in color, used in the installation of fire alarms and smoke detectors, and makes for easier rough identification of such fire alarms and smoke detectors.

FIG. 24 represents a side-view section of the EMVNA recessed in single-gang electrical outlet box 2100. This view is not to exact scale. Two-screw single-gang driver cover plate 2110 is mounted to wall surface 2460. Single-gang electrical outlet box 2100 for housing EMVNA driver 2000 is mounted behind two-screw single-gang driver cover plate 2110 and wall surface 2460 and within wall interior 2430. Visible in this view within single-gang electrical outlet box 2100 are two-position barrier strip connector 2390 and five-position dual in-line package (DIP) Switch 2360. Two-screw single-gang driver cover plate 2110 is of standard wall-cover size (2.9375 inches wide and 4.6875 inches tall) and is notched on at least two edges, shown as cover plate notches 2120 and 2130, for passage of two-wire lead-wire 2210. Two-wire lead-wire 2210 extends vertically downward from single-gang electrical outlet box 2100 to T-Connector 2200 along wall surface 2460. Two-wire lead-wire 2210 has a typical length of 32 inches but may be field-cut to fit installation need. T-Connector 2200 is mounted on wall surface 2460 using mounting screws 2231 and 2232. This view shows LightStrand 2222 exiting T-Connector 2200 near its base and is shown running on top of door trim or baseboard 2450 or alternatively running vertically at the edge of door trim 2440 if LightStrand 2220 is on the doorway.

FIG. 25 shows the EMVNA system installed in a typical exit. Single-gang electrical outlet box 2100 housing EMVNA driver 2000 would be mounted in the wall with two-screw single-gang driver cover plate 2110 mounted on the wall in close proximity to exit sign 2510 as shown. FIG. 25 shows two-wire lead-wire 2210 running vertically connecting EMVNA driver 2000 with T-Connector 2200. LightStrand 2220 is shown exiting T-Connector 2200 running horizontally left and right along the top of door trim 2440 as well as running vertically along door trim 2440.

FIG. 26 shows an alternative embodiment of integrated EMVNA system 2600. Single-gang electrical outlet box 2100 (not shown in FIG. 26) is recessed within the wall in close proximity to existing exit sign 2630. Lettered cover plate 2610 denotes the "exit" here with a down arrow or in an alternative embodiment could denote which direction one should take to reach the nearest exit with a left arrow, right arrow or up arrow as the specific location might command. LightStrands 2621 and 2622 exiting single-gang electrical outlet box 2100 on the left and right, respectively, are secured to and run along door trim 2640 horizontally and vertically, outlining exit door 2650.

Illumination Subsystem. In the illustrated embodiment, the exit route illumination subsystem 40 itself includes a controller 41 and one or more energizers 48*a* and 48*b* that operate to activate and control the illumination of at least two courses 21, 22 of linear illuminators 20. The controller 41 controls energizers 48 to energize lighted courses 21, 22 such that they emit a bright, readily-visible light. The luminary component for system 10 of FIG. 2 is a preferably static light (without the inverter-sequenced or other directional aspects), thereby providing the least cost and the easiest embodiment for consumers to install. In preferred embodiments, system 10 is directly connected to its own DC battery power source. More complicated embodiments are also integrated with an AC or solar based power source for recharging and/or operating.

For simplicity of installation, exit route illumination subsystem 40 is preferably capable of operating on low-voltage DC battery power. Note that, as an alternative to low voltage battery power, other embodiments are adapted to be powered by AC power in one of two modes—either by converting the AC power to DC through an inverter or the like, or by stepping-down the AC power to safe levels and directing the stepped-down AC power directly into the illuminator 20. Preferably, this is achieved by embodying the linear illuminators 20 of courses 21 and 22 in the form of electroluminescent (EL) wire, although various alternatives approximate some but not all of the benefits of using EL-Wire, as will be evident to those of ordinary skill in the art, particularly from further reading of this detailed description in light of the prior art. It is anticipated that the use of inverters and converters of AC and DC power into a useable power format for the EMVNA technology, in all of its forms, will be commonplace in the integration of the device into buildings, facilities, structures, interface with other appliances, devices or systems and subsystems. In still other embodiments, particularly the stand-alone or S-EMVNA modules, there is included a photocell embedded in the face or the top of the device to trickle charge the battery supplying power to the device. Such batteries would preferably be of a rechargeable type as understood by those of skill in the art which would be capable supplying sufficient power to operate the S-EMVNA module with all possible functional components which may be utilized in such a module.

One particularly-preferred alternative linear illuminator for the modular system 10 utilizes a laser light source rather than a physical illuminator but which may also use a filament or various forms of fiber optic cable to carry the light emission along its axis. This cabling or POF may be jacketed along its length with areas exposed to allow for the light carried within it to be hidden in certain areas along its axis and visible along other areas of its length. Like the EL-wire, this fiber-optic cabling, carrying laser or other light may be placed at locations where the installer/user thereof might desire it.

LED light sources, a single or multiple braided or twisted strands of electroluminescent wires possibly wrapped in a single translucent or colored jacket, side-light emitting plastic optical fiber, reflective mirrors and or reflective luminescent paints or strips of reflective material(s) may also be used to provide luminescence in less preferred variations of the modular system 10.

Another preferred embodiment of an illumination subsystem is illustrated in FIGS. 22A, 22B and 22C. FIG. 22A shows EMVNA T-Connector 2200. T-Connector 2200 is connected to EMVNA driver 2000 via two-wire lead-wire 2210 which has a standard length of 32 inches (85 centimeters) in the preferred embodiment but can be field-cut to fit installation need. T-Connector 2200 is surface mounted to a wall or surface by mounting screws 2231 and 2232.

Near the base of T-Connector 2200, LightStrands 2221 and 2222, the linear illuminator consisting of a length of electroluminescent wire (el-wire), exits T-Connector 2200 on the left and right sides near the base of T-Connector 2200 and when activated provides illumination around doorway/exit periphery and/or along the top of baseboards which is superior to existing technologies by making such exit visible from every angle of approach. This placement configuration of the el-wire provides not only a direct visual alarm by demarcating an exit but also provides an indirect visual alarm by illuminating an area in proximity to that exit. In further contrast to existing technologies which place strobes and other visual alarms high on a wall or at ceiling height above an exit whose presence may be completely occluded by smoke during a fire, this preferred embodiment provides visual alarms much lower so as not to be obscured or occluded by smoke.

LightStrands 2221 and 2222 are made with specially designed Lytec-Asia, Ltd. electroluminescent wire. Alternative embodiments provide for lengths of LightStrands 2221 and 2222 on each side where it exits T-Connector 2200 of 12 feet (370 cm), 15 feet (460 cm), or 18 feet (550 cm); however, "trim-to-fit" LightStrands 2221 and 2222 can be trimmed in the field to any desired length to meet the specific installation or physical limitation requirements. Stress reducers 2233 and 2234 are attached to EMVNA T-Connector 2200 where LightStrands 2221 and 2222 exit T-Connector 2200.

FIG. 22B is a white-pair connector wire detail 2240 of two-wire lead-wire 2210. Each wire in two-wire lead-wire 2210 has an outside diameter of 1.5 millimeters. Within each wire of two-wire lead-wire 2210, there are fourteen individual power supply wires 2251, each with a diameter of 0.12 millimeters. Each power supply wire 2251 consists of a copper core surrounded by a phosphor coating which in turn is covered by a clear protective sleeve on the outside of which is a colored PVC sleeve.

FIG. 22C shows polypropylene inner-mold construction 2260 located in the interior of T-Connector 2200. Two-wire lead-wire 2210 is shown vertically exiting through the top of polypropylene inner mold construction 2260, and LightStrands 2221 and 2222 is shown horizontally exiting polypropylene inner mold construction 2260 to the left and to the right near the base of polypropylene inner mold construction 2260. A cut-away view shows junction region 2270 where two-wire lead-wire 2210 is joined with stripped portion of el-wire 2280 to provide power for illumination. The insulation of two-wire lead-wire 2210 must be removed (stripped) to reveal individual inner wires 2241 and 2242. A portion of normally insulated el-wire is stripped by melting and scraping to expose the inner wire. Individual inner wires 2241 and 2242 are then attached to the exposed inner wire of stripped portion of el-wire 2280.

FIG. 22D is a larger representation of the cut-away view showing junction region 2270.

FIGS. 27A, 27B and 27C show orthogonal views of an alternative embodiment of an illumination subsystem el-wire t-box 2700.

FIG. 27A is a top view of el-wire t-box 2700 showing el-wire groove 2710.

FIG. 27B is a view of the back of el-wire t-box 2700. The el-wire (not pictured) is placed in el-wire groove 2710 and preferably secured in place by application of an adhesive such as clear silicone. Two-wire lead-wire 2210 is placed in lead-wire groove 2730 and similarly secured in place by application of an adhesive such as clear silicone. El-wire t-box 2700 can be mounted on a wall, such as wall surface 2460, by mounting screws (not pictured) put through mounting screw holes 2721 and 2722. Recessed region 2740 of el-wire t-box 2700 provides a space for joining stripped portion of el-wire 2280 and two-wire lead-wire 2210.

FIG. 27C is a side view of el-wire t-box 2700 showing el-wire groove 2710.

Kit with Module and Opposed Illuminator Lengths.

FIG. 5 is an elevation view of one preferred variation of an installation achieved with a pre-packaged kit embodiment of modular illumination system 10. The installed kit provides opposite courses 21 and 22 of linear illuminators that can be laid along the edges of the trim members 220, 222 and 223 on the wall 219. Although the last two components are less critical for a pre-packaged kit of the present invention, a preferred variation of such a kit includes: (1) appropriate instructions; (2) a stand-alone control module 40, with a pre-wired audio activation switch(es) 218 (for installation adjacent the periphery of an exit portal 231); (3) two lengths of linear illuminator 20 (each preferably twelve to fifteen feet in length for positioning on either side of the housing 211 for module 40), which lengths are easily trimmed if too long on one or both sides of the doorway; (4) a nine-volt battery (or other power supply alternatives); and (5) a tube of clear adhesive (preferably a heavy-duty clear silicone adhesive) to be used to secure the illuminator courses 21 and 22 around the periphery of the intended portal, along the trim and baseboard moldings surrounding the outer periphery of the portal and hence along the top edge of adjacent baseboards.

FIGS. 5 and 6 are further detailed views of installed embodiments of FIG. 2, as employed around the trim members 220, 222 and 223 of a doorway 231. Even though the EL-Wire illuminators are hardly visible if not energized, when a smoke detector or system is triggered by fire or a heavy smoke event, or the appliance is otherwise triggered by its integrated system or connectivity with another appliance or device, the controller immediately triggers the inconspicuous illumination strips (LightStrands) to light up the periphery and baseboard areas around the premise's safe exit portals or along its length to indicate the exit point or egress path. The resulting kit is a self-contained residential exit door illumination system that only requires a screwdriver for installation. It is therefore easy to install, easy to test, easy to use, and yet very effective in a fire/smoke emergency.

Hence, such a system 10 is adapted to save lives, help people avoid injury and the loss of life, speed up the building structure evacuation process, and provide a more efficient, safer and informative path for evacuees to follow when they find themselves enduring a crisis such as fire or heavy smoke in a residential or commercial structure 100. All this is achieved by system 10 providing bright floor-level and multi-elevational illumination which directs the occupants of a structure 100 toward the nearest exit portal in the event of a fire.

Any of the illuminator types herein described may be routed through a channel in the floor of the structure when circumstances might require such low level illumination. In other embodiments, illuminators may be laid in a routed channel at any elevation on a wall, in molding or trim, or in the floor with a clear covering such as Plexiglas to protect the illuminator, for guiding an occupant along an exit or safety path or for illuminating an exit portal. Other embodiments contemplate that illuminators may be routed through channels in sheetrock panels, countertops and the like if such a configuration is necessary within a particular facility or setting.

Securing Physical Illuminators in Place. While different embodiments of the linear illuminators 20 preferably use different supplies to secure the preferred positions of the linear illuminators 20, there are also even various alternative embodiments for affixing the particular physical types of linear illuminator 20, such as EL-Wire and POF embodiments. A first alternative kit for installation of the EL-Wire preferably includes a supply of an adhesive, preferably clear and preferably silicone (although those of ordinary skill will understand the pros and cons of other adhesives as well). The method of using such a kit involves applying the adhesive during or immediately after installation, to hold the EL-Wire illuminator in place, preferably in the nook or crevice where the molding 220, 222 and 223 and baseboards meet the wall 219, so that the illuminator 20 is even less noticeable when not energized.

Figure 7:
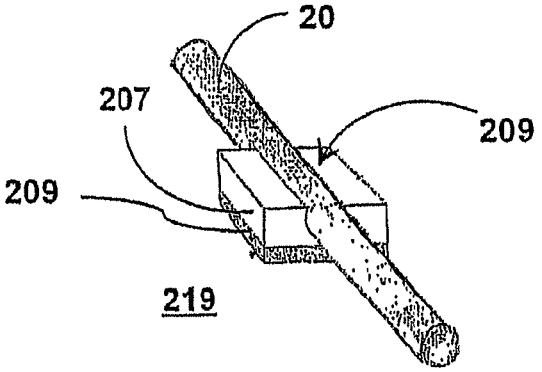
FIG. 7 is an isometric perspective view of an adhesive backed clip 207 for securing an optic fiber variation of linear illuminator 20 in its operative position against wall 219 and/or trim members 220 of the embodiment shown in FIG. 5.

As a second preferred alternative to direct adhesives (such as clear silicone), adhesive-backed cable "snap-in" or "snap-closed" clips and various forms of tape adhesives are included in certain preferred kit embodiments and are used in certain preferred methods. The clips may be off-the-shelf as the most affordable alternative embodiments for supplies to secure the EL-Wire illuminator 20 in place. As an alternative, such clips may also be made much like the one illustrated in FIG. 7. FIG. 7, more particularly, shows an adhesive backed clip 207 for securing an optic fiber variation of linear illuminator 20 in its operative position against wall 219 and/or trim members 220 of the embodiment shown in FIG. 5. Such a clip preferably is embodied as an elastically-flexible block of material that has an adhesive backing 209 for mounting on the wall 219 or trim member. The block 207 is provided with a groove 209 that is appropriately-sized to snugly hold the illuminators 20 in the connector groove 209. With either the off-the-shelf or custom variations, the adhesive-backed clips provide alternative supplies for securing the proper position of illuminators 20 along the wall 219 or the trim or molding 220 around the portal 231 and along the adjacent baseboards. Hence, to minimize conspicuousness of the physical alternatives of illuminators 20, a unique connector/clip system is provided with a clear adhesive-backed corner clip and flat clip would allow users to provide an easily installed alternative to glue or other adhesives (or augment their use) and would allow us to "quietly and somewhat inconspicuously" affix the LightSaver light wire to the periphery of an exit portal 231.

Figure 8:
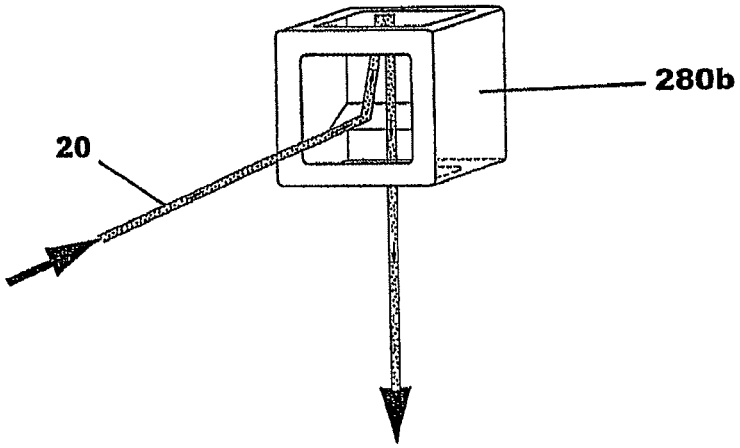
FIG. 8 is an isometric perspective view of an orthogonal reflector 280*b* to redirect the laser beam form of linear illuminator 20 as operatively provided by the embodiment of FIG. 6.

Directing Laser Illuminators. As mentioned elsewhere, laser light may also be used for linear illuminators 20 as an alternative without physical illuminators, by using energizers 48*a* and 48*b* that emit a laser beam out illuminator openings 241 and 242. With reference to FIGS. 6 and 8, such an alternative uses reflectors 280*a*-280*d* in the perimeter corners around the frame of doorway 231, in order to redirect the beam of each laser course 21 and 22 around the doorway 231. As reflected in FIG. 8, each reflector 280 is preferably a small box with pushpins or other mounting means to hold it in place at the referenced corners. Either through mirrors, prisms or the like, the reflectors redirect the beams accordingly. Hence, the right horizontal course 22 of the beam is reflected vertically down to proceed from reflector 280*b* in a direction that is closely adjacent and yet parallel to the vertical trim member 223 on that side of door 230 and then another reflector 280*d* again turns the beams course to proceed horizontally (parallel to the floor) just above the floor baseboard 160, Speaker with Preprogrammed Emergency Audible Alarm. In some embodiments, the device may include a speaker or alternative announcing device that would be integrated into the device's logic, electronic processor(s) and/or electronic microprocessor(s) that would, when activated/triggered by the device's sensing devices, repeatedly announce a preprogrammed audible emergency signal, tone, alarm or recorded voice announcement sound to more clearly demark the location of the exit portal location when the device is activated or triggered. One additional facet to the modular control subsystem 40 is that alternative embodiments are programmed with an audible tone or voice recording that is broadcasted from audio opening 225 whenever illuminators 20 are energized. More particularly, circuit board 212 is preferably adapted to include a small speaker that would be hooked to the logic in the microprocessor/logic chip 41, to announce (audibly) an emergency signal/tone/alarm/voice sound whenever emergency conditions are detected by controller 41. With this adaptation, system 10 is adapted to even more clearly demark the safe exit portal location during a smoke event or other emergency and can utilize integrated panel predefined tones, or messages delivered to the EMVNA from the system's control panel (such as a FACP). Alternative embodiments of this adaptation even embed a digital recording device in board 212 (or in a companion board) within the housing 211 for subsystem 40, and a parent is then able to actually record a short message in his or her own voice that would be announced repeatedly when an emergency condition is detected by controller 41. Incorporation of both of these features allows users to choose which audible signal they would want to be announced in the event of an emergency which triggers the system to illuminate the illuminators 20. With the voice adaptation, to further encourage and comfort a child in an emergency, a trusted or authoritative voice can be used to issue audible commands to the child in the emergency, repeating "COME THIS WAY!" or any other desired message. The added interactivity with module 40 when a parent records his or her voice into the module 40 reinforces preparedness for all involved.

Whatever the particular features, the system 10 of the invention allows one standardized housing 211 that will be able to contain all the electronic guts of module 40 regardless of what is inside. Audible alternative adaptations may include: The Option to choose a "standard issue" preprogrammed tone or alarm to be broadcast through our tiny speaker from the device housing; and/or the option to include the Recording/Playback components that allow parents to record their own voices in the device as the alarm for the younger ones living in the home or those in need of audible alerting, such as the legally blind and partially sighted.

Hence, in some embodiments, the device may include a modular self-contained adjacently mounted speaker interconnected with the device which may receive its audible signal from other sources or the integrated system and which is actuated in tandem with the triggering of the emergency system driving it or an audio recording device similarly housed in the device which is integrated with the aforementioned speaker or alternative announcing device and further integrated with the device's logic, electronic processor(s) and/or electronic microprocessor(s) devices. The recording device will allow the operator or end user of the device to record a message in his or her own voice or other chosen audible sound on the device, in lieu of the preprogrammed audible emergency signal, tone, alarm or recorded voice announcement sound and which is announced repeatedly when the device activated or triggered.

Auto-Default to Preprogrammed Emergency Audible Alarm. In preferred embodiments, the device has both a default preprogrammed sound signal and, in addition thereto, also contains the personalized recording device for the operator or end user to record his/her audible sound or announcement. In this embodiment, and in any event where the personalized announcement were inactive or otherwise disabled, the preprogrammed audible emergency tone, alarm or recorded voice announcement sound would be activated in the absence of the existence of such personalized recorded announcement as a default when the device is triggered or activated in an emergency.

Illuminator Functions. In the FIG. 2 embodiment, the essence of subsystem 40 is the exit route illumination subsystem 40, which is adapted to energize courses of linear illuminators in response to one or more emergency conditions. Preferably, when not energized, the linear illuminators are hardly noticeable to a passerby in the space where they are installed (such as in hallway 105). However, when activated by energizers 48, the linear illuminators (numbered as linear illuminators 20, 20' and 420 in various illustrated embodiments) help occupants exit the structure 100 by (i) illuminating one or more exit doors (the "door illumination" function), and/or (ii) illuminating the base of the walls around the space leading toward the exit door(s) (the "hall illumination" function).

The device may utilize any form of illumination, including but not limited to, a laser light source, Laser Wire, an LED light source and/or a single or multiple braided or twisted strands of electroluminescent wires (possibly wrapped in a single translucent or colored PVC jacket), side-light emitting plastic optical fiber, reflective mirrors, prisms and or reflectors and refractors possibly in conjunction with reflective luminescent paints, sprays, strips, tapes or adhesives containing of reflective material(s) in various diameters and widths.

Single Strand of Electroluminescent Wire w/o Directionality. In this preferred embodiment, one single strand of electroluminescent wire operates as the linear light source. The single strand of electroluminescent wire is laid upon or otherwise specifically adhered or affixed around and along the periphery of an exit door, window, stairwell/staircase and then laterally along the top of base molding along the floor in areas abutting, adjacent to or proximate to such doors, windows or stairwells.

When activated/triggered by the device's sensing devices, such electroluminescent wire is energized and illuminated. The wire flashes/illuminates in a predetermined flash or static light pattern as predetermined by the devices preprogrammed processor(s), microprocessor(s) and or logic mechanism(s) embedded in the device's construction and this lighted wire shed lights along the outside periphery of an exit door or portal and/or along the floor area near such door immediately adjacent thereto through its operation. The device's linear light source may be located near floor level for better visibility in smoke environments. The lighting and system, in general, may be operated repetitively and non-destructively to allow inclusion of the lighting and system in fire and other emergency drills.

The device may also be installed along a corridor wall, around ground-floor windows or other exit portals vertically or laterally or in other areas where required light may be required to demark a safe path or exit for an evacuee to pursue in a structure incurring fire, smoke or other peril and may be used as an extension of other appliances or devices designed to alert, demark and or direct occupants of a building facility, structure or premises to or toward safety.

Module Recessed in Wall. Another preferred embodiment recesses module 40 in wall 219 to render all of system 10, other than the light strands 20 themselves, truly inconspicuous. The recessed installation is achieved by slightly rearranging the components of module 40 and replacing the housing 211 of module 40 with an enclosure like a small "insulated junction-box" or "protective Hoffman box". This configuration can be used by either the S-EMVNA or the I-EMVNA, depending on the user's desires or architectural requirements. More specifically, system 10 may be housed in a standard UL-listed or UL-conforming single gang, four-square box (with a plaster ring), and or a double-gang junction box, often referred to in the field as "back-boxes'"; which come in a variety of types, styles, sizes, depths and configurations. Other alternatives may include housing system 10 in a red single gang outlet box which is sometimes used for installation of fire alarms and smoke detectors. Other alternative configurations of I-EMVNAs might also allow for them to be manufactured or fabricated in their own accompanying housing or electrical outlet box which can be mounted at any location by its installer. The result is flush with the surface of wall 219, with only the speaker/microphone hole 225 being visible above the door. In some applications, the module 40 is adapted to be recessed into a wall so that the microphone and/or audible speaker in the device are flush with the out surface of such wall and may be covered with a decorative or motif matching screening that, while covering and protecting the internal portions of the device, also allow for the reception of audible alarm frequencies that the device is trained to receive and similarly can allow for the broadcast of a tone, voice or other audible sound projection that the device may project or broadcast.

In typical installations, the cavity within which the device is situated in the wall is located "in the wall" behind the outer wall surface material which is typically sheetrock, paneling, bead-board, fabric, glass or polymer like materials. The installer of the device can easily create a hole in the wall face which is similarly sized and shaped as the housing 211 of the electrical and battery components that power and drive the light strands included in the device. The housing 211 portion of the device is affixed inside the cavity and the light strands protrude loosely into the room and remain on the outside of such wall to subsequently be affixed around the periphery of a door, window or other safe ingress/egress portal. Although this cavity can effectively be placed anywhere near the periphery of such door, window or other safe ingress/egress portal, it would typically be placed on center at the top of the exit portal and the light strands would be routed and affixed around such portal so as to illuminate the periphery of such door, window or ingress/egress portal.

In an alternative embodiment, FIG. 24 represents a side-view section of the EMVNA recessed in single-gang electrical outlet box 2100. This view is not to exact scale. Two-screw single-gang driver cover plate 2110 is mounted to wall surface 2460. Single-gang electrical outlet box 2100 is mounted behind two-screw single-gang driver cover plate 2110 and wall surface 2460 and within wall interior 2430. Visible in this view within single-gang electrical outlet box 2100 are two-position barrier strip connector 2390 and five-position dual in-line package (DIP) Switch 2360. Two-wire lead 2210 extends vertically downward from single-gang electrical outlet box 2100 to T-Connector 2200 along wall surface 2460. T-Connector 2200 is mounted on wall surface 2460. This view shows LightStrand 2222 exiting T-Connector 2200 near its base and is shown running on top of door trim 2440 or baseboard 2450 or alternatively running vertically at the edge of door trim 2440 if LightStrand 2222 is on the doorway.

Lock Control Subsystem

Another alternative embodiment includes a system that can unlock one or more exit portal covers in case of an emergency. An exit portal, such as a doorway or window, typically has a portal cover. Portal covers may include a door, window, gate, hatch, or other ingress- or egress-way cover. In a residential structure 100, portal covers such as doors 95 and windows 96 may be locked while persons are in the structure, particularly at night. This alternative embodiment, with its portal cover unlocking capability, includes a modular control subsystem 40 with a means to send an unlock command to effect the unlocking of a portal cover which is directly associated with, and proximate to, the modular control subsystem's 40 location. In this embodiment, when the controller 41 detects an alarm condition, the controller 41 not only activates the illumination subsystem to light the portal periphery, but also activates the lock control subsystem which initiates an unlocking process to unlock one or more portal covers. For a single associated portal cover, this unlocking process begins by the controller 41 sending an unlock command to the portal cover lock control. The unlock command is sent by one or more of several transmission means. In a structure where the is no pre-existing, remotely controllable portal cover lock control means, as in many residential structures, the preferred means for sending the unlock command is an RF signal produced by a transmitter within the modular control subsystem 40, or by an audible signal, or by electronic signal over electrical wires or optical cables. For structures with a pre-existing, remotely controllable portal cover lock control means, as in some commercial buildings, the modular control subsystem 40 may send the unlock command via any of the previous means, or may send a signal to the pre-existing portal cover remote controller which would, in turn, communicate an unlock command to the portal cover lock control. When received by the associated portal cover's lock control subsystem, the unlock command causes the portal cover locking mechanism to unconditionally unlock the portal cover. Once the portal cover is unlocked, persons can then leave or enter the enclosed or semi-enclosed structure through the portal.

In a preferred embodiment of this alternative, the modular control subsystem 40 is situated on, above, or otherwise proximate to a lockable portal cover where the portal is a logical or pre-determined egress-way through which persons in a building may exit in an emergency. Other embodiments are configured to interface with home security systems that will achieve the same result for some or all portals in the structure.

Optimally, in an emergency, the modular control subsystem 40 detects an alarm condition, activates the lights for the exit portal, and simultaneously commands the lock control to unlock the portal cover. The lighted, unlocked portal then allows persons in the structure an unobstructed egress route and rescue personnel outside the structure an unobstructed ingress route.

Yet another alternative embodiment includes a means whereby the modular control subsystem 40 detects a vibration event such as an earthquake, prolonged explosion or series of explosions, or other event that vibrates the structure's walls for several seconds. In a preferred embodiment, the modular control subsystem 40 is mounted to a wall near a portal cover where the portal 95 is a logical or pre-determined egress-way through which persons in a building may exit in an emergency. The module 40 is mounted on a wall and situated above or near a portal cover. The controller 41 detects vibrations that fit the vibration profile, for magnitude and duration, through the module's 40 own vibration sensing device, from a vibration sensing device located in the danger detection array 73, by receiving a vibration alarm signal from the structure's indigenous vibration sensor, or any combination thereof. When the controller 41 detects a vibration event from one or more of the vibration sensor sources, it responds by activating the subsystems in the particular embodiment such as the illumination subsystem, the audible alarm subsystem, and the lock control subsystem, with each subsystem performing its functions as described elsewhere herein.

Some of the embodiments described above feature residential structures as examples, but persons of ordinary skill in the art can appreciate and apply the capabilities of the present invention in many circumstances, combinations, and arrangements in residential and non-residential structures including, but not limited to, commercial, industrial, government, scientific, educational, medical, military, and other structures.

In an alternative embodiment of the present invention, when the modular control subsystem 40 detects an alarm condition, in addition to its other actions, the module 40 transmits an unlock command to the portal cover lock control subsystem. The lock control subsystem includes a means to receive the unlock command from the modular control subsystem 40 and a means to control the portal cover's locking mechanism such that the control can unlock the portal cover.

The lock control subsystem's receiving means can include a receiver or transceiver for radio frequency, audio frequency, or electronic signals and the interconnection of the device with other devices in the system. The preferred embodiment includes an RF receiver embedded in the portal cover and attached to the locking mechanism control means.

The locking mechanism control means controls the portal cover's locking mechanism. If the existing locking mechanism can be adapted to accept the lock control subsystem, the existing locking mechanism can be adapted and reused. Otherwise, the lock control subsystem, including a desired locking mechanism, a receiving means, and a lock control means, replaces the previous locking mechanism. In either case, the control is appropriate for the type of the locking mechanism. The control may include electrical, mechanical, electromechanical, hydraulic, or other means. For example, in a portal cover where the lock is engaged by extending a mechanically actuated sliding metal bolt, as in many residential structures, the locking mechanism control means is preferably an electromechanical actuator to retract the sliding bolt.

The lock control subsystem is installed in or on the portal cover, and is preferably embedded in the portal cover.

For portal covers that are already equipped with a remotely controllable locking mechanism, an alternative embodiment of the lock control subsystem includes a means for communicating with the existing control. For example, if the existing locking mechanism can receive an electrical signal to unlock the portal cover, the module 40 is equipped with a communication means that the controller 41 can activate to produce an unlock command signal that is communicated to the locking mechanism's control such that the control unlocks the portal cover. The module's communication means may include an electrical relay, an RF transmitter, transceiver, or other means that is effective to communicate an unlock command to the existing locking mechanism's control. Such communication means are well known in the art, and a person of ordinary skill in the art can select and configure communication means to achieve communication between the module 40 and the existing remotely controllable locking mechanism.

Some of the examples given for the embodiments described above feature residential structures, but persons of ordinary skill in the art can appreciate and apply the capabilities of the present invention in many circumstances, combinations, and arrangements in residential and non-residential structures.

The Lightsaver Commercial Lighting System. As an alternative ideal for the commercial setting, the LightSaver Commercial System is comprised of a thin scalable length (1' to several thousand feet) of three (3) twisted strands of very small wire that lights brightly when energized, a series of AC electrical inverters (to step the voltage from AC power and sequence the directional pulse), battery back-up power sources (to supply power in the absence of power) and can utilize RF transmitters and receivers (if required in some instances). This twisted wire is connected to an electronic sequencer inverter that energizes each independent wire in the three (3) wire sequence, in a 1-2-3, 1-2-3, 1-2-3 sequence. As each wire lights and then darkens (on-off, on-off, on-off) in harmony with the other two (2) wires and is repeated through the sequence, the optical occlusion effect of twisted or braided wire creates an optical illusion that the light is actually moving linearly along the entire braided strand in one direction. This effect is similar to that which your brain sees when you peer at the front of one of the massive sequenced lighting facades on the front of a casino in Las Vegas. The lights, through their proper sequencing (on-off, on-off, in harmony with the other similar lights in the pattern) cause the light to appear to move laterally along the face of the building structure; the same principal is used in the LightSaver System. Engineers commonly refer to this design as employing a "Jacob's Ladder" effect create the appearance of movement (directionality) of the light message being delivered to the occupant or evacuees during it activation.

Preferably, the braided wire or POF with laser or alternative light being carried along its length, is tiny and inconspicuous and runs laterally along the length of the wall just above floor level along the top of the baseboard, but many sized luminary outside diameter dimensions may be utilized in alternative commercial and industrial type applications and configurations. It can be run through walls, around doors or anywhere we desire to install it. The wire runs along exit corridors, interior hallways, exit stairwells and around interior room doors and provides a seamless line of sequenced and directional light from the most interior spaces of a building structure, along the hallways and corridors leading to emergency exits and then through the fireproof stairwells to the building structure exits leading to the out of doors of the structure; thusly leading evacuees from the depths of the building structure interior to the exterior of the building structure while illuminating and providing directionality along the way. Any event that would trigger an emergency alarm in a building structure can trigger (i.e. turn on) the LightSaver LinearStrobe™ System. The LightSaver LinearStrobe System can stand alone or can easily be integrated with existing fire and smoke alarms and security systems in Hotels/Motels, Casinos, Federal, State and Local Government Building structures, Hospitals, Retirement & Nursing Centers, Dormitories, Universities, Schools (public and private), High-Rise Residential Facilities (Condos/Apartments), Office Building structures, Malls and Retail/Shopping Facilities, Industrial/Manufacturing Facilities, Multi-Family Structures (Low-Rise Apartments) Individual Single Family Residences, Cruise Liners, Commercial Ships, Armed Services Aircraft Carriers, Ships and Submarines and any other Building structure or Structure. Our product is a life-saving public safety product which is triggered by any event that would similarly trigger and turn on an alarm system in a building structure, such as in the event of fire, smoke filling a building structure, an earthquake, a security breach or the release of dangerous levels of harmful or noxious gasses or other events requiring occupant notification in a structure. In actuality, any event which turns on an alarm will trigger the LightSaver LinearStrobe™ System. The public will simply "follow the light" to the nearest exit or will otherwise be able to glean the notification information desirous for the particular application.

This approach to fire safety and the assistance of evacuating a building structure is unique and will ultimately change the dependency of the public from mere exit signage above exits doors (where smoke first accumulates and masks such demarcation of safe exit) to an ultimately codified and required in-place system to light at floor-level AND to indicate the direction to proceed for safe egress from a building structure. This innovation will save lives, help people avoid injury, speed up the building structure evacuation process and will ultimately lessen the importance of exit signage. LightSaver provides a much more efficient, safer and informative path for evacuees to follow when they find themselves in a building structure enduring crisis such as fire, heavy smoke, earthquake, an emission of noxious fumes or toxic inert gasses or a security breach or loss of power to the building. Our process will allow for seamless integration of our system into existing systems, and will enable an added level of yet to be seen information to evacuees when they need it most.

Figure 9:
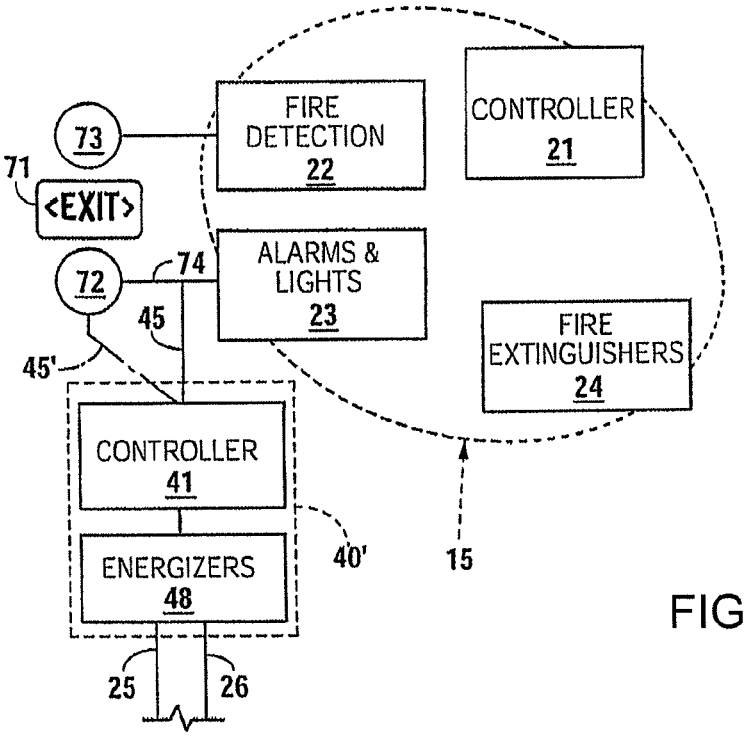
FIG. 9 is a diagram of an alternative preferred exit route illumination subsystem 40' in relation to the general Alarm Control System 15 of a commercial building structure 100' such as depicted in FIG. 2.

FIG. 9 is a diagram of an alternative preferred exit route illumination subsystem 40' in relation to the general Alarm Control System 15 of a commercial building structure 100' such as depicted in FIG. 2. As an alternative ideal for the commercial setting, a preferred exit route illumination subsystem 40' of the present invention is networked with emergency system 15 to be activated together with the alarm 72. Subsystem 40' taps into a power connection within alarm 72, as illustrated by phantom lines 45' in FIG. 9. The functional concept is the same whether connected upstream (line 45) or downstream (line 45') of alarm 72. Either way, exit route illumination subsystem 40 receives its operative power whenever alarm 72 receives power through line 74, in response to detection of an alarm condition by controller 21.

In the illustrated embodiment, the exit route illumination subsystem 40' itself includes a controller 41 and one or more energizers 48 that operate to activate and control the illumination of at least two courses 25, 26 of linear illuminators 20. In operation, when power is supplied to illumination subsystem 40' through lead 45 (or 45'), the controller 41 controls energizers 48 to energize courses 25, 26 such that they emit a bright, readily visible light. Preferably, this is achieved by embodying the linear illuminators 20 of courses 25 and 26 in the form of electroluminescent (EL) wire, although various alternatives approximate some but not all of the benefits of using EL-Wire, as will be evident to those of ordinary skill in the art, particularly from further reading of this detailed description in light of the prior art.

Multiple Strands of Electroluminescent Wire and Directionality. In another preferred embodiment, a grouping of braided, twisted or wound electroluminescent wires are utilized as the linear light source to provide the appearance of light movement and/or directionality in the linear light source. The device is triggered or activated immediately by the audible tones and/or frequencies of smoke alarms proximate the device or through electronic activation of other alarms that the invention is integrated with or through the invention's internal sensors and/or sensing devices and the electroluminescent wires are energized through the device's power source to provide emergency light and light movement. Once energized and illuminated, the wire(s) flash in sequence to illuminate in a predetermined flash or sequence as is predetermined by the devices preprogrammed processor(s), microprocessor(s) and or logic mechanism(s) embedded in the device's construction and this lighted wire shed lights along the outside periphery of an exit door or portal and/or along the floor area proximate such door and areas immediately adjacent thereto through its operation.

The wire(s), which may be contained in a clear jacket, is/are laid upon or otherwise specifically affixed to the top of and vertically along the sides of and generally around the periphery of an exit door or other portal such as a ground-floor window and/or is laid upon base molding along the floor and abutting a corridor wall upon which such molding is affixed.

When multiple strands of electroluminescent wire are utilized as the linear light source, the power source may be channeled through the light source sequentially from one line to the next repeatedly and continuously which causes the light to provide the visual perception of light moving laterally and directionally from one end of the wire to the opposite end of the wire while simultaneously providing an uninterrupted line of floor level directional lighting that is inconspicuous until activated by an emergency signal. The device's linear light source may be located near floor level for better visibility in smoke environments. The lighting and system, in general, may be operated repetitively and nondestructively to allow inclusion of the lighting and system in fire and other emergency drills.

Laser Module. The laser variations of Module 40 can be understood from FIGS. 6 and 8 (and others) which depicts a variation of a kit embodiment of illumination system 10, providing opposite courses 21 and 22 of linear illuminators in the form of laser beams that can be oriented along the edges of the trim member 220 on the wall 219. FIG. 8 is an isometric perspective view of an orthogonal reflector 280 to redirect the laser beam form of linear illumination as operatively provided by the embodiment of FIG. 6. Option to use Laser with: POF as a light conduit and mirrors, prisms, reflectors/refractors or lenses to direct the illumination. The laser kit preferably includes, but not limited to, a laser light source, an LED light source and/or a single or multiple braided or twisted strands of electroluminescent wires (possibly wrapped in a single translucent or colored PVC jacket), side-light emitting plastic optical fiber, reflective mirrors, prisms and or reflectors and refractors possibly in conjunction with reflective luminescent paints, sprays, strips, tapes or adhesives containing of reflective material(s) to enhance the devices luminescence around and or near a safe exit portal of an enclosed or semi-enclosed structure to demark and identify the safe exit door or alternative exit portal which a person seeking emergency egress from a room or building structure should exit through in the event that a fire, smoke, earthquake, terrorist attack or other crisis precipitates the immediate evacuation of a building structure, structure or other enclosed facility.

In one embodiment, the linear emergency light source is constructed of a laser light source wherein the laser light is triggered immediately by the audible tones and/or frequencies of smoke alarms proximate the device or through electronic activation of other alarms that the invention is integrated with or through the invention's internal sensors and/or sensing devices. When activated, such laser light is directed along the outside periphery of an exit door or portal and/or along the floor area near such door immediately adjacent thereto through a series of small mirrors, prisms or reflection/refraction devices or lenses which appropriately direct the laser beam/light along the periphery of the exit door and laterally along the wall wherein such door is situated. The device's linear light source may be located near floor level for better visibility in smoke environments. The lighting and system, in general, may be operated repetitively and nondestructively to allow inclusion of the lighting and system in fire and other emergency drills.

In the context of hallway 105, subsystem 40 preferably performs door illumination of doors 103-104 by illuminating the sides of doors 103-104 that face the hallway 105, which we therefore refer to as the "hallward" sides of doors 103 and 104. Partly because of the linear nature of illuminator 20, and in part due to the various preferred courses of its installation on or around the frames for doors 103 and 104 (rather than on the actual door itself), the door illumination for doors 103-104 also outlines the exit doors 103-104 to highlight doors 103 and 104. In the same context of hallway 105, subsystem 40 also performs hall illumination by illuminating the base of walls 106-107, preferably along lines at the base of the walls 106-107. Hence, hall illumination along the base of walls 106 and 107 outlines the way toward the exit door(s) 103-104. The inherent low height of the baseboards 160, where the illuminators 20 are installed and hall illumination is at its brightest, provides the benefit of being most readily visible to a person in hallway 105 even when hallway 105 is filled with smoke, such as in a fire.

Courses of the Linear Illuminators. In several commercial embodiments, linear illuminators 20 are preferably installed such that two courses 25-26 run from the energizers 48 under a concealed span 49 to two terminal points 23-24 (respectively, shown in FIG. 16) above the exit door 103. Referring to FIG. 16, span 49 (shown in dashed line) is preferably concealed in the sense that no light is able to be seen emitting from that span 49 by any person in the hallway 105 even when both courses 25 and 26 are energized; such concealment being achieved either by enclosing the span 49 in an opaque sleeve or by feeding it to points 23 and 24 through the enclosed space within wall 107.

As will also be described further herein, the remainder of courses 25-26 (i.e., beyond span 49) are positioned to extend left and right from points 23 and 24, to outline the left and right halves of exit door 103, respectively, and thereafter to illuminate the base of the walls of hallway 105 along the baseboards 160 adjacent the floor 109. Preferably, similar installations of exit route illumination systems are made relative to exit doors 103, 104 and 403 (shown in FIG. 17) and every other exit door for the entire structure 100.

FIGS. 11-19 will allow the reader to better understand the light giving portions 21 and 22 of the courses 25 and 26 of the linear illuminator 20, at least as they would relate to the preferred embodiments illustrated therein. FIG. 11 is a perspective view of the internal portion of hallway 105 of structure 100, showing the placement of the linear illuminator 20 according to various aspects of this invention. FIG. 16 is a perspective view of the internal portion of hallway 105 much like that of FIG. 11, except with a closer perspective of exit door 103, illustrating more detail on the placement of linear illuminator 20 relative to that exit door 103.

Beyond the terminal points 23, 24, other than variations due to door and corner spacing in hallway 105, illuminator courses 25 and 26 are similar to each other in basic characteristics. From the terminal points 23 and 24 above exit door 103, the left course 25 outlines the left side of door frame molding 97, and the right course 26 outlines the right side of door frame molding 97. As is evident in FIG. 16, points 23 and 24 mark the start of the illuminated portions 21 and 22 of the two courses 25 and 26. The illuminated portions 21 and 22 are placed to course in opposite directions around the illuminated exit door 103 and beyond. Course 21 proceeds from terminal point 23 to the left in FIG. 16; whereas course 22 proceeds from terminal point 24 to the right in FIG. 16. Points 23 and 24 are generally on the center line of the doorway of door 103, positioned adjacent each other beneath sign 71. The courses 21 and 22 of illuminator 20 respectively outline the left and right halves of door 103, preferably being adhered or tacked in place along the outside edge of frame molding 97 of door 103 until the courses meet the top edge of baseboard 160 at corners 18 and 19, respectively. For exit door 103, corners 18 and 19 mark the end of the door-outlining portions of courses 21 and 22, respectively. When operatively energized, such door-outlining portions of illuminator 20 not only achieve door illumination of door 103, but also serve to dramatically highlight the shape of exit door 103 to anyone standing in hallway 105. For further highlighting of exit door 103, the illuminators in this outline of exit door 103 are preferably sheathed in a transparent red sleeve to color the door-outlining portions red for viewers in the hallway 105.

To achieve hallway illumination, the linear illuminators 20 are operatively installed along the base of walls 106-107, along where walls 106-107 meet the floor 109 of hallway 105. Aside from the above-described door-outlining portions of illuminator 20 for each exit door 103-104, from the vantage point of one standing in hallway 105, essentially all other portions of illuminator 20 in the preferred embodiment are positioned along the base of walls 106-107, which preferably includes baseboard 160. With such positioning of linear illuminator 20 lengthwise along the lower portions of the side walls 106 of hallway 105, preferably along baseboards 160, illuminator 20 is positioned to hall illumination as well as to designate the route (or path) toward exit doors 103 and 104. When operatively energized, illuminator 20 illuminates each side of the hallway 105 along the baseboard 160, adjacent to floor 109. Because of the proximity of illuminator 20 to the floor 109, much of the floor 109 itself is also illuminated to help light the way for occupants to exit structure 100. Because of such positioning, these portions of illuminator 20 along baseboards 160 are referred to for reference as the "hall-defining portions" of illuminator 20.

In some embodiments, placement along baseboards 160 is achieved by adhering or tacking illuminator 20 along the baseboard, much as the door-frame-outlining portions are adhered or tacked along the outer edge of the door frame 97 of door 103.

Figure 12:
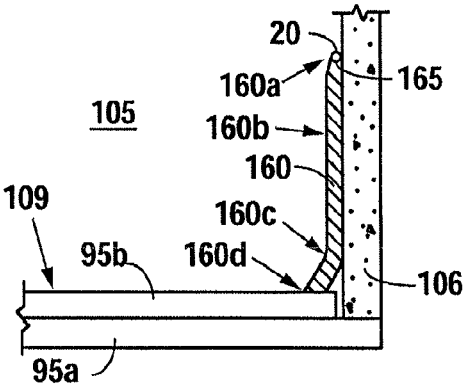
FIG. 12 is a cross-sectional view of wall 106 of the hallway 105 within which linear illuminator 20 is installed in a pre-formed groove 165 of cove base 160, as is one preferred way of associating illuminator 20 with wall 106 at a height adjacent to the floor 109. For reference, the approximate vantage point for FIG. 12 is designated as vantage plane 12-12 in the lower right portion of FIG. 11.
Figure 13:
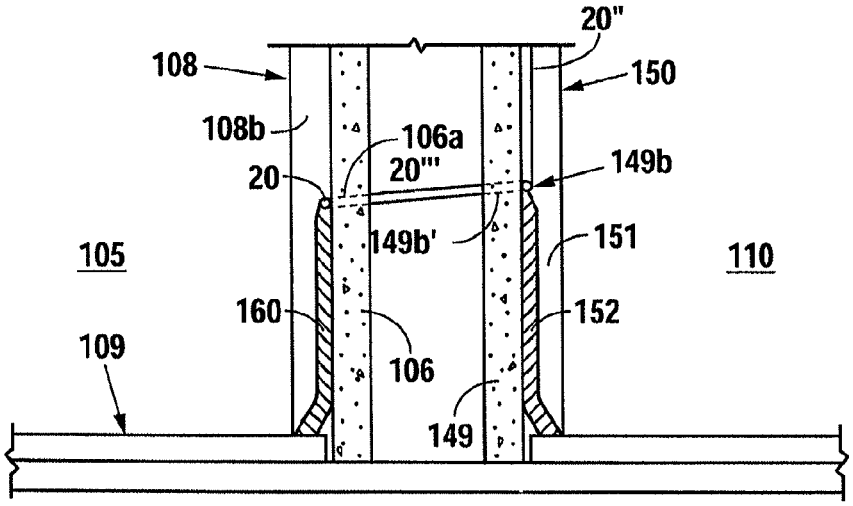
FIG. 13 is a cross-sectional view much like FIG. 12, except that the vantage point for FIG. 13 is expanded to allow illustration of a preferred placement of illuminator 20 in association with the baseboard 160 of hallway 105 while also outlining the door frame molding 150 (shown in FIG. 15) within room 110. For reference, the approximate vantage point for FIG. 13 is designated as vantage plane 13-13 in the lower left region of wall 149 in FIG. 15.

Illuminator Placement in Baseboard Groove. As one preferred alternative, though, a groove 165 that is pre-formed, extruded or cut into baseboard 160 secures the hall-defining portions of linear illuminator 20 in place relative to baseboards 160. As best seen in FIGS. 12-14, baseboards 160 are preferably embodied as elastomeric vinyl cove base material that is adhered to the lower edge of walls 106 with mastic or other conventional construction adhesives. Groove 165 is preferably pre-formed in the cove base material, being formed during the process of manufacturing (i.e., extruding) the cove base material 160. As illustrated the groove 165 is a continuous groove along the top edge 160*a* of cove base baseboard 160, although the groove 165 may alternatively be positioned either at the bottom edge 160*d*, at the bend 160*c*, or anywhere midway on the vertical face 160*b* of the baseboard 160. The groove 165 allows not only for convenient and secure placement of illuminator 20, but also provides a smaller protrusion (profile) for illuminator 20 such that it is not highly noticeable until and unless it is illuminated.

FIG. 12 is a cross-sectional view of wall 106 of the hallway 105 within which linear illuminator 20 is installed in a pre-formed groove 165 of cove base 160, as is one preferred way of associating illuminator 20 with wall 106 at its base height adjacent to the floor 109. In addition to the minimal diameter (preferably less than 3.5 mm) of linear illuminator 20, the preferred embodiment of illuminator 20 includes a clear, flexible, sleeve-like casing or jacket 14 (shown in phantom lines in FIG. 18). Jacket 14 is preferably a flexible, clear PVC coating or a clear LSZH (low smoke zero halogen) jacket. The relatively small diameter and clear properties of jacket 14 help provide relative inconspicuousness (i.e., virtual invisibility to the casual observer in hallway 105) of illuminator 20 along baseboard 160. This configuration allows the hall-defining portions of linear illuminator 20 to follow the course of the hallway 105 while also being relatively invisible when not illuminated, due in part to its subdued placement on the lines of cove base 160 and its minimal profile protruding therefrom.

Flanged Alternative Illuminator. FIG. 14 is very similar to FIG. 12, except that FIG. 14 illustrates an alternative embodiment of illuminator 20, namely illuminator 20' that has an integral lengthwise flange (or "tail") 320. As is also depicted in FIG. 19, flange 320 is preferably formed integral with the jacket 14 of illuminator 20. The lengthwise flange 320 (or its equivalent) is preferably formed from the same material as the outer sheath or casing 14 of illuminator 20. Flange 320 accordingly has a flexible elastomeric composition. Flange 320 also has a thin cross-section that preferably slightly tapers toward its distal end (as shown in FIG. 19), in order to give it a balance of flexibility and support. The structure of flange 320 enables mounting of flange 320 (with nails, staples, adhesive or the like) behind baseboard 160 as shown in FIG. 14. Such mounting of flange 320 behind baseboard 160 (i.e., in the crack between baseboard 160 and wall 106) positions the remainder of illuminator 20 (i.e., its bulk that has a generally circular cross section in FIG. 19) such that it appears to rest along the top edge 160*a* of baseboard 160. Hence, variations of illuminator 20 that include a flange 320 are particularly well suited for embodiments in which baseboard 160 is not adapted with a groove 165.

Adaptations for Non-Exit Doors. While outlining and illuminating the exit doors in a corridor is characteristic of many embodiments of the present invention, it is preferred that other doors in the same corridor (i.e., "upstream" or "non-exit" doors that lead the wrong way or away from the ideal exits) not be outlined or illuminated, to minimize confusion. Hence, as viewed from within hallway 105, the hallward sides of exit doors 103 and 104 (shown in FIGS. 1A & 1B) are outlined and illuminated, but the hallward side of doors 130-148 are preferably not outlined or illuminated. Such selective illumination of doors in the same hallway 105—i.e., illuminating exit doors 103 and 104 without illuminating the other doors 130-148—darkens the hallward sides of upstream (or non-exit) doors 130-148 relative to the exit doors 103-104 for hallway 105.

Preferably, relative darkening of the hallward sides of upstream doors 130-148 while also illuminating the baseboards 160 of hallway 105 is achieved in one of two alternate ways—either by bypassing the hallward side of the upstream doors 130-148, or by sheathing the illuminator 20 with an opaque sheath around the hallward side of those upstream doors 130-148. Although not explicitly shown in any of the drawings, elevator doors and other doors that should not be opened for exiting purposes are treated the same, or much the same, as upstream doors that are not illuminated (i.e., relatively darkened) when illuminators 20 are energized.

Bypassing the hallward sides of upstream doors 130-148 is itself preferably accomplished by one of two techniques—either by routing the illuminator under the door jamb for the upstream doors 130-148 such that it is not visible in that span (while also not presenting a tripping hazard), or by illuminating the opposite side (i.e., the roomward side) of such doors 130-148.

Commercial Monitoring Subsystem. With cross-reference to FIG. 9, a commercial structure 100' also has an emergency system 15 adapted with a monitoring subsystem 22, an alarm subsystem 23 (into which the exit route illumination subsystem 40' is connected), and an emergency response subsystem 24. In the embodiments of FIG. 9, the controller 21 for emergency system 15 is centralized for the entire structure 100', although those of ordinary skill in the art will readily understand how alternative embodiments can be installed with either power or a triggering signal received from a local smoke detector or other alarm that is not networked to a larger system. The power supply line 45 for subsystem 40 can be spliced into the low-voltage power supply line 74 that actuates the alarm 72, such that illumination subsystem 40 is automatically activated when the alarm 72 is activated. As will be understood by those of skill in the art, alternative embodiments of the present invention would be adapted to illuminate appropriate exit routes in the event of an emergency, be it a smoke or fire disaster, a security breach, a noxious fumes hazard, or some other form of emergency.

In any case, monitoring subsystem 22 is a system for monitoring the conditions in and/or around the structure 100' to detect potential dangers. Preferably, the monitoring subsystem 22 of system 15 includes one or more fire detectors, either in the form of smoke detectors (such as fire detector 73 illustrated in FIGS. 2, 9 and 16, which is a conventional smoke detector), heat detectors, carbon monoxide detectors, or some combination of those. Such fire detectors preferably include a combination of photoelectric sensors and thermocouples to detect either or both smoke and heat. Alternative embodiments also (or instead) include sensors for detecting dangerously high levels of carbon monoxide or other gasses, explosimeters, radon gas detectors, tornado proximity detectors, glass-break sensors, door or window-opening sensors, and any other desired type of hazard detectors in the monitoring subsystem 22 along with (or instead of) the fire detector(s) 73.

For embodiments monitoring security breaches, monitoring subsystem 22 includes detectors for monitoring glass break or door/window opening alarm switches, motion detectors and/or panic buttons. For embodiments monitoring for a noxious fumes hazard, the monitoring subsystem would include sensors for detecting excessive concentrations of CO or other potentially dangerous gasses (such as radon) in or around the structure, and the response subsystem would preferably be linked with a security alarm system to flash and sound special alarms in the event such excessive concentrations are detected. In an industrial manufacturing or processing setting, comparable systems may be employed to alert workers of noxious fumes within confined spaces.

Response Subsystem. When dangerous conditions are detected, controller 21 not only activates alarm subsystem 23 but, preferably, also initiates remedial measures through an emergency response subsystem 24. Such remedial measures are intended to mitigate the detected dangerous conditions, either in response to dangerous detections by the monitoring subsystem 22 or in response to manual or remote actuation of an alarm switch. In the preferred embodiment of an emergency system 15 for monitoring and responding to fire conditions, the response subsystem 24 is embodied to include a fire suppression system that may include sprinklers, halogen systems or analogous systems for other types of emergencies. The response subsystem 24 includes other types of actuators either in addition to or instead of the fire suppression system in other embodiments. Actuators for alerting law enforcement and security agencies, for instance, as well as visual and audible alarms 72, are included in embodiments adapted to monitor security breaches.

Alarm Subsystem. Perhaps most central to the functions of emergency system 15 is its function performed by controller 21 to alert occupants when monitoring subsystem 22 detects dangerous conditions. Controller 21 alerts such occupants by controlling alarm subsystem 23 to present both audible and visual alarms. In the preferred FIG. 9 embodiments, alarm subsystem 23 includes a DC-powered, combined audible alarm and flashing light alarm 72 mounted directly beneath the EXIT light 71 of FIGS. 8 & 15. In addition, the alarm subsystem 23 is also connected to an exit route illumination subsystem 40 that illuminates exit doors and/or hallways whenever alarm 72 is activated.

Illumination Subsystem. The preferred exit route illumination subsystem 40 of the present invention is networked with emergency system 15 to be activated together with the alarm 72. For simplicity of installation, exit route illumination subsystem 40 is preferably capable of operating on low-voltage DC power the same as alarm 72. The low-voltage power supply may be either battery or inverter powered, preferably at voltages that match the voltage of the existing monitoring and alarm subsystems 22 and 23. Note that, as an alternative to low voltage battery power, other embodiments are adapted to be powered by AC power in one of two modes—either by converting the AC power to DC through an inverter or the like, or by stepping-down the AC power to safe levels and directing the stepped-down AC power directly into the illuminator 20. The power supply line 45 for subsystem 40 can be spliced into the low-voltage power supply line 74 that actuates the alarm 72, such that illumination subsystem 40 is automatically activated when the alarm 72 is activated. As an alternative, subsystem 40 taps into a power connection within alarm 72, as illustrated by phantom lines 45' in FIG. 2. The functional concept is the same whether connected upstream (line 45) or downstream (line 45') of alarm 72. Either way, exit route illumination subsystem 40 receives its operative power whenever alarm 72 receives power through line 74, in response to detection of an alarm condition by controller 21.

In the illustrated embodiment, the exit route illumination subsystem 40 itself includes a controller 41 and one or more energizers 48 that operate to activate and control the illumination of at least two courses 25, 26 of linear illuminators 20. In operation, when power is supplied to illumination subsystem 40 through lead 45, the controller 41 controls energizers 48 to energize courses 25, 26 such that they emit a bright readily visible light. Preferably, this is achieved by embodying the linear illuminators 20 of courses 25 and 26 in the form of electroluminescent (EL) wire, although various alternatives approximate some but not all of the benefits of using EL wire, as will be evident to those of ordinary skill in the art, particularly from further reading of this detailed description in light of the prior art.

Illuminator Functions. In the FIG. 2 embodiment, the essence of subsystem 40 is the exit route illumination subsystem 40, which is adapted to energize courses of linear illuminators in response to one or more emergency conditions. Preferably, when not energized, the linear illuminators are hardly noticeable to a passer-by in the space where they are installed (such as in hallway 105). However, when activated by energizers 48, the linear illuminators (numbered as linear illuminators 20, 20' and 420 in various illustrated embodiments) help occupants exit the building 100 by (i) illuminating one or more exit doors (the "door illumination" function), and/or (ii) illuminating the base of the walls around the space leading toward the exit door(s) (the "hall illumination" function).

In the context of hallway 105, subsystem 40 preferably performs door illumination of doors 103-104 by illuminating the sides of doors 103-104 that face the hallway 105, which we therefore refer to as the "hallward" sides of doors 103 and 104. Partly because of the linear nature of illuminator 20, and in part due to the various preferred courses of its installation on or around the frames for doors 103 and 104 (rather than on the actual door itself), the door illumination for doors 103-104 also outlines the exit doors 103-104 to highlight doors 103 and 104. In the same context of hallway 105, subsystem 40 also performs hall illumination by illuminating the base of walls 106-107, preferably along lines at the base of the walls 106-107. Hence, hall illumination along the base of walls 106 and 107 outlines the way toward the exit door(s) 103-104. The inherent low height of the baseboards 160, where the illuminators 20 are installed and hall illumination is at its brightest, provides the benefit of being most readily visible to a person in hallway 105 even when hallway 105 is filled with smoke, such as in a fire.

Courses of the Linear Illuminators. Linear illuminators 20 are preferably installed such that two courses 25-26 run from the energizers 48 under a concealed span 49 to two terminal points 23-24 (respectively, shown in FIG. 16) above the exit door 103. Referring to FIG. 7, span 49 (shown in dashed line) is preferably concealed in the sense that no light is able to be seen emitting from that span 49 by any person in the hallway 105 even when both courses 25 and 26 are energized; such concealment being achieved either by enclosing the span 49 in an opaque sleeve or by feeding it to points 23 and 24 through the enclosed space within wall 107.

As will also be described further herein, the remainder of courses 25-26 (i.e., beyond span 49) are positioned to extend left and right from points 23 and 24, to outline the left and right halves of exit door 103, respectively, and thereafter to illuminate the base of the walls of hallway 105 along the baseboards 160 adjacent the floor 95. Preferably, similar installations of exit route illumination systems are made relative to exit doors 103, 104 & 403 (shown in FIG. 17) and every other exit door for the entire building 100.

FIGS. 3-8 will allow the reader to better understand the light giving portions 21 & 22 of the courses 25 and 26 of the linear illuminator 20, at least as they would relate to the preferred embodiments illustrated therein. FIG. 11 is a perspective view of the internal portion of hallway 105 of building 100, showing the placement of the linear illuminator 20 according to various aspects of this invention. FIG. 16 is a perspective view of the internal portion of hallway 105 much like that of FIG. 11, except with a closer perspective of exit door 103, illustrating more detail on the placement of linear illuminator 20 relative to that exit door 103.

Beyond the terminal points 23, 24, other than variations due to door and corner spacing in hallway 105, illuminator courses 25 and 26 are similar to each other in basic characteristics. From the terminal points 23 and 24 above exit door 103, the left course 25 outlines the left side of door frame molding 97, and the right course 26 outlines the right side of door frame molding 97. As is evident in FIG. 16, points 23 and 24 mark the start of the illuminated portions 21 and 22 of the two courses 25 and 26. The illuminated portions 21 and 22 are placed to course in opposite directions around the illuminated exit door 103 and beyond. Course 21 proceeds from terminal point 23 to the left in FIG. 16; whereas course 22 proceeds from terminal point 24 to the right in FIG. 16. Points 23 and 24 are generally on the center line of the doorway of door 103, positioned adjacent each other beneath sign 71. The courses 21 and 22 of illuminator 20 respectively outline the left and right halves of door 103, preferably being adhered or tacked in place along the outside edge of frame molding 97 of door 103 until the courses meet the top edge of baseboard 160 at corners 18 and 19, respectively. For exit door 103, corners 18 and 19 mark the end of the door-outlining portions of courses 21 and 22, respectively. When operatively energized, such door-outlining portions of illuminator 20 not only achieve door illumination of door 103, but also serve to dramatically highlight the shape of exit door 103 to anyone standing in hallway 105. For further highlighting of exit door 103, the illuminators in this outline of exit door 103 are preferably sheathed in a transparent red sleeve to color the door-outlining portions red for viewers in the hallway 105.

To achieve hallway illumination, the linear illuminators 20 are operatively installed along the base of walls 106-107, along where walls 106-107 meet the floor 95 of hallway 105. Aside from the above-described door-outlining portions of illuminator 20 for each exit door 103-104, from the vantage point of one standing in hallway 105, essentially all other portions of illuminator 20 in the preferred embodiment are positioned along the base of walls 106-107, which preferably includes baseboard 160. With such positioning of linear illuminator 20 lengthwise along the lower portions of the side walls 106 of hallway 105, preferably along baseboards 160, illuminator 20 is positioned to hall illumination as well as to designate the route (or path) toward exit doors 103 and 104. When operatively energized, illuminator 20 illuminates each side of the hallway 105 along the baseboard 160, adjacent to floor 95. Because of the proximity of illuminator 20 to the floor 95, much of the floor 95 itself is also illuminated to help light the way for occupants to exit building 100. Because of such positioning, these portions of illuminator 20 along baseboards 160 are referred to for reference as the "hall-defining portions" of illuminator 20.

In some embodiments, placement along baseboards 160 is achieved by adhering or tacking illuminator 20 along the baseboard, much as the door-frame-outlining portions are adhered or tacked along the outer edge of the door frame 97 of door 103.

Illuminator Placement in Baseboard Groove. As one preferred alternative, though, a groove 165 that is pre-formed, extruded or cut into baseboard 160 secures the hall-defining portions of linear illuminator 20 in place relative to baseboards 160. As best seen in FIGS. 12-14, baseboards 160 are preferably embodied as elastomeric vinyl cove base material that is adhered to the lower edge of walls 106 with mastic or other conventional construction adhesives. Groove 165 is preferably pre-formed in the cove base material, being formed during the process of manufacturing (i.e., extruding) the cove base material 160. As illustrated the groove 165 is a continuous groove along the top edge 160*a* of cove base baseboard 160, although the groove 165 may alternatively be positioned either at the bottom edge 160*d*, at the bend 160*c*, or anywhere midway on the vertical face 160*b* of the baseboard 160. The groove 165 allows not only for convenient and secure placement of illuminator 20, but also provides a smaller protrusion (profile) for illuminator 20 such that it is not highly noticeable until and unless it is illuminated.

FIG. 12 is a cross-sectional view of wall 106 of the hallway 105 within which linear illuminator 20 is installed in a pre-formed groove 165 of cove base 160, as is one preferred way of associating illuminator 20 with wall 106 at its base height adjacent to the floor 95. In addition to the minimal diameter (preferably less than 3.5 mm) of linear illuminator 20, the preferred embodiment of illuminator 20 includes a clear, flexible, sleeve-like casing or jacket 14 (shown in phantom lines in FIG. 18). Jacket 14 is preferably a flexible, clear PVC coating or a clear LSZH (low smoke zero halogen) jacket. The relatively small diameter and clear properties of jacket 14 help provide relative inconspicuousness (i.e., virtual invisibility to the casual observer in hallway 105) of illuminator 20 along baseboard 160. This configuration allows the hall-defining portions of linear illuminator 20 to follow the course of the hallway 105 while also being relatively invisible when not illuminated, due in part to its subdued placement on the lines of cove base 160 and its minimal profile protruding therefrom.

Flanged Alternative Illuminator. FIG. 14 is very similar to FIG. 12, except that FIG. 14 illustrates an alternative embodiment of illuminator 20, namely illuminator 20' that has an integral lengthwise flange (or "tail") 320. As is also depicted in FIG. 19, flange 320 is preferably formed integral with the jacket 14 of illuminator 20. The lengthwise flange 320 (or its equivalent) is preferably formed from the same material as the outer sheath or casing 14 of illuminator 20. Flange 320 accordingly has a flexible elastomeric composition. Flange 320 also has a thin cross-section that preferably slightly tapers toward its distal end (as shown in FIG. 19), in order to give it a balance of flexibility and support. The structure of flange 320 enables mounting of flange 320 (with nails, staples, adhesive or the like) behind baseboard 160 as shown in FIG. 14. Such mounting of flange 320 behind baseboard 160 (i.e., in the crack between baseboard 160 and wall 106) positions the remainder of illuminator 20 (i.e., its bulk that has a generally circular cross section in FIG. 19) such that it appears to rest along the top edge 160*a* of baseboard 160. Hence, variations of illuminator 20 that include a flange 320 are particularly well suited for embodiments in which baseboard 160 is not adapted with a groove 165.

Adaptations for Non-Exit Doors. While outlining and illuminating the exit doors in a corridor is characteristic of many embodiments of the present invention, it is preferred that other doors in the same corridor (i.e., "upstream" or "non-exit" doors that lead the wrong way . . . away from the ideal exits) not be outlined or illuminated, to minimize confusion. Hence, as viewed from within hallway 105, the hallward sides of exit doors 103 and 104 (shown in FIG. 1B) are outlined and illuminated, but the hallward side of doors 130-148 are preferably not outlined or illuminated. Such selective illumination of doors in the same hallway 105—i.e., illuminating exit doors 103 and 104 without illuminating the other doors 130-148—darkens the hallward sides of upstream (or non-exit) doors 130-148 relative to the exit doors 103-104 for hallway 105.

Preferably, relative darkening of the hallward sides of upstream doors 130-148 while also illuminating the baseboards 160 of hallway 105 is achieved in one of two alternate ways—either by bypassing the hallward side of the upstream doors 130-148, or by sheathing the illuminator 20 with an opaque sheath around the hallward side of those upstream doors 130-148. Although not explicitly shown in any of the drawings, elevator doors and other doors that should not be opened for exiting purposes are treated the same, or much the same, as upstream doors that are not illuminated (i.e., relatively darkened) when illuminators 20 are energized.

Bypassing the hallward sides of upstream doors 130-148 is itself preferably accomplished by one of two techniques—either by routing the illuminator under the door jamb for the upstream doors 130-148 such that it is not visible in that span (while also not presenting a tripping hazard), or by illuminating the opposite side (i.e., the roomward side) of such doors 130-148.

Outlining the Roomward Side of Doors. With references to FIGS. 11, 13 and 15, one can appreciate the preferred positioning and the related installation technique for bypassing the hallward side by illuminating the roomward side of doors 130-148. Cross-referencing FIG. 11, the hall-defining portions of illuminator 20 proceed from the hallway's exit door 103 to the proximal edge 108*a* of the molding 108 around the door 130 for room 110. Then, to minimize confusion of an occupant in hallway 105, illuminator 20 preferably does not outline door 130 on the hallward side facing hallway 105 (visible in FIG. 11). Rather, from that point where illuminator 20 meets the proximal edge 108*a* of door frame molding 108, the course of illuminator 20 penetrates through the wall 106 and outlines the door 130 on its roomward side, which is on the inside of room 110 (as visible in FIG. 15). Then, after coursing around the perimeter 151 of the frame 150 of door 130 on its roomward side, the course of illuminator 20 is directed back through wall 106 into hallway 105.

The installation of illuminator 20 on the roomward side of door 130 can be more particularly seen by cross-referencing FIGS. 11, 13 and 15. As illuminator 20 is being installed, its course proceeding away from exit door 103 first enters room 110 through a hole drilled from wall 106 through wall 149, entering room 110 at the junction point 149*a* where baseboard 152 abuts the roomward frame 150 of door 130. The course of illuminator 20 is then directed up and around the perimeter 151 of doorframe 150 to produce a door-illuminating portion 20" of illuminator 20, for illuminating and/or outlining the roomward side of door 130 inside room 110. The door-illuminating portion 20" in room 110 then terminates at the junction point 149*b* where the perimeter 151 of frame 150 again intersects with the baseboard 152 in room 110. At junction point 149*b*, the course of illuminator 20 penetrates wall 149 and wall 106 to leave room 110 and re-enter hallway 105.

As can be seen in FIG. 13, it should be recognized that wall 149 and wall 106 are actually the sheetrock faces of opposite sides of the same wall. So, for the course of illuminator 20 to penetrate the wall from room 110 to hallway 105 (or, by analogy, the opposite way from hallway 105 to one of the rooms 110-128), it passes through both layers of sheetrock and everything in between. This can be accomplished by drilling or otherwise providing a hole 149*b*' at the point 149*b* on wall 149, preferably aligned with a comparable hole 106*a* in wall 106. The hole 106*a* is positioned on the hallward side of wall 106 close to the corner where the top edge 160*a* of cove base 160 abuts the edge 108*b* of frame molding 108. The linear illuminator is then fed from room 110 through holes 149*b*' and 106*a*. Back within hallway 105, the illuminator 20 can then be re-secured along cove base 160 to re-convene the hall-defining course in the manner previously described.

In similar fashion, each of the upstream doors for a particular space, such as each of doors 130-148 for hallway 105, are preferably bypassed on their hallward sides and illuminated instead on their roomward (or upstream) sides. In addition to the illumination provided in hallway 105, the outlining and/or illumination of the roomward sides of doors 130-148 enables occupants within rooms 110-128 to visually identify the way to safety in the event of an emergency condition detected by system 15.

Successively-Illuminated Exit Doors. So, in use, when illumination is energized from a single circuit of linear illuminators 20 from a given exit door (such as exit door 103), the illuminated circuit guides an occupant in an upstream room through successive doors leading to safety. For the illuminator circuit based at exit door 103, for instance, if a guest in the hotel of structure 100 is asleep in bed 110' of room 110 when system 15 detects a fire or other emergency, the system 15 controls its subsystems 23 and 40 to bring the guest progressively toward a safe exit from structure 100. Such a progression begins with sounding of the audible alarm from alarm 72, waking and alerting the guest. When alert, the guest notices that the roomward side of door 130 is highlighted with a brightly-illuminated outline, which prompts the guest to get out of bed 110' and leave the room 110 into hallway 105 through door 130. Once in hallway 105, hallway illumination along baseboard 160 indicates and highlights the path for the guest to move toward exit door 103.

Plus, the room-exit process that the guest just experienced in exiting room 110 through an illuminated door 130 has trained the guest to exit through successive illuminated doors. The door illumination of illuminator 20, therefore, draws the guest to exit through door 103 as the guest sees its illumination while other upstream doors (for example, doors 132 and 133) are relatively darkened on their sides facing hallway 105. To reinforce the clarity of this learned exit behavior, the illumination system is preferably installed such that the appearance of the door illumination within rooms 110-128 is substantially the same as the appearance of door 103 in hallway 105. Hence, if the door-outlining portions of illuminator 20 that outline door 103 are adapted to illuminate in the red color as is preferred (or in any other unique manner), the door illuminating portion 20" in the individual rooms are preferably also adapted with sleeves, coatings or the like to illuminate red in the same way as with door 103.

Much the same is true for occupants in any of the rooms 110-128 in structure 100'. When the illumination subsystem 40 is energized, each of the doorways 130-148 are illuminated as seen from inside rooms 110-128 which indicates to the room occupants that the doorway connects to the main corridor of hallway 105. Yet, from the perspective of an occupant already in hallway 105 outside the rooms 110-128, the hallward sides of the same doorways 130-148 are relatively darkened.

More Progression in Stairwells. FIG. 17 is a perspective view from within a stairwell such as North Stair 101 of FIG. 1B, to illustrate another and/or an expanded embodiment of an exit route illumination subsystem 40 according to teachings of the present invention. In FIG. 17, linear illuminator 420 and its controller 440 and other related components are like illuminator 20 of FIGS. 9-15, except that illuminator 420 is installed in a stairwell. In the illustrated stairwell 101, there are two doors 103 and 403. From inside the stairwell 101, door 403 is the one that leads to safety while door 103 leads back to hallway 105, which makes door 403 the one that occupants should proceed through in the event of an emergency.

As in the FIG. 1-8 embodiments, the origin terminal ends of illuminator 420 are above the exit door 403 that occupants of the stairwell 101 should exit in an emergency. From those origin terminal ends, opposing courses 421-422 of illuminator 420 outline door frame molding 497 and then follow baseboard 460 laterally on wall 407 and then along baseboard 460 at the bottom of side wall 406, along the length of the pathway in the stairwell and up or down the stairs away from the exit door 403 (downward on wall 406 in FIG. 17). Hence, once a guest at the hotel has exited hallway 105 into stairwell 101, there is a further progression of path illumination and door illumination to continue leading the guest to safety.

As an alternative embodiment of stairwell illuminator 420, its course can be adjusted to highlight the stair-step profile of stairs 496, along the base of wall 406, to help further orient an occupant in stairwell 101. This alternative presents the linear illuminator 20 following the exact step-profile shape of the stairs 496. The controller and energizers are similar to that depicted in other figures including FIG. 17, with the exception of the stair-step appearance of illuminator 420 between the two doors.

Alternatives within Upstream Rooms. As will be evident to those of skill in the art, there are many variations on the themes of system 15 and subsystems 22-24 and 40. For example, with reference to the perspective view of FIG. 15, accommodations can be made to add linear illuminators along all the baseboards within a room such as room 110, preferably with adaptations to not just illuminate, but also to indicate the direction for an occupant to move in order to get closer to door 130.

As will also be evident, similar successions of exit door illumination may also extend further upstream into still further halls, rooms and the like, whether they be sleeping quarters, dining rooms, banquet halls, restrooms, ballrooms or any other type of room that can exit into and through hallway 105. From such upstream rooms and halls, additional illuminator subsystems like subsystem 40 may be deployed to direct the occupants toward hallway 105, where the system illustrated in FIG. 1B then leads them to exit doors 103-104, thereby leading the occupant progressively to an eventual exit from the structure 100.

El-Wire Embodiments. As described previously, some preferred embodiments embody the linear illuminator 20 as EL-Wire, which is capable of providing bright illumination with minimal power consumption. Indeed, currently available variations of EL-Wire consume only about 0.15 amps per linear foot with a 0.9 mm diameter EL-Wire (available from Lytec of Israel, Lytec of China, and other manufacturers in China and worldwide). On a single readily-available 12-Volt battery, eight hundred to a thousand feet of EL-Wire can be easily illuminated in some preferred embodiments.

Figure 10:
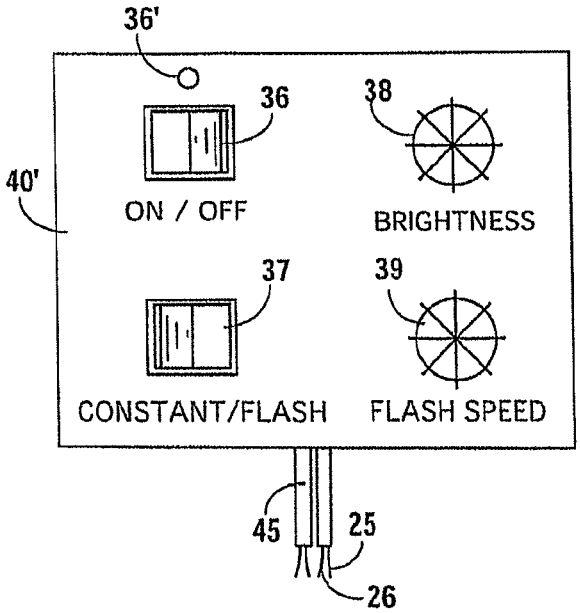
FIG. 10 is a pictorial illustration of a control box 40' that contains controller 41 and energizers 48 for at least one alternative embodiment of the illumination subsystem 40' depicted schematically in FIG. 9.

The preferred EL-Wire embodiment uses commercially-available individually specified electroluminescent wire designed for the invention and manufactured by others or the inventor, "High Bright" EL-Wire, or Ellumiglow's Laser Wire, which has a clear outer casing 14 and appears fairly pale when not energized, but illuminates as bright aqua blue. Applicant has found that the "high bright" variations provide highly visible illumination. With reference to FIG. 10, knob 38 is provided on controller console 40' to adjust the power levels being supplied to the courses 25-26 of linear illuminator 20, to thereby adjust the brightness of illuminator 20 when energized. Each illuminator 20 is preferably constructed of at least one strand of EL-Wire, although multiple strands of EL-Wire (or other form of illuminator) are used for enhanced features in some embodiments (as described further herein).

It is widely known that green based wavelengths (like the aqua-white light emitted by the EMVNA) are the easiest colors for human's visual systems to detect, especially in dark or darkening (contrasted) settings. It has been shown that in these contrasted settings, the human eye sees all light as "white" light. At reasonable levels of illumination output in contrasted settings, such as that of the inside of a space or building during a fire when smoke is present, human visual systems just see light; and not the color of the light emitted. The EMVNA light emission, by design, provides the benefit of both an appropriate level of light intensity in a contrasted setting and an easy color for the human eye/brain to see/process.

Although the human eye can see over 10 million colors, the human eye is most sensitive to light emitted at a wavelength of 495 nm which in dark or contrasted settings is seen as white light to the human eye and brain. That wavelength (495 nm) is precisely halfway between green and blue in the color spectrum; exactly where the EMVNA light color falls. This area of the color spectrum is most visible and easiest to see (for the human brain to process) because this color actually demands the least amount of energy by the human eye and brain to see and process, respectively, the light. This is especially true in a contrasted setting in a dark or darkening volume of space; such as in a building space filling with smoke. In fact, consideration of human color visual sensitivity has led to drastic changes in the long-standing practice of painting emergency vehicles, such as fire trucks and ambulances entirely red. Although the color (red) is historically intended for the vehicles to be easily seen and responded to, the wavelength distribution is not highly visible at low light levels and, actually, can appear nearly black in the evening or at night.

The EMVNA light pulses conform to the code required UL Standards for flash rates as they flash in a variety of frequencies (model's flash rates vary depending on the model and use). The EMVNA combined pulse and color combination are uniquely designed to easily catch the attention of human eye in a crisis situation; particularly at night or in a dark or darkening volume of space where smoke, in a fire, is billowing in and quickly darkens the space by blocking out the existing conventional forms of light found in most buildings and homes or spaces today. In fact, in recent news, NASA has contracted with one of its larger aerospace vendors to redevelop the International Space Station (ISS) to "swap a fluorescent lighting panel with a solid-state lighting module (SSLM) containing LED's which produces a blue, whitish or red-colored light depending on the time" of day. By altering the color emitted by the SSLM, it is believed that the ISS environment can be modified to meet the then current needs of the crew and made more conducive to promoting alertness, or sleepiness. Insomnia, and its ramifications to the mission's crew, is a common problem in prolonged space flight. The important note to take away from this is that, hues in the color of the EMVNA are believed, not only to be the easiest to see and process through the brain, but also promote "alertness". According to NASA, "When these LED lights are colored blue, scientists believe that melanopsin—a pigment found in cells in the eye's retina which send nerve impulses to parts of the brain thought to make a person feel alert is stimulated. This blue light is also believed to suppress melatonin—a hormone made by the brain's pineal gland which makes a person feel sleepy when its levels rise in their blood." Alternatively, "by switching from blue to red light—via an intermediary white stage—this process should be reversed, encouraging a feeling of sleepiness."

Flash blindness is caused by bleaching (oversaturation) of the retinal pigment of the eye when high intensity light like that broadcast by emergency strobe lights, or camera flashes, is suddenly flashed into one's eyes. This effect can be even more debilitating in dark settings (like in a fire) when the dark-adapted pupil of the eye is wide open, giving the flash blindness a greater and longer effect. This visual impairment during and following exposure to that light flash may last for a few seconds to a few minutes. In contrast, the EMVNA is specifically designed to deliver a light emission color and intensity that diminishes the chances for occupants to suffer flash blindness when seeking the exits underneath the smoke in the then-dark setting of a smoky fire. Because the EMVNA is designed to be situated at and around the doorway or along low-lying areas when demarking a path of egress, the occupants passing through such an exit porthole will be close to the light. The EMVNA design takes this into account by calibrating its light intensity to a "moderate" effective level of brightness. Its calculated moderation of brightness, specified color and installation configuration substantially diminish the possibilities of creating flash blindness in the individual as he/she passes by the light. This intelligent design is particularly important in time-starved critical moments of an evacuation or relocation of occupants.

Bends. As will be evident, the type of technology used for illuminator 20 is such that illuminator 20 preferably can continue illuminating effectively despite being bent (or junctioned) to course through 90-degree turns such as at the points 18, 19, 149*a* and 149*b* shown in various illustrations or as otherwise needed for outlining doorframes and for the transitions between doors and baseboards, etc. The EL-Wire embodiments of the present invention are preferred in part for this reason—because EL-Wire illuminators can readily be bent at or beyond the 90-degree angles. Despite such sharp bends, EL-Wire does not easily crack or break and will continue to transmit light.

Directionality. "Directionality" in this context refers to the quality of an illumination system or an individual illuminator to indicate to an occupant in structure 100 which way to go toward an exit. A flashing light is considered by authorities and those skilled in the art of fire and life safety appliances to be a critical component of "alerting" occupants to an emergency condition. The flash of a light, itself, can be used to create a directionality for occupants to go or head toward. Hall illumination alone does not indicate directionality, unless the individual sections of the illuminators are specially adapted for directionality as taught herein. However, door illumination does provide directionality because it designates a door through which an occupant can exit. Likewise, an overall illumination subsystem 40 provides directionality by combining hall illumination with exit door illumination, illumination of the exit doors 103-104 communicating to occupants that they are the ways out of the hallway 105, and hall illumination of hallway 105 outlining and illuminating the way to those exit doors 103-104. As described elsewhere herein, the directionality achieved with exit door illumination is further enhanced by coloring the door illumination of exit doors 103-104, preferably to be red in color, thereby highlighting the exit doors 103-104 and further distinguishing them from other portions of hallway 105 that are not so colored.

In addition, individual sections of linear illuminator 20 are specially adapted in certain embodiments to provide directionality even if the occupant is not able to see the exit door illumination or is unable to notice the different colors or the like. The alternatives for providing this type of directionality to illuminator 20 preferably achieve such directionality with one or more of three approaches: (1) adapting and controlling the illuminator to create the illusion that light emitted from illuminator 20 is moving in a particular direction along the length of the linear illuminator 20, preferably toward the exit 103, thereby producing a wave-like motion (for reference, a "wave" or "pulse" effect); (2) providing arrow-shaped images (either dark or light images, through masking) on or in conjunction with the linear illuminator 20 to point in the direction toward an exit 103; and (3) varying the color of illuminator 20 along different sections of wall 106 so that illuminator 20 appears progressively more like the color of exit doors 103-104 for wall sections that are closer to exit doors 103-104, preferably varying from lighter colors to redder colors. Some preferred embodiments combine two of these approaches for hall illumination directionality, while other preferred embodiments just use one of these approaches for hall illumination directionality. Irrespective of the particular type of directionality, illuminator 20 preferably not only illuminates the route to exit doors 103 and 102 (and exit door 203 in FIG. 17), but is also adapted to indicate direction. Hence, someone looking at illuminator 20 in a hall (such as hallway 105) can tell which way to go in order to reach an exit.

Multi-Strand Illuminators. The illuminator 20 in FIG. 18, for instance, is a preferred embodiment that combines three discrete illuminator strands 11-13 that can be energized in successive cycles to produce a pulse effect. While each strand 11-13 is preferably less than a millimeter in diameter (to still enable relative invisibility), each strand 11-13 has the composition of a linear illuminator in and of itself. Using EL-Wire technology as the linear illuminator of each strand 11-13, for instance, each strand includes a central conductor 11*a*-13*a* coated with a phosphorous-based illumination layer 11*b*-13*b* as is characteristic of EL-Wire, and the other components (not shown) as are necessary for EL-Wire technology. To produce a wave effect with such multi-strand construction, each strand is operatively energized in a controlled fashion such that the brightness of its illumination varies in a wave-like manner, and the energizing cycles are timed such that each strand 11-13 is illuminated at the same frequency but out of phase with each other, such that the combined multi-strand illuminator 20 produces the illusion of successive pulses moving along the length of illuminator 20.

Operatively connected to an appropriate control console 40', as depicted in FIG. 10, when illumination controller 41 receives operative power through line 45, the two opposing courses 25-26 that extend from exit door 103 are controlled to create the illusion of pulses moving toward door 103 all along the baseboards 160 as far as the length of the opposite courses 25-26 allow hall illumination to reach. From door 103, for instance, the length of course 25 (including visible portion 21 in FIG. 16) is sufficient to allow installation of hall illumination past doors 132-135. On the opposite side of hallway 105, the length of course 26 (including visible portion 22 in FIG. 16) is sufficient to allow installation of hall illumination past doors 130 and 131. Together, the two courses 25-26 provide an operative pair of illuminator circuits based around exit door 103. Similar pairs of illuminator circuits are preferably installed for each major exit door 103-104 in structure 100, although variations will naturally be made depending on the geometry of the hallway 105 around the corresponding exit door 103-104. As will be understood, additional illuminator circuits (i.e., more than a pair) and/or supplemental controllers 41 or supplemental power supplies and energizers 48 may be added when necessary for more complicated hall geometries.

With reference to FIG. 10, a flash selector toggle switch 37 is provided to enable the pulse effect when desired. If the pulse effect is not enabled, the entirety of courses 25-26 is illuminated steadily, without producing the pulse effect. Control console 40' also has a knob 39 for adjusting the speed that the pulse appears to travel along either course 25-26 of the linear illuminator 20, by adjusting the frequency at which each of strands 11-13 is illuminated.

It is also noted that alternative multi-strand embodiments of linear illuminator 20 may include other numbers of strands 11-13 (two or more) with varying benefits. Still other alternative multi-strand embodiments combine the plurality of strands 11-13 in a manner that is different than a simple twist (as in FIG. 18) while still enabling directionality, by braiding or weaving the strands together or into a supporting substrate.

Arrow-Shaped Directionality Features. Directionality of illuminators 20 can also be achieved by the inclusion of directionally-shaped images on illuminator 20 when energized, either alone or in combination with other directionality features. FIG. 19 shows illuminator 20', for example, as an alternative embodiment of illuminator 20. Strands 11-13 of illuminator 20' are the same as strands 11-13 of illuminator 20. The directionality difference in FIG. 19 is that the circumferential casing 14' of illuminator 20' includes arrow-shaped features 331 and 332. Due to such features 331-332, when illuminator 20' is operatively installed relative to baseboards 160 and energized, the features present arrow-shaped images that point along the length of illuminator 20 in the general direction back toward the origin terminal points above the corresponding exit door 103, to indicate directionality to a viewer.

Preferably, the arrow shaped features 331-332 are clear, arrow-shaped windows on darkened bands 14*b* and 14*d* of the casing 14' of illuminator 20'. Creation of such windows can be achieved in many ways that will be evident, such as by painting, printing or the like, or by the addition of a separable plastic or metal clip that has the arrow-shaped window pre-made in it. The remainder of casing 14' (i.e., the segments 14*a*, 14*c* and 14*e*) are preferably clear, to allow maximum illumination in those segments 14*a*, 14*c* and 14*e*. As alternatives to the head-and-tail arrow shapes shown for features 331-332 in FIG. 19, other arrow shapes may be used as alternatives, such as triangles, deltas, or carrot-shaped images (i.e., greater-than/less-than symbols) either alone or as multiple images grouped in series. As will be evident, darkened arrow-shaped features against an illuminated background can be fabricated as an alternative to the clear windows against a darkened band as in FIG. 19.

By also incorporating the mounting flange 320 (described elsewhere herein with reference to FIG. 14) in the construction of illuminator 20', the position of arrow-shaped features 331 and 332 is pre-determined relative to the likely vantage point of a person viewing it after it has been operatively installed and illuminated during operation. More particularly, in the cross-sectional orientation shown in FIG. 19 with the cross-section of casing 14' considered as a clock-face for reference, such that flange 320 is positioned vertically at 6:00 (six o'clock), the position of the center of arrow-shaped features 331-332 is shown at two o'clock (2:00, or 60° offset from the vertical flange 320) and preferably is positioned either at 12:00 (twelve o'clock) or within the range of 1:00 to 2:30 (one o'clock to two-thirty). For reference, each of such positions is referred to as being on a surface of illuminator 20' opposite flange 320, and any positions in the range of 1:00 to 2:30 are referred to as positions having an "obtuse off-set from the vertical." Although not visible in FIG. 18, a similar arrow-shaped feature is included on the back side of illuminator 20' at a mirror-image orientation relative to the centerline of flange 320, to allow illuminator 20' to be installed in a reverse orientation. As will be understood, with embodiments where the arrow-shaped features 331-332 are positioned at twelve o'clock, no such mirror image is included because the mirror image would be at the same location as the primary image. All such orientations of arrow-shaped images 331-332 are positions that enable viewing of the same by an occupant in hallway 105.

In alternative embodiments, arrow-like shapes are illuminated (or masked) adjacent (or across the face of) groove 165 to indicate the appropriate direction to a fire exit, to be illuminated by the proximity of the arrow-like shapes to the linear illuminator 20.

Color Coding. Another feature of preferred variations of linear illuminator 20 is the use of color to indicate directionality and aid occupants in more readily locating the Exit doorways 102-103. As mentioned earlier, a distinctive color (preferably red) can be rendered onto the linear illuminator 20 in those portions that surround (or are near, in some embodiments) the exit doors 102 and 103 to provide a very basic level of color directionality for the illumination subsystem 40. Most preferably, color differentiation differentiates exit door illumination from hall illumination, but in some embodiments it may also differentiate door illumination of an exit door 103 from door illumination of an upstream door. Such color is applied to the illuminator 20 either with a thin layer of transparent red paint, stain or the like, or by applying a transparent colored jacket, preferably made from fire retardant materials. The use of a fire-retardant spray can further enhance the fire retardant nature of illuminator 20.

Alternative embodiments also employ other uses of color-coding in addition to the red highlighting of exit doors. In such embodiments, generally in addition to the colored door illumination, the color of the hall illumination changes progressively for portions of the illuminator that are further away from the exit door 103. Preferably, the color progression begins at points 18-19 as the same color as illuminator 20 around door 103, and becomes more and more distinct from the color of the door illumination as it progresses away from door 103. So, with door illumination at exit door 103 preferably red, beginning at the base of either side of the exit door (at points 18-19 in FIG. 19), the color of linear illuminator 20 emits increasingly pale (less red) light along the bottom of wall 106 until it displays as a white band of light (no red at all) in the area furthest from the exit door 103. Baseboard linear illuminator 20 leading from upstream or non-exit doors towards the closest (or perhaps the safest) exit stairwell or exit door will likewise preferably display light that progresses from white to increasing redness as the stairwell or exit door are approached.

In some cases, authorities, such as fire departments in major cities, such as the FDNY of New York City, N.Y., have indicated a desire to deploy the EMVNA technology to indicate to responding fire and rescue personnel where a dangerous or hazardous location might exist in a building. In circumstances such as this, alternate coloration of the Light-Strands would be necessitated in an effort to clearly indicate to such responding personnel that the area(s) behind the door or portal have differing firefighting protocols and firefighting needs and concerns. This would be the case with doors leading to boiler rooms, sub-power stations, building battery rooms and the like where the prescribed actions of firefighting personnel are defined differently from normal firefighting actions in other portions of the structure. As an example of this contemplated use, officers of the FDNY have suggested that the LightStrands would be "red" in color around doorways that lead into building battery array room that serve any given building in order to alert the firefighters in the fire scene to the existence of the battery room and to signal their need to treat this area of the building differently or with added caution. This concept could be used to establish different door color coding for different types of rooms or areas for a variety of life saving measures where the EMVNA LightStrands would have various colors, in turn signaling various firefighting protocols to be initiated by the local fire authority while fighting a fire in the building, structure or facility.

As will be evident, rather than a continuously gradual color progression for the hall illumination, the progression of color may be achieved in steps, where every so many feet of hall illumination is the same color, and the next so many feet is slightly lighter in color, etc. Many other ways of progressively changing the color will be evident to those of skill in the arts. Some alternative patterns for color progression used to indicate directionality and aid in navigating to doorways and in particular the exit doors 102-103: white gradually turning red hall illumination closer to exit doors 102-103; red around frame of exit door; white around frame of hallward side of internal upstream door; alternating red-white-red around frame of exit doorway.

Still other alternatives use differing colors on the upstream side of a door versus the downstream side of a door. Referring back to FIG. 15, for example, preferred embodiments include red color in the portion of linear illuminator 20 that surrounds the upstream side of door 130, illuminator 20 being fastened to outline the door frame molding 150 of the door 130 leading to the hallway 105 beyond. In contrast, the hallward side of the same door 130 is preferably relatively dark or, in alternative embodiments, the hallward side is illuminated the same color as the adjacent hall illumination. Hence, occupants in the rooms 110-128 and hall 105 can also understand the right direction to proceed based on color directionality, following the baseboard 160 linear illuminator 20 in the direction of increasing redness until the red exit door 103 is reached.

Static Door Illumination Combined with Pulsed Hall Illumination. In one particularly preferred embodiment, connectors, colors, arrows and pulsation are all combined to provide an overall illumination circuit with beneficial characteristics, among which are the combination of static door illumination with pulsed hall illumination.

Preferably, the static/pulsed combination is accomplished by splicing together and installing an individual circuit of two different types of multi-strand illuminators 20 arranged in alternating succession. One of the alternating types is constructed with twisted wire to produce the pulse effect when energized (as in FIG. 18), while the other is not. The other type (for "static" sections), which illuminates without a pulse effect, is constructed instead of parallel (i.e., non-twisted) strands 11-13 such that a pulse does not appear to travel down its length. Both for simplicity of keeping static sections differentiated from the others during installation, and for the purpose of highlighting doors with a different color, the static sections of illuminator 20 are preferably delivered to the structure 100 of installation with a transparent red color already incorporated in their outer casing 14. The static sections are also prepared in advance in lengths that match the distance needed for sections 20" (numbered in FIG. 15) that fit around the perimeter of the standard sized doors for structure 100.

As will be understood, rather than splicing together two different types of illuminator 20, the static/pulsed combination can also be fabricated from continuous strands 11-13—either sheathed in casing 14 at the site of installation, or produced and sheathed at the factory based on measurements of the needed dimensions and arrangements for each type of multi-strand illuminator 20 given the spacing of the doors in a given hall.

One particularly preferred way of achieving directionality is achieved by embodying each illuminator is constructed as a twisted combination of two, three or more EL-Wires (or other illuminators) contained in a clear jacket, sleeve or casing, as illustrated in FIG. 18. With such twisted (or alternatively, braided) combinations of multi-strand illuminators are then controlled in a sequentially flashing manner to simulate visual motion to indicate direction toward the nearest or best choice of the appropriate exit doors 203 or 204. FIG. 10 is a pictorial illustration of the control box 40' for at least one alternative embodiment of the illumination subsystem 40 depicted in FIG. 19.

Other Types of Linear Illuminators. Although some aspects of the present invention directly relate to use of electroluminescent wire, other aspects can be appreciated in alternative embodiments with the use of other linear lighting technology, even including illuminators that are technically non-linear but that become linear illuminators through combinations of multiple non-linear illuminators. Several of the possible linear illuminators would fall into the LED (Light Emitting Diode) lighting family. Particularly, LED light sources that would lend themselves to different embodiments of the present invention include:

- Low-voltage LED Rope/Wire lighting: [Rope Light is made of highly durable flexible linear solid transparent or colored PVC tube with a series/parallel arrangement of sub-miniature LED light bulbs],
- LED Ribbon Lighting: [LED FLEX RIBBON STRIP is a low voltage LED lighting in a flexible thin strip incased in a plastic weather resistance coating.]
- LED Flexible Neon lighting [LED NEON-FLEX is made of an inner plastic extrusion that houses a flexible linear series of individual low voltage LED lights and has an outer transparent plastic jacket to further protect the inner tube of lights. Laser-Wire and other luminaries made by this manufacturer (known to be produced and sold by Ellumiglow.com, of Portland, Oreg.), LED NEON-FLEX is comprised of solid-state Light Emitting Diodes (LED's) in series housed by an inner plastic extrusion core, and a UV stable outer plastic jacket further protects the inner core and is available in a vast array of colors.]

In most embodiments of the present invention, these LED lighting components would preferably be sized in the 0.15 mm to 5 mm sizes and the flexible nature of these light sources enable one to attach it to any flat or curved surface in installation. The LED lights are covered by silicon coating or a PVC jacket which makes the lighting source able to withstand great strain, pressure and stress without tearing or breaking, and they are weather resistant and water proof.

Laser-illuminated fiber optic filaments such as side-light and end-light plastic optical fiber (often called "POF" or "fiber") which is an optical fiber made out of plastic. Traditionally PMMA (acrylic) is the core material, and fluorinated polymers are the cladding material. These plastic optical fibers are designed for flexible and controlled light transfer of light from one point to another and along the sides of the cable/fiber no matter the visible color of the light source. The light can be transferred over long distances without much visible changing of the input color. In some instances, a careful mechanical treatment of the fiber surface could produce a side glow line of visible light. Many fiber optic cables are composed of several individual strands of PMMA acrylic fibers (also referred to as plastic fiber optic cable) covered by a clear PVC coating. All fiber optic lighting utilizes an illuminator is often referred to as the light engine, light pump, light source and even transformer which is affixed to one end of the cable that pumps the light through the length of the cable. The illuminator houses the lamp that provides the light for the fiber optic cable. The fiber is connected to the illuminator via a fiber head. One fiber optic preferred embodiment is multimode, multi-strand, OFNP cable.

Any of the aforementioned alternatives can provide numerous advantages that may substitute for EL-Wire benefits. LED systems can also be adapted to approximate a linear illuminator and, indeed, provide alternate ways of achieving sequencing of the illumination in order to indicate directionality. It should also be understood that illumination may also be achieved by using still other technologies that have not been mentioned in this description. Among such other options would be organic LED (OLED) technologies, LCD technologies, or excitable inert gasses such as neon or halogen lighting.

To the extent achievable with the technology utilized for linear illuminators 20 that form the courses 25 and 26, controller 41 (referenced in FIG. 9) is preferably adapted to control illumination of courses 25 and 26 to be illuminated either continuously or in a sequencing manner by use of toggle switch 37 (referenced in FIG. 10). The sequencing manner refers to any manner that achieves the pulse effect as has been described previously herein, or the equivalent, in order to indicate directionality to the hall illumination, thereby communicating the direction that someone should move in order to reach an exit.

Certain uses or installation circumstances present opportunities for alternative embodiments to utilize forms of conspicuous linear illuminators, which have dimensions much larger in diameter than the preferred range for inconspicuous illuminators 20 referenced previously. While the inconspicuous variations have diameters of 3.5 mm or less, the conspicuous embodiments have diameters greater than 3.5 mm but preferably less than 15 mm. Although such conspicuous embodiments compromise on some aspects of the inconspicuous embodiments, the conspicuous embodiments are still suitable for applications where inconspicuousness is not a concern. Such applications may be in industrial and commercial settings where aesthetics are of little relative importance. Moreover, the conspicuous embodiments generally produce brighter illumination when energized, given the increased size of the illuminator.

It should also be understood that still other alternative embodiments may incorporate features outside of the ranges described as "preferred" while still enjoying the benefit of remaining aspects of the invention. Some embodiments, for example, involve combining multiple sizes and colorations of differing types of illuminator components, not only differing in diameter sizes, but also differing in the color of light that is used for illumination. Indeed, certain alternative embodiments employ multi-wavelength illuminators to transmit both visible and infrared light to enhance visibility for firefighters using infrared vision. Such multi-wavelength illuminators have been found particularly beneficial with fiber optic laser illuminators that produce a dual beam in the same fiber-optic cable.

As described in part, still other embodiments use different types of technology for achieving illumination. Embodiments of aspects of the invention that are not limited in the type of technology may also combine more than one type of illumination technology, such as by combining EL-Wire together with LED components or Fiber Optic Laser Fiber (s), or vice versa, all interconnected in the same system in a given structure 100 or portion of that building structure. Indeed, such differential combinations enable an installer to provide the benefits of using EL-Wire for long halls, together with the benefits of fiber optic illumination for exit doors, all in combination with sequenced LED illuminators in sections where more variable directionality is desired.

Although some aspects of the present invention directly relate to use of electroluminescent wire, other aspects can be appreciated in alternative embodiments with the use of other linear lighting technology. Feasible alternatives for certain aspects of the invention utilize low-voltage LED wire or flexible LED strips, such as the 0.15 mm super thin BTgreen LED strip available from Betop Electronics Company, Ltd. Laser-illuminated fiber optic filaments also provide numerous advantages that may substitute for EL-Wire benefits. LED systems can also be adapted to approximate a linear illuminator and, indeed, provide alternate ways of achieving sequencing of the illumination in order to indicate directionality. Non-linear lighting technologies can be implemented in still other ways that either approximate a linear illuminator or achieve an equivalent result.

Irrespective of the particular type of technology used for illuminator 20, illuminator 20 preferably optimizes illumination, uses minimal power and simple transceiver equipment, is lightweight yet wide and/or brilliant enough to be highly visible when energized, and is cost-effective.

Casing Material Alternatives. The materials incorporated in and/or encasing illuminator 20 are preferably fire-resistant and/or fire-retardant. Several options are available commercially in EL-Wire and fiber optic cable, and it is expected that similar fire resistance and retardant characteristics could be made in other variations of illuminator 20 through substitution of materials or the addition of fire retardant coatings or casings. When not inherently fire retardant, illuminator 20 is preferably encased in transparent, specially-treated, fire-retardant casings or jackets 14 such as "Low Smoke Zero Halogen" (LSZH) jackets or as is commercially available under the "Plenum" designation. Flame Seal Products, Inc. also offers an Intumescent Fire Barrier Coating that may be used to provide an invisible coating that reportedly can be sprayed onto the linear illuminator 20 as a thin 18-mil coating to render the illuminator fire retardant. As an alternative, such materials can be applied onto the illuminator 20 and associated components and assemblies after they have been operatively installed in structure 100.

Preferably, for any illuminator alternatives that are not fire resistant or fire retardant in and of themselves, either a "Plenum" jacket or a LSZH jacket is used as the outer casing 14 of the illuminator to provide fire resistance in compliance with regulatory guidelines. Either of such jacket types provides a fire retardant jacket 14 that is slow-burning and emits little smoke during combustion. Installations using Plenum-rated jacketing help to ensure the safety of personnel by reducing the spread of dangerous gases in the event of a fire.

Wireless Sensors and Related Applications. In still other alternative embodiments, remote wireless actuators can be used in any of the referenced configurations to trigger activation of the illumination subsystem 40 or variations of that system. While using such wireless actuators is beneficial for numerous applications of the invention, particular benefits can be appreciated in residential or post-construction security applications, particularly where the monitoring subsystem is installed in a pre-existing structure. RF (Radio Frequency) transmitter/receiver triggering mechanisms allow installation of strips of the product under windows, in corridors, etc., where AC power is either not available or is economically unfeasible. RF capacity would operate on a frequency(ies) designed for same that would turn on the remote battery pack(s) associated with the controllers 41 installed in remote areas of the building structure. Such signal would be triggered by a signal transmitter switch mechanism triggered by the emergency response subsystem 24.

Quick-Release. As will be evident to those of skill in the art, in most embodiments, each of the entire courses of illuminator 20 may either be one continuous linear illuminator, or it may be composed of various segments that are spliced together using a suitable connector that transfers the necessary illuminating energy over the discontinuity in the linear illuminator. Such splicing of discontinuities in linear illuminator 20 preferably involves cutting, preparing the terminal ends (sanding or otherwise), approximating the opposed ends adjacent each other, and then applying an appropriate connector. Similar illuminator adaptation mechanisms can also be used for connecting the illuminator cables to the alarm system control module. When the distances to be illuminated are particularly lengthy, repeater units or supplemental power steps will also be included as needed. The extent of hallway 105 to be illuminated preferably is such that the illuminator from one door extends as far down the hall as designers want occupants to be directed toward the subject exit door, presumably to the center of the hall.

The device may utilize any form of illumination, including but not limited to a laser light source, a linear light source and/or a single or multiple braided or twisted strands of electroluminescent wires (possibly wrapped in a single translucent or colored PVC jacket), side-light emitting plastic optical fiber, reflective mirrors possibly in conjunction with reflective luminescent paints, sprays, strips, tapes or adhesives containing of reflective material(s) to enhance the devices luminescence around and/or near a safe exit portal of an enclosed or semi-enclosed structure.

The device may be triggered by any or all of an audible emergency fire protection alarm system, such as smoke detectors, carbon monoxide detectors or other emergency alarms or detection systems that emit an audible alarm and/or may be triggered by its own sensing devices included in its construction.

The device may be directly connected to its own DC powered battery source and, in some alternative embodiments it is powered by an alternative AC current electrical power source or system, both of which power and support the operation thereof. In an embodiment with directional illumination source, the AC or DC current energizes the electrical components comprising the device which may channel the electrification through the light source in a sequence from one line to the next repeatedly and continuously which causes the light to provide the visual perception of light moving laterally and directionally from one end of the wire to the opposite end of the wire while simultaneously providing an uninterrupted line of floor level directional lighting that is inconspicuous until activated by an emergency signal.

The luminary portion of the device may be located near floor level to provide evacuees with better visibility in smoke environments. The lighting and system, in general, may be operated repetitively and nondestructively to allow inclusion of the lighting and system in fire and other emergency drills and/or to train building structure occupants in such drills. In some embodiments, the linear emergency light source may be constructed of a laser light source wherein the laser light is triggered immediately by the audible tones and/or frequencies of smoke alarms or other alarms or by the device's own internal sensing device(s) and such laser light is directed along the outside periphery of an exit door and/or along the floor area near such door immediately adjacent thereto by using side-light emitting plastic optical fiber and/or a series of small mirrors which appropriately direct the laser beam/light along the periphery of the exit door and three (3) wound electroluminescent wires (possibly contained in one (1) clear jacket) which is laid upon or otherwise specifically adhered or affixed around and along the periphery of an exit door, window, stairwell/staircase and then laterally along the top of base molding along the floor in areas abutting, adjacent to or proximate to such doors, windows or stairwells. The device may also be installed along a corridor wall laterally or in other areas where required light may be required to demark a safe path or exit for an evacuee in a structure incurring fire, smoke or other peril.

Whether now known or later discovered, there are countless other alternatives, variations and modifications of the many features of the various described and illustrated embodiments, both in construction and in operation, that will be evident to those of skill in the art after careful and discerning review of the foregoing descriptions, particularly if they are also able to review all of various systems and methods that have been tried in the public domain or otherwise described in the prior art. All such alternatives, variations and modifications are contemplated to fall within the scope of the present invention. Although the present invention has been described in terms of the foregoing preferred and alternate embodiments, this description has been provided by way of explanation of examples only and is not to be construed as a limitation of the invention, the scope of which is limited only by the claims of any related patent applications and any amendments thereto.

The invention claimed is:

1. A system for enabling visual orientation and providing illumination to evacuees in the event of an emergency requiring evacuation of a residential, commercial, industrial, institutional, vehicular or marine structure or enclosure having portals such as doorways, passageways and/or egress windows, wherein there is a planned path of safe emergency egress from an interior space such as a room, quarters or hallway of said structure or enclosure and wherein said planned path passes through a portal such as an interior or exterior doorway or window of said structure or enclosure, said system comprising:

a housing mountable relative to a wall of said interior space;

an electricity source;

an illuminator, at least a portion of said illuminator being positionable on a portion of said wall;

an energizer mounted relative to said housing and associated with said illuminator, said energizer being electrically powered;

a signal generator mounted relative to said housing and associated with said energizer, said signal generator being adapted to generate a trigger signal in response to a signal produced by a danger detector such as a fire detector, smoke detector, carbon monoxide detector, earthquake detector, power failure detector, radon gas detector, or a monitoring system that itself produces signals in response to one or more other danger detectors; and a controller mounted relative to said housing and being associated with said electricity source and said signal generator, said controller being operatively connected to control a supply of electricity from said electricity source to cause operation of said energizer, to thereby enable said illuminator to illuminate, in the event that said signal generator generates a trigger signal in response to a danger detector signal.

2. The system as in claim 1, further comprising an electrical connector whereby said system is connected with a control panel associated with a security system, an emergency lighting system, and/or an access control system located within said structure or enclosure such that said system is hard-wired to and integrated with said security system, said emergency lighting system, and/or said access control system, whereby said control panel energizes said illuminator to illuminate upon detection of a condition by said security system, said emergency lighting system, and/or said access control system including a security breach, power failure, and/or a breach of controlled access.

3. The system as in claim 1, further comprising a rechargeable power source, said rechargeable power source being in electrical communication with an alternating current (AC) power source, wherein said AC power source recharges said rechargeable power source, said system further comprising said controller being adapted and connected to control a supply of electricity from said rechargeable power source to cause actuation of said energizer in the event of a power failure in said structure or enclosure, whereby said controller causes said energizer to illuminate said illuminator in a steady mode as an emergency light source.

4. The system as in claim 1, wherein said rechargeable power source comprises a battery backup system, and wherein said battery backup system comprises a wall pack.

5. The system as in claim 1, wherein said illuminator comprises an electroluminescent light source.

6. The system as in claim 5, wherein said electroluminescent light source comprises a strand of electroluminescent wire.

7. The system as in claim 6, wherein said strand of electroluminescent wire provides a bright aqua blue illumination when energized by said energizer, and wherein said bright aqua blue illumination is highly visible to evacuees in said interior space.

8. The system as in claim 1, wherein said electricity source comprises a rechargeable battery, said rechargeable battery being associated with a photocell, said photocell being adapted to provide a trickle charge to said rechargeable battery.

9. The system as in claim 1, wherein at least a segment of said illuminator is installed on a lower portion of said wall by direct adhesives, tapes and/or mechanical fasteners.

10. The system as in claim 1, wherein said housing is adapted to be mounted on the top edge of a trim member on a wall surface in close proximity to said portal using direct adhesives or mechanical fasteners.

11. The system as in claim 10, wherein said housing comprises a low-profile injection-molded housing, and wherein said energizer and said controller are contained within said low-profile injection-molded housing.

12. The system as in claim 1, wherein one or more components of said system are contained in protective materials, said protective materials being waterproof.

13. The system as in claim 1, further comprising a controller associated with said energizer for regulating illumination of said illuminator, and wherein said controller is adapted such that said energizer energizes said illuminator to flash in a pattern.

14. The system as in claim 1, wherein said illuminator is installed in a routed channel at any elevation in or on said wall, in molding or trim, and/or in a floor of said structure or enclosure.

15. The system as in claim 1, wherein said illuminator comprises a linear illuminator.

16. The system as in claim 15, wherein said linear illuminator is installed such that two courses run on opposite sides of said hallway, in a direction away from said portal, a first of said two courses including a segment that runs at a low height, such as along a floor or a first baseboard of said hallway, and a second of said two courses including a segment that runs on an opposite wall at a low height, such as along said floor or a second baseboard of said hallway, to designate said planned path toward said portal.

17. The system as in claim 16, wherein a segment of said linear illuminator is installed along the perimeter of said portal, for illuminating the perimeter of said portal to aid in identification of said portal.

18. The system as in claim 1, further comprising a controller associated with said energizer for regulating illumination of said illuminator, and wherein said controller is adapted to actuate said energizer in response to a radio frequency (RF) switching mechanism initiated in response to detection of emergency conditions by said danger detector.

19. The system as in claim 1, wherein said signal generator comprises an audio sensor that generates a trigger signal in response to an audio signal produced by a detector such as a fire detector, smoke detector, carbon monoxide detector, or radon gas detector when emergency conditions are detected, said audio sensor being mounted in said housing.

20. A system for enabling visual orientation and providing illumination to evacuees in the event of an emergency requiring evacuation of a residential, commercial, industrial, institutional, vehicular or marine structure or enclosure having portals such as doorways, passageways and/or egress windows, wherein there is a planned path of safe emergency egress from an interior space such as a room, quarters or hallway of said structure or enclosure and wherein said planned path passes through a portal such as an interior or exterior doorway or window of said structure or enclosure, said system comprising:

a housing mountable relative to a wall of said interior space;

an electricity source;

an illuminator comprising at least two linear illuminator segments installed on portions of said wall, a first segment of said at least two linear illuminator segments being installed at a low height in said interior space, parallel to and along a floor of said interior space such as along a baseboard, and a second segment of said at least two linear illuminator segments being installed along a perimeter of said portal;

an energizer mounted relative to said housing and associated with said illuminator, said energizer being electrically powered; and a controller mounted relative to said housing and being associated with said electricity source, said controller being operatively connected to control a supply of electricity from said electricity source to cause operation of said energizer, to thereby enable said first and second segments of said at least two linear illuminator segments to illuminate during emergency conditions, thereby illuminating said perimeter of said portal to aid in identification of said portal.

21. A system for enabling visual orientation and providing illumination to evacuees in the event of an emergency requiring evacuation of a residential, commercial, industrial, institutional, vehicular or marine structure or enclosure having portals such as doorways, passageways and/or egress windows, wherein there is a planned path of safe emergency egress from an interior space such as a room, quarters or hallway of said structure or enclosure and wherein said planned path passes through a portal such as an interior or exterior doorway or window of said structure or enclosure, said system comprising:

a housing mountable to a wall of said interior space;

an electricity source within said housing;

an illuminator, at least a portion of said illuminator being positionable on a portion of said wall;

an energizer for said illuminator, said energizer being mounted within said housing;

a sensor that generates a trigger signal in response to an audible, visual or wireless signal produced by a detector such as a fire detector, smoke detector, carbon monoxide detector, or radon gas detector when emergency conditions are detected, said sensor being mounted in said housing;

a controller mounted within said housing and associated with each of said electricity source, said sensor, and said energizer, said controller being adapted and connected to control a supply of electricity from said electricity source to cause actuation of said energizer in the event said sensor generates said trigger signal, whereby said controller causes said energizer to illuminate said illuminator in response to said trigger signal;

an electrical connector whereby said system is in electrical communication with a control panel, said control panel being associated with a security system, an emergency lighting system, and/or an access control system within said structure or enclosure such that said system is hard-wired to and integrated with said security system, said emergency lighting system, and/or said access control system, and wherein said control panel is adapted to energize said illuminator to illuminate upon detection of a condition including a security breach, a power failure, and/or a breach of controlled access;

a rechargeable power source being in electrical communication with an alternating current (AC) power source, wherein said AC power source recharges said rechargeable power source, said system further comprising said controller being adapted and connected to control a supply of electricity from said rechargeable power source to cause actuation of said energizer in the event of a power failure in said structure or enclosure, whereby said controller causes said energizer to illuminate said illuminator in a steady mode as an emergency light source;

said rechargeable power source comprises a battery backup system;

said controller being calibrated such that said energizer energizes said illuminator to flash in a pattern;

said illuminator comprises an electroluminescent light source, wherein said electroluminescent light source comprises a strand of electroluminescent wire, and wherein said strand of electroluminescent wire comprises a clear, flexible, sleeve-like outer casing;

said illuminator is installed on a lower portion of said wall by direct adhesives, tapes, and/or mechanical fasteners;

said illuminator comprises a linear illuminator;

said linear illuminator is installed such that two courses run at a low height on opposite sides of said hallway, to designate said planned path toward said portal, and wherein a segment of said linear illuminator is installed along the perimeter of said portal, for illuminating the perimeter of said portal to aid in identification of said portal;

said housing comprises an enclosure, wherein said enclosure is recessed into said wall such that said enclosure is flush with the surface of said wall;

said housing further comprises a low-profile injection-molded housing, and wherein said energizer and said controller are contained within said low-profile injection-molded housing;

said controller is further adapted to actuate said energizer in response to a radio frequency (RF) switching mechanism initiated in response to detection of emergency conditions by said detector; and said sensor is an audio sensor that generates a trigger signal in response to an audio signal produced by a detector such as a fire detector, smoke detector, carbon monoxide detector, or radon gas detector when emergency conditions are detected, said audio sensor being mounted in said housing.

* * * * *